US011653162B2

(12) United States Patent
Wübbolt et al.

(10) Patent No.: US 11,653,162 B2
(45) Date of Patent: May 16, 2023

(54) APPARATUSES FOR CONVERTING AN OBJECT POSITION OF AN AUDIO OBJECT, AUDIO STREAM PROVIDER, AUDIO CONTENT PRODUCTION SYSTEM, AUDIO PLAYBACK APPARATUS, METHODS AND COMPUTER PROGRAMS

(71) Applicant: Fraunhofer-Gesellschaft zur Förderung der angewandten Forschung e.V., Munich (DE)

(72) Inventors: Oliver Wübbolt, Erlangen (DE); Achim Kuntz, Erlangen (DE); Christian Ertel, Erlangen (DE); Sascha Dick, Erlangen (DE); Frederik Nagel, Erlangen (DE); Matthias Neusinger, Erlangen (DE)

(73) Assignee: Fraunhofer-Gesellschaft zur Förderung der angewandten Forschung e.V., Munich (DE)

( * ) Notice: Subject to any disclaimer, the term of this patent is extended or adjusted under 35 U.S.C. 154(b) by 0 days.

(21) Appl. No.: 16/943,778

(22) Filed: Jul. 30, 2020

(65) Prior Publication Data

US 2020/0359149 A1 Nov. 12, 2020

Related U.S. Application Data

(63) Continuation of application No. PCT/EP2019/052156, filed on Jan. 29, 2019.

(30) Foreign Application Priority Data

Jan. 30, 2018 (EP) ..... 18154307.5
Aug. 8, 2018 (WO) ..... PCT/EP2018/025211

(51) Int. Cl.
*H04S 3/00* (2006.01)
*H04S 7/00* (2006.01)

(52) U.S. Cl.
CPC ..... *H04S 3/002* (2013.01); *H04S 7/302* (2013.01); *H04S 2400/01* (2013.01); *H04S 2400/11* (2013.01)

(58) Field of Classification Search
CPC ..... H04S 3/002; H04S 7/302; H04S 2400/01; H04S 2400/11
See application file for complete search history.

(56) References Cited

U.S. PATENT DOCUMENTS

2003/0061001 A1 3/2003 Willins et al.
2012/0051565 A1 3/2012 Iwata et al.
(Continued)

FOREIGN PATENT DOCUMENTS

CN 103650535 A 3/2014
CN 104956695 A 9/2015
(Continued)

OTHER PUBLICATIONS

"Advanced sound system for programme production", Recommendation ITU-R BS 2051-1; ITU-R Radiocommunication Sector of ITU; 22 pages, Jun. 2017.
(Continued)

*Primary Examiner* — Ping Lee
(74) *Attorney, Agent, or Firm* — Perkins Coie LLP; Michael A. Glenn

(57) ABSTRACT

An apparatus for converting an object position of an audio object from a Cartesian representation to a spherical representation is described. A basis area of the Cartesian representation is subdivided into a plurality of basis area triangles, and wherein a plurality of spherical-domain triangles are inscribed into a circle of a spherical representation. The apparatus is configured to determine, in which of the basis area triangles a projection of the object position of the audio object into the base area is arranged; and the apparatus is
(Continued)

configured to determine a mapped position of the projection of the object position using a linear transform, which maps the base area triangle onto its associated spherical domain triangle. The apparatus is configured to derive an azimuth angle and an intermediate radius value from the mapped position. The apparatus is configured to obtain a spherical domain radius value and an elevation angle in dependence on the intermediate radius value and in dependence on a distance of the object position from the base area. An apparatus for converting an object position of an audio object from a spherical representation to a spherical representation, applications of these apparatuses, methods and computer programs are also described.

77 Claims, 26 Drawing Sheets

(56) References Cited

U.S. PATENT DOCUMENTS

| | | | |
|---|---|---|---|
| 2013/0142342 | A1 | 6/2013 | Del et al. |
| 2014/0119581 | A1 | 5/2014 | Tsingos et al. |
| 2014/0219455 | A1 | 8/2014 | Peters et al. |
| 2017/0011751 | A1 | 1/2017 | Fueg et al. |
| 2017/0013388 | A1 | 1/2017 | Fueg et al. |
| 2017/0280264 | A1 | 9/2017 | Wang et al. |
| 2018/0020310 | A1 | 1/2018 | Crockett et al. |

FOREIGN PATENT DOCUMENTS

| | | | |
|---|---|---|---|
| CN | 105898668 | A | 8/2016 |
| CN | 106463128 | A | 2/2017 |
| CN | 106465034 | A | 2/2017 |
| CN | 107509141 | A | 12/2017 |
| EP | 2809088 | A1 | 12/2014 |
| EP | 2958339 | A1 | 12/2015 |
| EP | 3061269 | A1 | 8/2016 |
| EP | 3223542 | A2 | 9/2017 |
| JP | 2015179986 | A | 10/2015 |
| RU | 2589469 | C2 | 7/2016 |
| WO | 2014160576 | A2 | 10/2014 |
| WO | 2015144409 | A1 | 10/2015 |
| WO | 2016109065 | A1 | 7/2016 |
| WO | 2016172254 | A1 | 10/2016 |
| WO | 2016210174 | A1 | 12/2016 |
| WO | 2017027308 | A1 | 2/2017 |
| WO | 2017085562 | A2 | 5/2017 |
| ZA | 200503594 | B | 8/2006 |

OTHER PUBLICATIONS

"Information technology—High efficiency coding and media delivery in heterogeneous environments", Part 3: 3D audio; ISO/IEC JTC 1/SC 29, Feb. 20, 2015; 438 pages.

"Multichannel sound technology in home and broadcasting applications", ITU-R Radiocommunication Sector of ITU, Feb. 2015, 86 pages.

Example of a Cartesian parameter room with corresponding loudspeaker positions for a 5.1 + 4H

| | $P_1$ | $P_2$ | $\widetilde{P}_1$ | $\widetilde{P}_2$ |
|---|---|---|---|---|
| 1 (green) | (1,1) | (-1,1) | $(\sin 30° = \frac{\sqrt{3}}{2}, \cos 30° = \frac{1}{2})$ | $(-\frac{\sqrt{3}}{2}, \frac{1}{2})$ |
| 2 (purpel) | (-1,1) | (-1,-1) | $(-\frac{\sqrt{3}}{2}, \frac{1}{2})$ | (-0.93969, -0.34202) |
| 3 (red) | (-1,-1) | (1,-1) | (-cos (110° - 90°)= -0.93969, -sin (20°)=-0.34202) | (0.93969, -0.34202) |
| 4 (white) | (1,-1) | (1,1) | (0.93969, -0.34202) | $(\frac{\sqrt{3}}{2}, \frac{1}{2})$ |

Fig. 7A

| Middle layer of 5.1+4H loudspeaker set-up (elevation $\theta=0°$) | | | | |
|---|---|---|---|---|
| | $P_1$ | $P_2$ | $\widetilde{P}_1$ | $\widetilde{P}_2$ |
| 1 (green) | (0,1) | (-1,1) | $\varphi_{sp}=0°$, $r_{sp}=1$ | $\varphi_{sp}=30°$, $r_{sp}=1$ |
| | | | (0, 1) | $(-\frac{1}{2}, \frac{\sqrt{3}}{2})$ |
| 2 (purple) | (-1,1) | (-1,-1) | $\varphi_{sp}=30°$, $r_{sp}=1$ | $\varphi_{sp}=110°$, $r_{sp}=1$ |
| | | | $(-\frac{1}{2}, \frac{\sqrt{3}}{2})$ | (-0.93969, -0.34202) |
| 3 (red) | (-1,-1) | (1,-1) | $\varphi_{sp}=110°$, $r_{sp}=1$ | $\varphi_{sp}=-110°$, $r_{sp}=1$ |
| | | | (-0.93969, -0.34202) | (0.93969, -0.34202) |
| 4 (yellow) | (1,-1) | (1,1) | $\varphi_{sp}=-110°$, $r_{sp}=1$ | $\varphi_{sp}=-30°$, $r_{sp}=1$ |
| | | | (0.93969, -0.34202) | $(\frac{1}{2}, \frac{\sqrt{3}}{2})$ |
| 5 (blue) | (1,1) | (0,1) | $\varphi_{sp}=-30°$, $r_{sp}=1$ | $\varphi_{sp}=-0°$, $r_{sp}=1$ |
| | | | $(\frac{1}{2}, \frac{\sqrt{3}}{2})$ | (0, 1) |

Fig. 21A

APPARATUSES FOR CONVERTING AN OBJECT POSITION OF AN AUDIO OBJECT, AUDIO STREAM PROVIDER, AUDIO CONTENT PRODUCTION SYSTEM, AUDIO PLAYBACK APPARATUS, METHODS AND COMPUTER PROGRAMS

CROSS-REFERENCES TO RELATED APPLICATIONS

This application is a continuation of copending International Application No. PCT/EP2019/052156, filed Jan. 29, 2019, which is incorporated herein by reference in its entirety, and additionally claims priority from European Application No. EP 18154307.5, filed Jan. 30, 2018, and International Application PCT/EP2018/025211, filed Aug. 8, 2018, both of which are incorporated herein by reference in their entirety.

Embodiments according to the invention are related to apparatuses for converting an object position of an audio object from a Cartesian representation to a spherical representation and vice versa.

Embodiments according to the invention are related to an audio stream provider.

Further embodiments according to the invention are related to an audio content production system.

Further embodiments according to the invention are related to an audio playback apparatus.

Further embodiments according to the invention are related to respective methods.

Further embodiments according to the invention are related to computer programs.

Embodiments according to the invention are related to a mapping rule for dynamic objection position metadata.

BACKGROUND OF THE INVENTION

Positions of audio objects or of loudspeakers are sometimes described in Cartesian coordinates (room centric description), and are sometimes described in spherical coordinates (ego centric description).

However, it has been found that it is often desirable to convert an object position, or a loudspeaker position from one representation into the other while maintaining a good hearing impression. It is also desirable to maintain the general topology of a described loudspeaker setup and to maintain the correct object positions played back from designated loudspeaker positions.

In view of this situation, there is a desire for a concept which allows for a conversion between a Cartesian representation of object metadata (for example, object position data) and a spherical representation which provides for a good tradeoff between an achievable hearing impression and a computational complexity.

SUMMARY

An embodiment may have an apparatus for converting an object position of an audio object from a Cartesian representation to a spherical representation, wherein a basis area of the Cartesian representation is subdivided into a plurality of basis area triangles, and wherein a plurality of spherical-domain triangles are inscribed into a circle of a spherical representation, wherein the apparatus is configured to determine, in which of the basis area triangles a projection of the object position of the audio object into the base area is arranged; and wherein the apparatus is configured to determine a mapped position of the projection of the object position using a linear transform, which maps the base area triangle onto its associated spherical domain triangle, wherein the apparatus is configured to derive an azimuth angle and an intermediate radius value from the mapped position; wherein the apparatus is configured to obtain a spherical domain radius value and an elevation angle in dependence on the intermediate radius value and in dependence on a distance of the object position from the base area.

Another embodiment may have an apparatus for converting an object position of an audio object from a spherical representation to a Cartesian representation, wherein a basis area of the Cartesian representation is subdivided into a plurality of basis area triangles, and wherein a plurality of spherical-domain triangles are inscribed into a circle of a spherical representation, wherein the apparatus is configured to obtain a value describing a distance of the object position from the base area and an intermediate radius on the basis of the elevation angle or the mapped elevation angle and on the basis of the spherical domain radius or the mapped spherical domain radius; wherein the apparatus is configured to determine a position within one of the triangles inscribed into the circle on the basis of the intermediate radius, or a corrected version thereof, and on the basis of an azimuth angle; and wherein the apparatus is configured to determine a mapped position of the projection of the object position onto the base plane on the basis of the determined position within one of the triangles inscribed into the circle.

Yet another embodiment may have an audio stream provider for providing an audio stream, wherein the audio stream provider is configured to receive input object position information describing a position of an audio object in a Cartesian representation and to provide an audio stream including output object position information describing the position of the object in a spherical representation, wherein the audio stream provider may have an inventive apparatus for converting an object position of an audio object from a Cartesian representation to a spherical representation in order to convert the Cartesian representation into the spherical representation.

Yet another embodiment may have an audio content production system, wherein the audio content production system is configured to determine an object position information describing a position of an audio object in a Cartesian representation, and wherein the audio content production system may have an inventive apparatus for converting an object position of an audio object from a Cartesian representation to a spherical representation in order to convert the Cartesian representation into the spherical representation, and wherein the audio content production system is configured to include the spherical representation into an audio stream.

Another embodiment may have an audio playback apparatus, wherein the audio playback apparatus is configured to receive an audios stream including a spherical representation of an object position information, and wherein the audio playback apparatus may have an inventive apparatus for converting an object position of an audio object from a spherical representation to a Cartesian representation, which is configured to convert the spherical representation into a Cartesian representation of the object position information, and wherein the audio playback apparatus may have a renderer configured to render an audio object to a plurality of channel signals associated with sound transducers in dependence on the Cartesian representation of the object position information.

Another embodiment may have an audio stream provider for providing an audio stream, wherein the audio stream provider is configured to receive input object position information describing a position of an audio object in a spherical representation and to provide an audio stream including output object position information describing the position of the object in a Cartesian representation, wherein the audio stream provider may have an inventive apparatus for converting an object position of an audio object from a spherical representation to a Cartesian representation in order to convert the spherical representation into the Cartesian representation.

Yet another embodiment may have an audio content production system, wherein the audio content production system is configured to determine an object position information describing a position of an audio object in a spherical representation, and wherein the audio content production system may have inventive apparatus for converting an object position of an audio object from a spherical representation to a Cartesian representation in order to convert the spherical representation into a Cartesian representation, and wherein the audio content production system is configured to include the Cartesian representation into an audio stream.

Yet another embodiment may have an audio playback apparatus, wherein the audio playback apparatus is configured to receive an audio stream including a Cartesian representation of an object position information, and wherein the audio playback apparatus may have an inventive apparatus, which is configured to convert the Cartesian representation into a spherical representation of the object position information, and wherein the audio playback apparatus may have a renderer configured to render an audio object to a plurality of channel signals associated with sound transducers in dependence on the spherical representation of the object position information.

Yet another embodiment may have a method for converting an object position of an audio object from a Cartesian representation to a spherical representation, wherein a basis area of the Cartesian representation is subdivided into a plurality of basis area triangles, and wherein a plurality of spherical-domain triangles are inscribed into a circle of a spherical representation, wherein the method may have the steps of: determining in which of the base area triangles a projection of the object position of the audio object into the base area is arranged; and determining a mapped position of the projection of the object position using a linear transform, which maps the base area triangle onto its associated spherical domain triangle, and deriving an azimuth angle [(p] and an intermediate radius value from the mapped position; obtaining a spherical domain radius value and an elevation angle in dependence on the intermediate radius value and in dependence on a distance of the object position from the base area.

Yet another embodiment may have a method for converting an object position of an audio object from a spherical representation to a Cartesian representation, wherein a basis area of the Cartesian representation is subdivided into a plurality of basis area triangles, and wherein a plurality of spherical-domain triangles are inscribed into a circle of a spherical representation, wherein the method may have the steps of: obtaining a value describing a distance of the object position from the base area and an intermediate radius on the basis of an elevation angle or a mapped elevation angle and on the basis of a spherical domain radius or a mapped spherical domain radius; determining a position within one of the triangles inscribed into the circle on the basis of the intermediate radius, or a corrected version thereof, and on the basis of an azimuth angle [(p]; and determining a mapped position of the projection of the object position onto the base plane on the basis of the determined position within one of the triangles inscribed into the circle.

According to another embodiment, a method for providing an audio stream may have the steps of: receiving input object position information describing a position of an audio object in a Cartesian representation, providing an audio stream including output object position information describing the position of the object in a spherical representation, and converting the Cartesian representation into the spherical representation using the inventive method for converting an object position of an audio object from a Cartesian representation to a spherical representation.

According to another embodiment, a method for producing an audio content may have the steps of: determining an object position information describing a position of an audio object in a Cartesian representation, and converting the Cartesian representation into the spherical representation using the inventive method for converting an object position of an audio object from a Cartesian representation to a spherical representation, and including the spherical representation into an audio stream.

According to yet another embodiment, a method for audio playback may have the steps of: receiving an audios stream including a spherical representation of an object position information, converting the spherical representation into a Cartesian representation of the object position information according to the inventive method for audio playback, and rendering an audio object to a plurality of channel signals associated with sound transducers in dependence on the Cartesian representation of the object position information.

According to yet another embodiment, a method for providing an audio stream may have the steps of: receiving input object position information describing a position of an audio object in a spherical representation and providing an audio stream including output object position information describing the position of the object in a Cartesian representation, converting the spherical representation into the Cartesian representation using the inventive method for converting an object position of an audio object from a spherical representation to a Cartesian representation.

According to yet another embodiment, a method for producing an audio content may have the steps of: determining an object position information describing a position of an audio object in a spherical representation, converting the spherical representation into the Cartesian representation using the inventive method for converting an object position of an audio object from a spherical representation to a Cartesian representation, and including the Cartesian representation into an audio stream.

According to yet another embodiment, a method for audio playback may have the steps of: receiving an audios stream including a Cartesian representation of an object position information, and converting the Cartesian representation into a spherical representation of the object position information according to the inventive method for converting an object position of an audio object from a Cartesian representation to a spherical representation, and rendering an audio object to a plurality of channel signals associated with sound transducers in dependence on the spherical representation of the object position information.

According to yet another embodiment, a non-transitory digital storage medium may have a computer program stored thereon to perform any of the inventive methods when said computer program is run by a computer.

Another embodiment may have an apparatus for converting an object position of an audio object from a Cartesian representation to a spherical representation, in which the object position is described using an azimuth angle, an elevation angle and a spherical domain radius, wherein, for example, loudspeakers are placed on a square in a Cartesian coordinate system associated with the Cartesian representation and loudspeakers are placed on a circle in a spherical coordinate system associated with the spherical representation; wherein a basis area of the Cartesian representation is subdivided into a plurality of basis area triangles, and wherein a plurality of spherical-domain triangles are inscribed into a circle of the spherical representation, wherein each of the spherical-domain triangles is associated to a basis area triangle; wherein positions of corners of at least some of the basis area triangles correspond to positions of loudspeakers in the Cartesian coordinate system, and wherein positions of corners of at least some of the spherical-domain triangles correspond to positions of loudspeakers in the spherical coordinate system; wherein the apparatus is configured to determine, in which of the basis area triangles a projection of the object position of the audio object into the base area is arranged; and wherein the apparatus is configured to determine a mapped position of the projection of the object position using a linear transform, which maps the basis area triangle onto an associated spherical domain triangle, wherein the apparatus is configured to derive an azimuth angle and an intermediate radius value from the mapped position; wherein the apparatus is configured to obtain a spherical domain radius value and an elevation angle in dependence on the intermediate radius value and in dependence on a distance of the object position from the base area.

Another embodiment may have a method for converting an object position of an audio object from a Cartesian representation to a spherical representation, in which the object position is described using an azimuth angle, an elevation angle and a spherical domain radius, wherein, for example, loudspeakers are placed on a square in a Cartesian coordinate system associated with the Cartesian representation and loudspeakers are placed on a circle in a spherical coordinate system associated with the spherical representation; wherein a basis area of the Cartesian representation is subdivided into a plurality of basis area triangles, and wherein a plurality of spherical-domain triangles are inscribed into a circle of the spherical representation, wherein each of the spherical-domain triangles is associated to a basis area triangle; wherein positions of corners of at least some of the basis area triangles correspond to positions of loudspeakers in the Cartesian coordinate system, and wherein positions of corners of at least some of the spherical-domain triangles correspond to positions of loudspeakers in the spherical coordinate system; which method may have the steps of determining, in which of the base area triangles a projection of the object position of the audio object into the base area is arranged; determining a mapped position of the projection of the object position using a linear transform, which maps the basis area triangle onto its associated spherical domain triangle, deriving an azimuth angle [φ] and an intermediate radius value from the mapped position; and obtaining a spherical domain radius value and an elevation angle in dependence on the intermediate radius value and in dependence on a distance of the object position from the base area.

Another embodiment may have an apparatus for converting an object position of an audio object from a spherical representation, in which the object position is described using an azimuth angle, an elevation angle and a spherical domain radius, to a Cartesian representation, wherein, for example, loudspeakers are placed on a square in a Cartesian coordinate system associated with the Cartesian representation and loudspeakers are placed on a circle in a spherical coordinate system associated with the spherical representation; wherein a basis area of the Cartesian representation is subdivided into a plurality of basis area triangles, and wherein a plurality of spherical-domain triangles are inscribed into a circle of the spherical representation, wherein positions of corners of at least some of the basis area triangles correspond to positions of loudspeakers in the Cartesian coordinate system, and wherein positions of corners of at least some of the spherical-domain triangles correspond to positions of loudspeakers in the spherical coordinate system; wherein the apparatus is configured to obtain a value describing a distance of the object position from the base area and an intermediate radius on the basis of the elevation angle or a mapped elevation angle and on the basis of the spherical domain radius or a mapped spherical domain radius; wherein the apparatus is configured to determine a position within one of the triangles inscribed into the circle on the basis of the intermediate radius, or a corrected version thereof in which a radius adjustment, which is made because the loudspeakers are placed on a square in the Cartesian coordinate system in contrast to the spherical coordinate system, is reversed, and on the basis of the azimuth angle; and wherein the apparatus is configured to determine a mapped position of the projection of the object position onto the base plane on the basis of the determined position within one of the triangles inscribed into the circle, using a linear transform mapping the triangle in which the determined position lies, onto an associated triangle in the base plane, wherein the value describing the distance of the object position from the base area and the mapped position describe the object position in the Cartesian representation.

Another embodiment may have a method for converting an object position of an audio object from a spherical representation, in which the object position is described using an azimuth angle, an elevation angle and a spherical domain radius, to a Cartesian representation, wherein, for example, loudspeakers are placed on a square in a Cartesian coordinate system associated with the Cartesian representation and loudspeakers are placed on a circle in a spherical coordinate system associated with the spherical representation; wherein a basis area of the Cartesian representation is subdivided into a plurality of basis area triangles, and wherein a plurality of spherical-domain triangles are inscribed into a circle of a spherical representation, wherein positions of corners of at least some of the basis area triangles correspond to positions of loudspeakers in the Cartesian coordinate system, and wherein positions of corners of at least some of the spherical-domain triangles correspond to positions of loudspeakers in the spherical coordinate system; wherein the method may have the steps of: obtaining a value describing a distance of the object position from the base area and an intermediate radius on the basis of an elevation angle or a mapped elevation angle and on the basis of a spherical domain radius or a mapped spherical domain radius; determining a position within one of the triangles inscribed into the circle on the basis of the intermediate radius, or a corrected version thereof in which a radius adjustment, which is made because the loudspeakers are placed on a square in the Cartesian coordinate system in contrast to the spherical coordinate system, is reversed, and on the basis of an azimuth angle [φ]; and determining a mapped position of the projection of the object position onto the base plane on the basis of the determined position within one of the triangles inscribed into the circle, using a linear transform mapping the triangle in which the determined position lies, onto an associated triangle in the base plane; wherein the value describing the distance of the object position from the base area and the mapped position describe the object position in the Cartesian representation.

An embodiment according to the invention creates an apparatus for converting an object position of an audio object (for example, "object position data") from a Cartesian representation (or from a Cartesian coordinate system representation) (for example, comprising x, y and z coordinates) to a spherical representation (or spherical coordinate system representation) (for example, comprising an azimuth angle, a spherical domain radius value and an elevation angle).

A basis area of the Cartesian representation (for example, a quadratic area in an x-y plane, for example, having corner points (−1; −1; 0), (1; −1; 0), (1; 1; 0) and (−1; 1; 0)) is subdivided into a plurality of basis area triangles (for example, a green triangle or a triangle having a first hatching, a purple triangle or a triangle having a second hatching, a red triangle or a triangle having a third hatching and a white triangle or a triangle having a fourth hatching). For example, the basis area triangles may all have a corner at a center position of the base area. Moreover, a plurality of (for example, corresponding or associated) spherical-domain triangles may be inscribed into a circle of a spherical representation (wherein, for example, each of the spherical-domain triangles is associated to a basis area triangle, and wherein the spherical domain triangles are typically deformed when compared to the basis area triangles, wherein there is a mapping (advantageously a linear mapping) for mapping a given base area triangle onto its associated spherical domain triangle). For example, the spherical domain triangles may all comprise a corner at a center of the circle.

The apparatus is configured to determine, in which of the base area triangles a projection of the object position of the audio object into the base area is arranged. Moreover, the apparatus is configured to determine a mapped position of the projection of the object position using a transform (advantageously a linear transform), which maps the base area triangle (in which the projection of the object position of the audio object into the base area is arranged) onto its associated spherical domain triangle. The apparatus is further configured to derive an azimuth angle and an intermediate radius value (for example, a two-dimensional radius value, for example, in a base plane of the spherical coordinate system, for example, at an elevation of zero) from the mapped position.

For example, a radius adjustment which maps a spherical domain triangle inscribed into the circle onto a circle segment may be used. For example, a radius adjustment obtaining an adjusted intermediate radius $r_{xy}$ may be used. The radius adjustment may, for example, scale the radius value $\tilde{r}_{xy}$ obtained before in dependence on the azimuth angle $\varphi$.

The apparatus is configured to obtain a spherical domain radius value and an elevation angle in dependence on the intermediate radius value (which may be adjusted or non-adjusted) and in dependence on a distance of the object position from the base area. The elevation angle may be determined as an angle of a right triangle having legs of the intermediate radius value and of the distance of the object position from the base area. Moreover, the spherical domain radius may be a hypotenuse length of the right triangle, or an adjusted version thereof.

Moreover, the apparatus may optionally be configured to obtain an adjusted elevation angle (for example, using a non-linear mapping which linearly maps angles in first angle region onto a first mapped angle region and which linearly maps angles within a second angle region onto a second mapped angle region, wherein the first angle region has a different width or extent when compared to the first mapped angle region, and wherein, for example, an angle range covered together by the first angle region and the second angle region is identical to an angle range covered together by the first mapped angle region and the second mapped angle region.

This apparatus is based on the finding that the combination of the above-mentioned processing steps provides for a conversion of an object position of an audio object from a Cartesian representation to a spherical representation with comparatively small computational effort while allowing to obtain a reasonably good audio quality. Also, it has been found that the steps mentioned are typically invertible with moderate effort, such that it is possible to go back from the spherical representation into a Cartesian representation, for example, at the side of an audio decoder, with moderate effort.

For example, by subdividing the base area (also designated as basis area) of the Cartesian representation into basis area triangles (also designated as base area triangles), and by mapping positions within the basis angle triangles onto positions within the spherical domain triangles, a simple transition can be made from the Cartesian representation to the spherical representation, which involves little computational effort and which is easily invertible. Moreover, by an appropriate choice of the triangles, it can be ensured with little computational effort, that an auditable degradation of the hearing impression can be avoided or at least minimized. This is due to the fact that the triangles can be defined in such a manner, that audio sources within a given one of the triangles cause a similar hearing impression.

For example, loudspeaker setups described in room centric parameters and are converted with the proposed conversion into ego centric description preserve their topology. Moreover it is desired that also object positions falling on an exact loudspeaker position are still located on the same loudspeaker after the conversion. Embodiments according to the invention can fulfil these requirements.

Moreover, it has been found that using a multistep procedure, in which an azimuth angle and an intermediate radius value (which may be a two-dimensional radius value) are derived, and in which a spherical domain radius value and an elevation angle are derived from the intermediate radius value and in dependence on the distance of the object position from the base area, the mapping can be subdivided into "small" steps, which can be performed using relatively small computational effort and which can be designed in an easily invertible manner.

In an advantageous embodiment, the apparatus is configured to determine the mapped position of the projection of the object position using a linear transform described by a transform matrix. The apparatus is configured to obtain the transform matrix in dependence on the determined basis area triangle. In other words, based on the determination, in which base area triangle a projection of the object position of the audio object into the base area is arranged, the transform matrix may be selected (for example, on a basis of a plurality of a precomputed transform matrices). Alternatively, the transform matrix may also be calculated by the apparatus, for example, in dependence on positions of corners of a determined base area triangle and of the determined (associated) spherical domain triangle. Thus, it is very easy to select the right transform matrix, and the transform can be made using computationally simple linear operations.

In an advantageous embodiment, the transform matrix is defined according to an equation as shown in the claims. In this case, the transform matrix is determined by x- and y-coordinates of (for example, two) corners of the determined basis area triangle and by x- and y-coordinates of (for example, two) corners of the associated spherical domain triangle. For example, it may be assumed that the third corner of the determined basis area triangle and/or the third corner of the associated spherical domain triangle may be in the origin of the coordinate system, which facilitates the computation of the transform.

In an advantageous embodiment, the base area triangles comprise a first base angle triangle which covers an area "in front" of an origin of the Cartesian representation. A second base area triangle covers an area on a left side of the origin of the Cartesian representation. A third base area triangle covers an area on a right side of the origin of the Cartesian representation. A fourth base area triangle covers an area behind the origin of the Cartesian representation. By using such base area triangles, the different base area triangles define regions which result in a different hearing impression (if an object is placed in such a region). However, it would optionally be possible to distinguish even more different triangles, to obtain a finer spatial resolution (and/or to reduce artifacts resulting from the conversion from the Cartesian representation to the spherical representation).

According to an aspect, the definition of the base area triangles according to a segmentation based on the loudspeaker positions in the horizontal plane/layer is an important feature, see FIGS. 18 to 24 and formulae based on a 5.1 loudspeaker setup in the horizontal plane. For details, reference is also made to section 10.

According to an embodiment, the spherical domain triangles may comprise a first spherical domain triangle which covers an area in front of an origin of the spherical representation, a second spherical domain triangle which covers an area on a left side of the origin of the spherical representation, a third spherical domain triangle which covers an area on a right side of the origin of the spherical representation and a fourth spherical domain triangle which covers an area behind the origin of the spherical representation. These four spherical domain triangles correspond well to the four base area triangles mentioned before. However, it should be noted that the spherical domain triangles may be substantially different from the associated base area triangles, for example in that they comprise different angles. The base area triangles are advantageously inscribed into a quadratic area in an x-y plane of the Cartesian representation. In contrast, the spherical domain triangles are, for example, inscribed into a circle in a zero-elevation plane of the spherical representation. Possibly, the arrangement of triangles may also comprise symmetry with respect to a symmetry axis, wherein the symmetry axis may, for example, extend in a direction which is associated to a front-view of a listener or of a listening environment.

In an advantageous embodiment, the coordinates of corners of the base area triangles and the coordinates of corners of the associated spherical domain triangles may be defined as shown in the claims. It has been found that such a choice of triangles brings along particularly good results.

In an advantageous embodiment, the apparatus is configured to derive the azimuth angle from the mapped coordinates of the mapped position according to a mapping rule as shown in the claims. For example, the mapping rule may use an arc-tangent (arctan) function to map the coordinates of the mapped position onto an azimuth angle, wherein a handling for "special cases" may be implemented (in particular, for the case when one of the coordinates is zero).

Such a azimuth angle derivation is also computationally efficient. The described computational rule is computationally particularly efficient and also numerically stable, wherein unreliable results are voided.

In an advantageous embodiment, the apparatus is configured to derive the intermediate radius value from mapped coordinates of the mapped positions according to an equation as shown in the claims. Such a radius computation is particularly simple to implement and provides good results.

In an advantageous embodiment, the apparatus is configured to obtain the spherical domain radius value in dependence on the intermediate radius value using a radius adjustment which maps a spherical domain triangle inscribed into a circle onto a circle segment. It has been found that such a transform can be made by evaluating a single trigonometric function and is therefore computationally very efficient and also easily invertible. Furthermore, is has been found that the full range of radius values available in the spherical domain can be utilized by using such an approach.

In an advantageous embodiment, the apparatus is configured to obtain the spherical domain radius value in dependence on the intermediate radius value using a radius adjustment, wherein the radius adjustment is adapted to scale the intermediate radius values obtained before in dependence on the azimuth angle. Accordingly, it is, for example, possible to upscale the intermediate radius value in dependence on a ratio between the radius of the circle, into which the respective spherical domain triangle is inscribed, and the distance of a hypotenuse of an equal-sided right triangle from the corner opposite of the hypotenuse in the direction determined by the azimuth angle.

In an advantageous embodiment, the apparatus is configured to obtain the spherical domain radius value in dependence on the intermediate radius value using the mapping equations as defined in the claims. It has been found that this approach is particularly well-suited for a 5.1+4H loudspeaker setup.

In an advantageous embodiment, the apparatus is configured to obtain the elevation angle as an angle of a right triangle having legs of the intermediate radius value and of the distance of the object position from the base area. It has been found that such a computation of the elevation angle provides a particularly good result and also allows for an inversion of the coordinate transform with a moderate effort.

In an advantageous embodiment, the apparatus is configured to obtain the spherical domain radius as a hypotenuse length of a right triangle having legs of the intermediate radius value and of the distance of the object position from the base are, or as an adjusted version thereof. It has been found that such an computation is of low complexity and is invertible. However, in some cases, for example, if the spherical domain radius value is simply obtained as the hypotenuse length of the right triangle, the radius value may exceed a radius of the circle into which the spherical domain triangles are inscribed, such that it is advantageous to make another adjustment, to thereby bring the adjusted spherical domain radius value into a range of values which is smaller than or equal to the radius of the circle into which the spherical domain triangles are inscribed.

In an advantageous embodiment, the apparatus is configured to obtain the elevation angle as described in the claims, and/or to obtain the spherical domain radius as described in the claims. It has been found that these computation rules bring along a comparatively small computation effort and also typically allow for an inversion of the coordinated transform with moderate effort.

In an advantageous embodiment, the apparatus is configured to obtain an adjusted elevation angle (for example, using a non-linear mapping which linearly maps angles in a first angle region onto a first mapped angle region and which linearly maps angles within a second angle region onto a second mapped angle region, wherein the first angle region has a different width when compared to the first mapped angle region, and wherein, for example, an angle range covered together by the first angle region and the second angle region is equal to an angle range covered together by the first mapped angle region and the second mapped angle region). Accordingly, it is possible to adapt the coordinate transform, for example, to loudspeaker positions. Also, by using such a mapping, it can be considered that, in terms of hearing impression, there is no one-to-one correspondence between elevation angles in the Cartesian representation and elevation angles in the spherical representation. Thus, by performing such a non-linear mapping, which may be a piece-wise linear mapping, an appropriate adjustment of the elevation angle may be performed, which is also reversible with moderate effort.

In an advantageous embodiment, the apparatus is configured to obtain the adjusted elevation angle using a non-linear mapping which linearly maps angles in a first angle region on to a first mapped angle region and which linearly maps angles within a second angle region onto a second mapped angle region, wherein the first angle region has a different width when compared to the first mapped angle region. Accordingly, in some regions the elevation angles are "compressed" and in other regions the elevation angles are "spread" when performing the conversion. The helps to obtain a good hearing impression.

In an advantageous embodiment, an angle range covered by the first angle region and the second angle region (together) is identical to an angle range covered together by the first mapped angle region and the second mapped angle region. Thus, a given angle region of the elevation (for example, from 0° to 90°) can be mapped on an angle region of the same size (for example, from 0° to 90°), wherein some angle regions are spread and wherein some angle regions are compressed by the non-linear mapping.

In an advantageous embodiment, the apparatus is configured to map the elevation angle onto the adjusted elevation angle according to the rule provided in the claims. It has been found that such a rule provides a particularly good hearing impression.

In an advantageous embodiment, the apparatus is configured to obtain an adjusted spherical domain radius on the basis of a spherical domain radius. It has been found that adjusting the spherical domain radius may be helpful to avoid that the spherical domain radius exceeds the radius of the circle into which the spherical domain triangles are inscribed.

In an advantageous embodiment, the apparatus is configured to perform a mapping which maps boundaries of a square in a Cartesian system onto a circle in a spherical coordinate system, in order to obtain the adjusted spherical domain radius. It has been found that such a mapping is appropriate in order to bring the spherical domain radius into a desired range of values.

In an advantageous embodiment, the apparatus is configured to map the spherical domain radius onto the adjusted spherical domain radius according to the rule provided in the claims. It has been found that this rule is well-suited to bring the adjusted spherical domain radius into the desired range of value, and that the described rule is also easily invertible.

Another embodiment creates an apparatus for converting an object position of an audio object (for example, "object position data") from a spherical representation (or from a spherical coordinate system representation) (for example, comprising an azimuth angle, a spherical domain radius value and an elevation angle) to a Cartesian representation (or Cartesian coordinate system representation) (for example, comprising x, y and z coordinates).

A basis area of the Cartesian representation (for example, a quadratic area in a x-y plane, for example, having corner points (−1; −1; 0), (1; −1; 0), (1; 1; 0) and (−1; 1; 0)) is subdivided into a plurality of basis area triangles (for example, a green triangle, or a triangle shown using a first hatching, a purple triangle or a triangle shown using a second hatching, a red triangle or a triangle shown using a third hatching, and a white triangle or a triangle shown using a fourth hatching) (wherein, for example, the basis area triangles may all have a corner at a center position of the base area), and wherein a plurality of (corresponding or associated) spherical-domain triangles are inscribed into a circle of a spherical representation (wherein, for example, each of the spherical-domain triangles is associated to a basis area triangle, and wherein the spherical domain triangles are typically deformed when compared to the basis are triangles, and wherein there is advantageously a linear mapping for mapping a given base area triangle onto its associated spherical domain triangle). For example, the spherical domain triangles may all comprise a corner at a center of the circle).

The apparatus may optionally be configured to obtain a mapped elevation angle on the basis of an elevation angle (for example, using a non-linear mapping which linearly maps angles in a first angle region onto a first mapped angle region and which linearly maps angles within a second angle region onto a second mapped angle region, wherein the first angle region has a different width when compared to the first mapped angle region, and wherein, for example, an angle range covered together by the first angle region and the second angle region is identical to an angle range covered together by the first mapped angle region and the second mapped angle region.

The apparatus may optionally also be configured to obtain a mapped spherical domain radius on the basis of the spherical domain radius.

The apparatus is further configured to obtain a value describing a distance of the object position from the base area and an intermediate radius (which may, for example, be a two-dimensional radius) on the basis of the elevation angle or the mapped elevation angle and on the basis of the spherical domain radius or the mapped spherical domain radius. The apparatus may optionally be configured to perform a radius correction on the basis of the intermediate radius.

The apparatus is also configured to determine a position within one of the triangles inscribed into the circle on the basis of the intermediate radius, or on the basis of a corrected version thereof, and on the basis of an azimuth angle. Moreover, the apparatus is configured to determine a mapped position of the projection of the object position onto the base plane on the basis of the determined position within one of the triangles inscribed into the circle (for example, using a linear transform mapping the triangle in which the determined position lies, onto an associated triangle in the base plane). For example, the mapped position and the distance of the object position from the base area may, together, determine the position of the audio object in the Cartesian coordinate system.

It should be noted that this apparatus is based on similar considerations as the above-mentioned apparatus for converting an object position of an audio object from a Cartesian representation to a spherical representation. The conversion performed by the apparatus for converting an object position from a spherical representation to a Cartesian representation may, for example, reverse the operation of the apparatus mentioned above. Also, it has been found that the operations performed by the apparatus for converting an object position of an audio object from the spherical representation to the Cartesian representation are typically computationally simple, partially because they are split up into separate independent (or subsequent) processing steps of low complexity.

In an advantageous embodiment, the apparatus is configured to obtain a mapped elevation angle on the basis of an elevation angle. This helps to come from an elevation angle, which is well-suited for a spherical domain rendering, to an elevation angle which is well-adapted to a Cartesian domain rendering.

In an advantageous embodiment, the apparatus is configured to obtain the mapped elevation angle using a non-linear mapping which linearly maps angles in a first angle region onto a first mapped angle region and which linearly maps angles within a second angle region onto a second mapped angle region, wherein the first angle region has a different width when compared to the first mapped angle region. It has been found that such a piece wise-linear mapping (which is, as a whole, a non-linear mapping) can be performed in a computationally very efficient manner and typically brings along an improved hearing impression.

In an advantageous embodiment, an angle range covered together by the first angle range region and the second angle range region is identical to an angle range covered together by the first mapped angle range region and the second mapped angle range region. Thus, a given angle range (for example, between 0° and 90°) can be mapped onto a corresponding angle range (for example, also from 0° to 90°), wherein some angle regions are compressed and wherein some angle regions are spread by the non-linear (but piece-wise linear) mapping. It has been found that such a mapping is helpful to obtain a good hearing impression and is computationally efficient.

In an advantageous embodiment, the apparatus is configured to map the elevation angle onto the mapped elevation angle according to the rule provided in the claims. It has been found that this rule is a particularly advantageous implementation.

In an advantageous embodiment, the apparatus is configured to obtain a mapped spherical domain radius on the basis of a spherical domain radius. In should be noted that the spherical domain radius (which may, for example, lie within a range of values determined by a radius of the circle in which the spherical domain triangles are inscribed) is sub-optimal. For this reason, it is advantageous to apply a mapping, to derive the mapped spherical domain radius. For example, the spherical domain radius may be mapped such that values of the mapped spherical domain radius are larger than a radius of the circle. For example, this may be achieved for a spherical domain radius that is close to the radius of the circle, for example, using the relationship $$\tilde{r} = \begin{cases} \dfrac{r}{\cos\tilde{\theta}} & \text{for } \tilde{\theta} \le 45° \\ \dfrac{r}{\sin\tilde{\theta}} & \text{for } 45° < \tilde{\theta} < 90° \end{cases},$$

with the spherical domain radius r and the mapped spherical domain radius $\tilde{r}$.

In other words, the mapped spherical domain radius may, for example, be determined in such a manner that a two-dimensional radius value derived from the mapped spherical domain radius value is smaller than or equal to the radius of said circle.

In an advantageous embodiment, the apparatus is configured to scale the spherical domain radius in dependence on the elevation angle or in dependence on the mapped elevation angle. For example, the apparatus may be configured to perform a mapping, which maps a circle in a spherical coordinate system onto boundaries of a square in a Cartesian system (for example, to derive the mapped elevation angle). By using such a mapping, it may be reached that the mapped spherical domain radius is well-suited for a derivation of a two-dimensional radius value and also for obtaining a z-coordinate value.

In an advantageous embodiment, the apparatus is configured to obtain the mapped spherical domain radius on the basis of the spherical domain radius according to a rule as described in the claims. It has been found that such a rule is particularly efficient and results in a good hearing impression.

In an advantageous embodiment, the apparatus is configured to obtain a value z describing a distance of the object position from a base area according to a rule defined in the claims. Alternatively or in addition, the apparatus may be configured to obtain the intermediate radius according to the rule defined in the claims. It has been found that these rules are particularly efficient and simple to implement.

In an advantageous embodiment, the apparatus is configured to perform the radius correction using a mapping which maps circle segments onto triangles inscribed in a circle. For example, the intermediate radius, which may take values between zero and the radius of the circle into which the spherical domain triangles are inscribed independent of an azimuth angle, may be mapped in such a way that the maximum obtainable value of the mapped spherical domain radius is limited to a distance of a side of the triangle inscribed into the circle from the center of the circle (for example, in the direction described by the azimuth angle). For example, the intermediate radius is scaled using an azimuth-angle dependent ratio between the distance of a side of a respective spherical domain triangle (for example, in the direction described by the azimuth angle) and the radius of the circle into which the spherical domain triangle is inscribed.

In an advantageous embodiment, the apparatus is configured to scale the intermediate radius in dependence on the azimuth angle, to obtain a corrected radius. Such a scaling is typically computationally simple and still appropriate to map a sector of a circle onto a triangle without causing excessive distortion.

Another advantageous embodiment is based on the segmentation given by the loudspeaker setup in the horizontal plane, like e.g. 5.1.

In an advantageous embodiment, the apparatus is configured to obtain the corrected radius on the basis of the intermediate radius according to a rule as defined in the claims. It has been found that this rule is particularly advantageous and results in a particularly good hearing impression.

In an advantageous embodiment, the apparatus is configured to determine a position within one of the triangles inscribed into the circle according to a rule defined in the claims. This rule only uses simple trigonometric functions, and is well-suited to clearly define an x-coordinate and a y-coordinate.

In an advantageous embodiment, the apparatus is configured to determine the mapped position of the protection of the object position onto the base plane (for example, an x-coordinate and a y-coordinate) on the basis of the determined position within one of the triangles inscribed into the circle using a linear transform which maps the triangle in which the determined position lies onto an associated triangle it the base plane. It has been found that such a linear transform is a very efficient (and invertible) method to map between the spherical domain and the Cartesian domain.

In an advantageous embodiment, the apparatus is configured to determine the mapped position of the projection of the object position onto the base plane according to the mapping rule defined in the claims. It has been found that this mapping rule is efficient and invertible.

In an advantageous embodiment, the transform matrix is defined as described in the claims.

In an advantageous embodiment, the base area triangles comprise a first base area triangle, a second base area triangle, a third base area triangle and a fourth base area triangle, as already mentioned above.

Similarly, in an advantageous embodiment, the spherical domain triangles comprise a first spherical domain triangle, a second spherical domain triangle, a third spherical domain triangle and a fourth spherical domain triangle, as already mentioned above.

In other advantageous embodiments, coordinates of the corners of the base angle triangles are defined as mentioned in the claims. A specific choice of the base area triangles, of the spherical domain triangles and of the corners of said triangles is based on the same considerations as mentioned above with respect to the apparatus for converting an object position from a Cartesian representation to a spherical representation.

Another embodiment according to the invention creates an audio stream provider for providing an audio stream. The audio stream provider is configured to receive input object position information describing a position of an audio object in a Cartesian representation. The audio stream provider is further configured to provide an audio stream comprising output object position information describing the position of the object in a spherical representation. The audio stream provider comprises an apparatus as described above in order to convert the Cartesian representation into the spherical representation.

According to another embodiment, it is also possible to have an audio stream provider with a spherical to Cartesian transform.

Such an audio stream provider can deal with an input object position information using a Cartesian representation and can still provide an audio stream comprising a spherical representation of the position. Thus, the audio stream is usable by audio decoders which may use a spherical representation of the position of an object in order to work efficiently.

Another embodiment according to the invention creates an audio content production system. The audio content production system is configured to determine an object position information describing a position of an audio object in a Cartesian representation. The audio content production system comprises an apparatus as described above in order to convert the Cartesian representation into the spherical representation. Moreover, the audio content production system is configured to include the spherical representation into an audio stream.

Alternatively, however, also spherical-to-Cartesian is possible.

Such an audio content production system has the advantage that the object position can initially be determined in a Cartesian representation, which is convenient and more intuitive to many users. However, the audio content production system can nevertheless provide the audio stream such that the audio stream comprises a spherical representation of the object position which is originally determined in a Cartesian representation. Thus, the audio stream is usable by audio decoders which may use a spherical representation of the position of an object in order to work efficiently.

Another embodiment according to the invention creates an audio playback apparatus. The audio playback apparatus is configured to receive an audio stream comprising a spherical representation of an object position information. The audio playback apparatus also comprises an apparatus as described before, which is configured to convert the spherical representation into a Cartesian representation of the object position information (or, alternatively, vice versa). The audio playback apparatus further comprises a renderer configured to render an audio object to a plurality of channel signals associated with sound transducers (for example, speakers) in dependence on the Cartesian representation of the object position information.

Accordingly, the audio playback apparatus can deal with audio streams comprising a spherical representation of the object position information, even though the renderer may use the object position information in a Cartesian representation. In other words, it is apparent that the apparatus for converting the object position from a spherical representation to a Cartesian representation can advantageously be used in an audio playback apparatus.

It should be noted that all applications (e.g. production tool or decoder) can be implemented in a reverse (mirrored) manner, wherein a conversion from spherical coordinates to Cartesian coordinates may be replaced by a conversion from Cartesian coordinates to spherical coordinates and vice versa (e.g. Sph→Cart and Cart→Sph).

Further embodiments according to the invention create respective methods.

However, it should be noted that the methods are based on the same considerations as the corresponding apparatuses. Moreover, the methods can be supplemented by any of the features, functionalities and details which are described herein with respect to the apparatuses, both individually and taken in combination.

Moreover, embodiments according to the invention create computer programs for performing said methods.

BRIEF DESCRIPTION OF THE DRAWINGS

Embodiments of the present invention will be detailed subsequently referring to the appended drawings, in which:

FIG. 7A shows coordinates of corners of triangles in the Cartesian coordinate system and corners or corresponding triangles in the spherical coordinate system;

FIG. 21A shows coordinates of corners of triangles in the Cartesian coordinate system and corners or corresponding triangles in the spherical coordinate system;

DETAILED DESCRIPTION OF THE INVENTION

In the following, different inventive embodiments and aspects will be described. Also, further embodiments will be defined by the enclosed claims.

It should be noted that any embodiments as defined by the claims can be supplemented by any of the details (features and functionalities) described herein. Also, the embodiments described herein can be used individually, and can also optionally be supplemented by any of the details (features and functionalities) included in the claims.

Also, it should be noted that individual aspects described herein can be used individually or in combination. Thus, details can be added to each of said individual aspects without adding details to another one of said aspects.

It should also be noted that the present disclosure describes, explicitly or implicitly, features usable in an audio encoder (apparatus for providing an encoded representation of an input audio signal) and in an audio decoder (apparatus for providing a decoded representation of an audio signal on the basis of an encoded representation). Thus, any of the features described herein can be used in the context of an audio encoder and in the context of an audio decoder.

Moreover, features and functionalities disclosed herein relating to a method can also be used in an apparatus (configured to perform such functionality). Furthermore, any features and functionalities disclosed herein with respect to an apparatus can also be used in a corresponding method. In other words, the methods disclosed herein can be supplemented by any of the features and functionalities described with respect to the apparatuses.

Also, any of the features and functionalities described herein can be implemented in hardware or in software, or using a combination of hardware and software, as will be described in the section "Implementation Alternatives".

1. Embodiment According to FIG. 1

Figure 1:
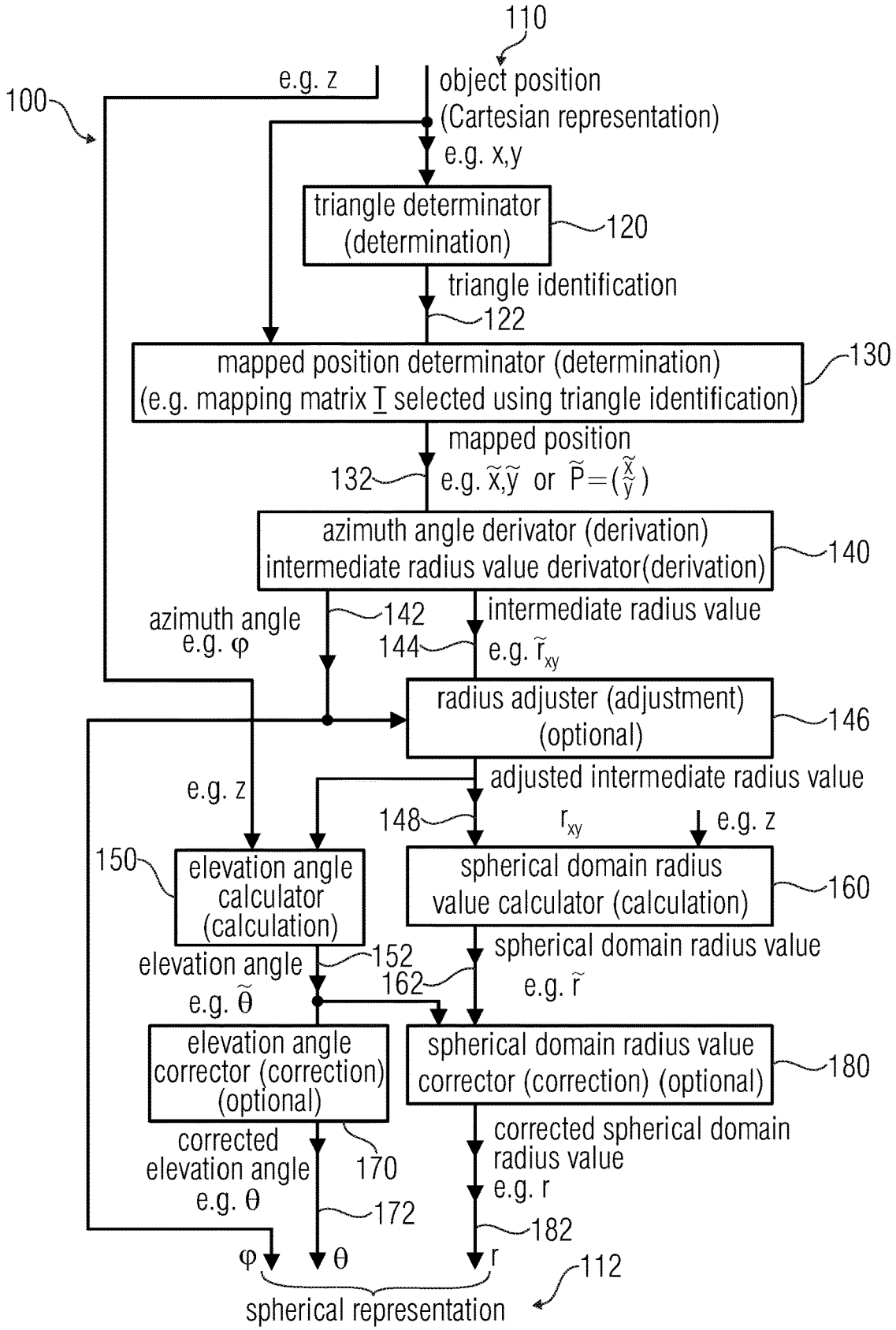
FIG. 1 shows a block schematic diagram of an apparatus for converting an object position of an audio object from a Cartesian representation to a spherical representation, according to an embodiment of the present invention.

FIG. 1 shows a block schematic diagram of an apparatus for converting an object position of an audio object from a Cartesian representation to a spherical representation.

The apparatus 100 is configured to receive the Cartesian representation 110, which may, for example, comprise Cartesian coordinates x, y, z. Moreover, the apparatus 100 is configured to provide a spherical representation 112, which may, for example, comprise coordinates r, $\varphi$ and $\theta$.

Figure 6:
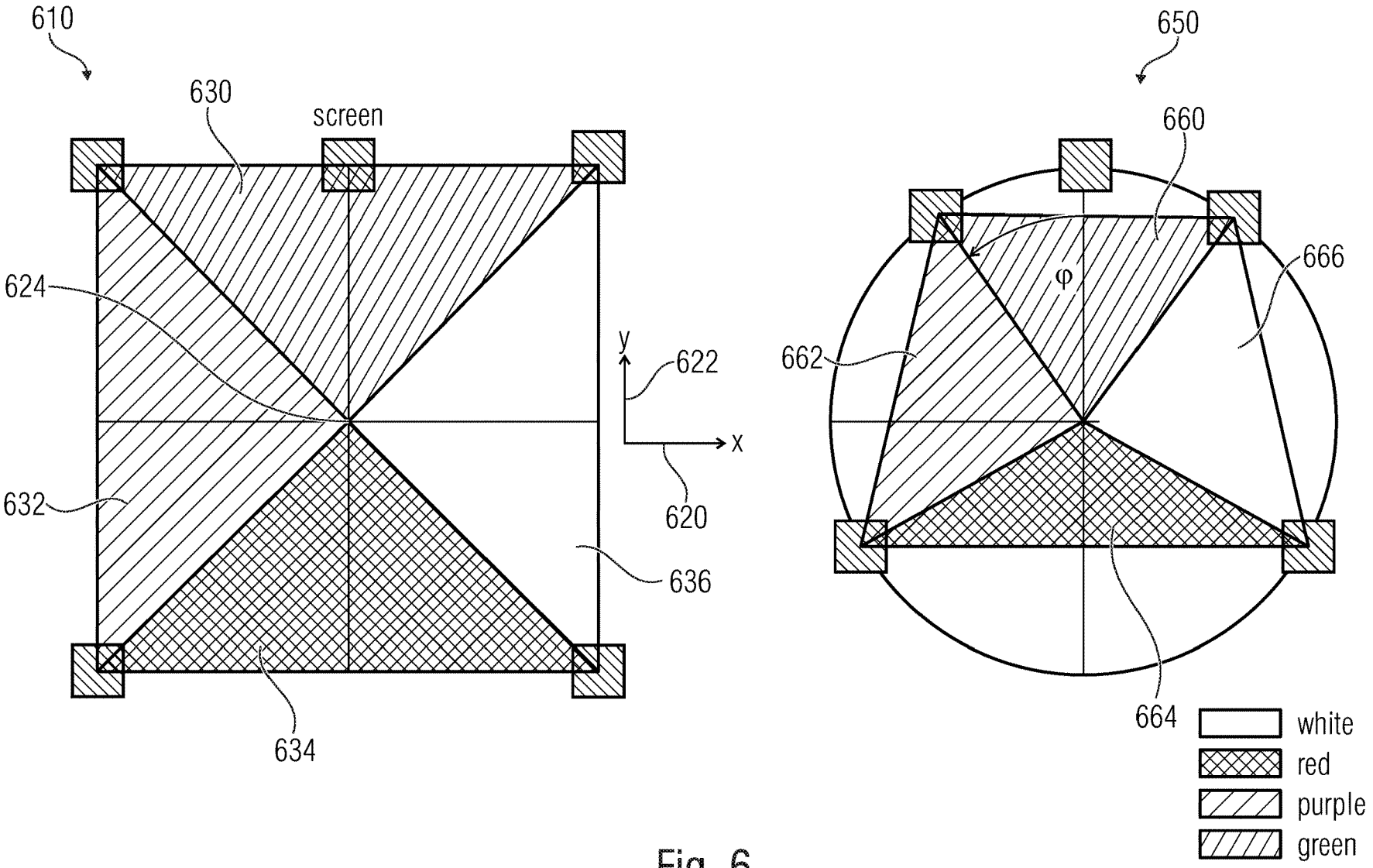
FIG. 6 shows a graphic representation of a mapping of triangles in a Cartesian coordinate system onto corresponding triangles in a spherical coordinate system.

The apparatus may be based on the assumption that a basis area of a Cartesian representation is subdivided into a plurality of basis area triangles (for example, as shown in FIG. 6) and that a plurality of spherical-domain triangles are inscribed into a circle of a spherical representation (for example, as also shown in FIG. 6).

The apparatus 100 comprises a triangle determinator (or determination) 120, which is configured to determine, in which of the base area triangles a projection of the object position of the audio object into the base area is arranged. For example, the triangle determinator 120 may provide a triangle identification 122 on the basis of an x-coordinate and a y-coordinate of the object position information.

Moreover, the apparatus may comprise a mapped position determinator which is configured to determine a mapped position of the projection of the object position using a linear transform, which maps the base area triangle (in which the projection of the object position of the audio object into the base area is arranged) onto its associated spherical domain triangle. In other words, the mapped position determinator may map positions within a first base area triangle onto positions within a first spherical domain triangle, and may map positions within a second base area triangle onto positions within a second spherical domain triangle. Generally speaking, positions within an i-th base area triangle may be mapped onto positions within a i-th spherical domain triangle (wherein a boundary of the i-th base area triangle may be mapped onto a boundary of the i-th spherical domain triangle). Accordingly, the mapped position determinator 130 may provide a mapped position 132 on the basis of the x-coordinate and the y-coordinate and also on the basis of the triangle identification 122 provided by the triangle determinator 120.

Moreover, the apparatus 100 comprises an azimuth angle/intermediate radius value derivator 140 which is configured to derive an azimuth angle (for example, an angle $\varphi$) and an intermediate radius value (for example, an intermediate radius value $\tilde{r}_{xy}$) from the mapped position 132 (which may be described by two coordinates). The azimuth angle information is designated with 142 and the intermediate radius value is designated with 144.

Optionally, the apparatus 100 comprises a radius adjuster 146, which receives the intermediate radius value 144 and provides, on the basis thereof, an adjusted intermediate radius value 148. In the following, the further processing will be described taking reference to the adjusted intermediate radius value. However, in the absence of the optional radius adjuster 146, the intermediate radius value 144 may take the place of the adjusted intermediate radius value 148.

The apparatus 100 also comprise an elevation angle calculator 150 which is configured to obtain an elevation angle 152 (for example, designated with $\tilde{\theta}$) in dependence on the intermediate radius value 144, or independence on the adjusted intermediate radius value 148, and also in dependence on the z-coordinate, which describes the distance of the object position from the base area.

Moreover, the apparatus 100 comprises a spherical domain radius value calculator which is configured to obtain a spherical domain radius value in dependence on the intermediate radius value 144 or the adjusted intermediate radius value 148 and also in dependence on the z-coordinate which describes the distance of the object position from the base area. Accordingly, the spherical domain radius value calculator 160 provides a spherical domain radius value 162, which is also designated with $\tilde{r}$.

Optionally, the apparatus 100 also comprises an elevation angle corrector (or adjustor) 170, which is configured to obtain a corrected or adjusted elevation angle 172 (designated, for example with $\theta$) on the basis of the elevation angle 152.

Moreover, the apparatus 100 also comprises a spherical domain radius value corrector (or a spherical domain radius value adjustor) 180, which is configured to provide a corrected or adjusted spherical domain radius value 182 on the basis of the spherical domain radius value 162. The corrected or adjusted spherical domain radius value 182 is designated, for example, with r.

It should be noted that the apparatus 100 can be supplemented by any of the features and functionalities describe herein. Also, it should be noted that each of the individual blocks may, for example, be implemented using the details described below, without necessitating that other blocks are implemented using specific details.

Regarding the functionality of the apparatus 100, it should be noted that the apparatus is configured to perform multiple small steps, each of which is invertible at the side of an apparatus converting a spherical representation back into a Cartesian representation.

The overall functionality of the apparatus is based on the idea that an object position, which is given in a Cartesian representation (wherein, for example, valid object positions may lie within a cube centered at an origin of the Cartesian coordinate system and aligned with the axes of the Cartesian coordinate system) can be mapped into a spherical representation (wherein, for example, valid object positions may lie within a sphere centered at an origin of the spherical coordinate system) without significantly degrading a hearing impression. For example, Direct loudspeaker mapping is enabled if loudspeaker positions define the triangles/segmentation. A projection of the object position onto the base area (for example, onto the x-y plane) may be mapped onto a position within a spherical domain triangle which is associated with a triangle in which the projection of the object position into the base area is arranged. Accordingly, a mapped position 132 is obtained, which is a two-dimensional position within the area within which the spherical domain triangles are arranged.

An azimuth angle is directly derived from this mapped position 132 using the azimuth angle derivator or azimuth angle derivation. However, it has been found that an elevation angle 152 and a spherical domain radius value 162 can also be obtained on the basis of an intermediate radius value 144 (or on the basis of an adjusted intermediate radius value 148) which can be derived from the mapped position 132. In a simple option, the intermediate radius value 144, which can be derived easily from the mapped position 132, can be used to derive the spherical domain radius value 162, wherein the z-coordinate is considered (spherical domain radius value calculator 160). Also, the elevation angle 152 can easily be derived from the intermediate radius value 144, or from the adjusted intermediate radius value 148, wherein the z-coordinate is also considered. In particular, the mapping which is performed by the mapped position determinator 130 significantly improves the results when compared to an approach which would not perform such a mapping.

Moreover, it has been found that the quality of the conversion can be further improved if the intermediate radius value is adjusted by the radius adjuster 146 and if the elevation angle 152 is adjusted by the optional elevation angle corrector or elevation angle adjuster 170 and if the spherical domain radius value 162 is corrected or adjusted by the spherical domain radius value corrector or spherical domain radius value adjuster 180. The radius adjustor 146 and the spherical domain radius value corrector 180 can, for example, be used to adjust the range of values of the radius, such that the resulting radius value 182 comprises a range of values well-adapted to the Cartesian representation. Similarly, the elevation angle corrector 170 may provide a corrected elevation angle 172, which brings along a particularly good hearing impression, since it will be achieved that the elevation angle is better adjusted to the spherical representation which is typically used in the field of audio processing.

Moreover, it should be noted that the apparatus 100 can optionally be supplemented by any of the features and functionalities described herein, both individually and in combination.

In particular, the apparatus 100 can optionally be supplemented by any of the features and functionalities described with respect to the "production side conversion".

The features, functionalities and details described herein can optionally be introduced individually or in combination into the apparatus 100.

2. Embodiment According to FIG. 2

Figure 2:
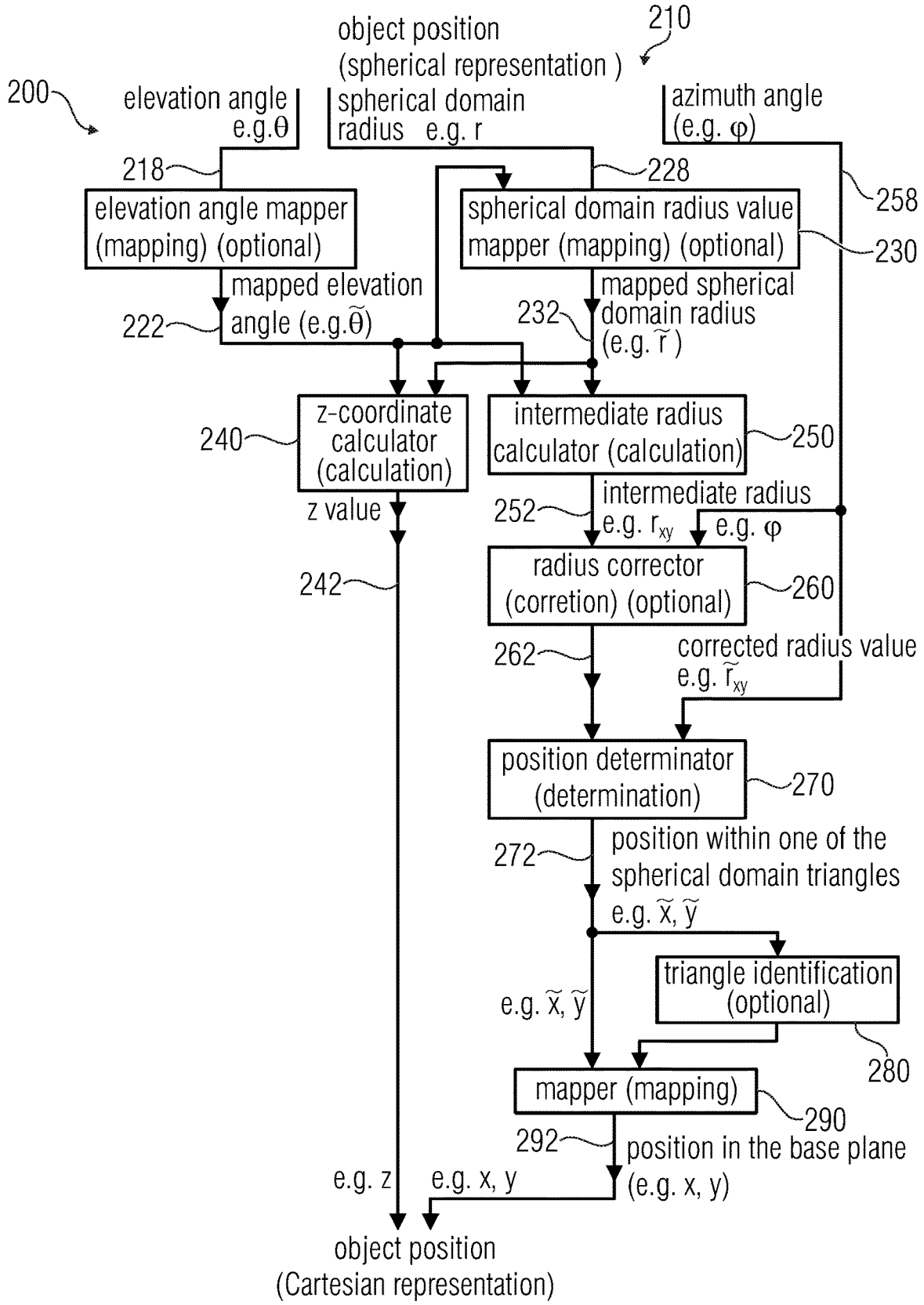
FIG. 2 shows a block schematic diagram of an apparatus for converting an object position of an object from a spherical representation to a Cartesian representation, according to an embodiment of the present invention.

FIG. 2 shows a block schematic diagram of an apparatus for converting an object position of an audio object from a spherical representation to a Cartesian representation.

The apparatus for converting an object position from a spherical representation to a Cartesian representation is designated in its entirety with 200.

The apparatus 200 receives an object position information, which is a spherical representation. The spherical representation may, for example, comprise a spherical domain radius value r, an azimuth angle value (for example, φ) and an elevation value (for example, θ).

Similar to the apparatus 100, the apparatus 200 is also based on the assumption that a basis area of the Cartesian representation (for example, a quadratic area in an x-y plane, for example having corner points (−1; −1; 0), (1; −1; 0), (1; 1; 0) and (−1; 1; 0)) is subdivided into a plurality of basis area triangles (for example, a first basis area triangle, a second basis area triangle, a third basis area triangle and fourth basis area triangle). For example, the basis area triangles may all have a corner at a center position of the base area. Moreover, it is assumed that there is a plurality of (corresponding or associated) spherical-domain triangles which are inscribed into a circle of a spherical representation (wherein, for example, each of the spherical-domain triangles is associated to a base area triangle, wherein the spherical domain triangles are typically deformed when compared to the associated basis area triangles, and wherein there is a linear mapping for mapping a given base area triangle onto its associated spherical area triangle). Moreover, the spherical domain triangles may, for example, comprise a corner at a center of the circle.

The apparatus 200 optionally comprises an elevation angle mapper 220, which receives the elevation angle value of the spherical representation 210. The elevation angle mapper 220 is configured to obtained a mapped elevation angle 222 (for example, designated with $\tilde{\theta}$) on the basis of an elevation angle (for example, designated with θ). For example, the elevation angle mapper 220 may be configured to obtain the mapped elevation angle 222 using a non-linear mapping which linearly maps angles in a first angle region onto a first mapped angle region and which linearly maps angles within a second angle region onto a second mapped angled region, wherein the first angle region has a different width when compared to the first mapped angled region and where, for example, an angle range covered together by the first angle region and the second angle region is identical to an angle range covered together by the first mapped angle region and the second mapped angle region.

Moreover, the apparatus 200 optionally comprises a spherical domain radius value mapper 230, which receives the spherical domain radius (for example, r). The spherical domain radius value mapper 230, which is optional, may be configured to obtain a mapped spherical domain radius 232 on the basis of the spherical domain radius (for example, r).

Moreover, the apparatus 200 comprises a z-coordinate calculator 240, which is configured to obtain a value (for example, z) describing a distance of the object position from the base area on the basis of the elevation angle 218 or on the basis of the mapped elevation angle 222, and on the basis of the spherical domain radius 228 or on the basis of the mapped spherical domain radius 232. The value describing a distance of the object position from the base area is designated with 242, and may also be designated with "z".

Moreover, the apparatus 200 comprises an intermediate radius calculator 250, which is configured to obtain an intermediate radius 252 (for example, designated with $r_{xy}$) on the basis of the elevation angle 218 or on the basis of the mapped elevation angle 222 and also on the basis of the spherical domain radius 228 or on the basis of the mapped spherical domain radius 232.

The apparatus 200 optionally comprises a radius corrector 260, which may be configured to receive the intermediate radius 252 and the azimuth angle 258 and to provide a corrected (or adjusted) radius value 262.

The apparatus 200 also comprises a position determinator 270, which is configured to determine a position within one of the triangles inscribed into the circle (spherical domain triangle) on the basis of the intermediate radius 252, or on the basis of the corrected version 262 of the intermediate radius, and on the basis of the azimuth value 258 (for example φ). The position within one of the triangles may be designated with 272 and may, for example, be described by two coordinates $\tilde{x}$ any $\tilde{y}$ (which are Cartesian coordinates within the plane in which the spherical domain triangles lie).

The apparatus 200 may optionally comprise a triangle identification 280, which determines in which of the spherical domain triangles the position 272 lies. This identification, which is performed by the triangle identification 280, may, for example, be used to select a mapping rule to be used by a mapper 290.

The mapper 290 is configured to determine a mapped position 292 of the projection of the object position onto the base plane on the basis of the determined position 272 within one of the triangles inscribed into the circle (for example, using a transform or a linear transform mapping the triangle, in which the determined position lies, onto an associated triangle in the base plane). Accordingly, the mapped position 292 (which may be a two-dimensional position within the base plane) and the distance of the object position from the base area (for example, the z value 242) may, together, determine the position of the audio object in the Cartesian coordinate system.

It should be noted that the functionality of the apparatus 200 may, for example, be inverse to the functionality of the apparatus 100, such that it is possible to map a spherical representation 112 provided by the apparatus 100 back to a Cartesian representation of the object position using the apparatus 200 (wherein the object position information 210, in the spherical representation (which may comprise the elevation angle 218, the spherical domain radius 228 and azimuth angle 258) may be equal to the spherical representation 112 provided by the apparatus 100, or may be derived from the spherical representation 112 (E.g. may be a lossy coded or quantized version of the spherical representation 112). For example, by an appropriate choice of the processing, it may be reached that the conversion performed by the apparatus 100 is invertible with moderate effort by the apparatus 200.

Moreover, it should be noted that it is an important feature of the apparatus 200 that there is a mapping of a position within one of the spherical domain triangles onto a position in the base plane of the Cartesian representation, because this functionality allows for a mapping which provides a good hearing impression with moderate complexity.

Moreover, it should be noted that the apparatus 200 can be supplemented by any of the features, functionalities and details which are described herein, both individually and in combination.

3. Further Embodiments and Considerations

In the following, some details regarding the mapping rule for object position metadata or for dynamic object position metadata will be described. It should be noted that the position does not have to be dynamic. Also static object positions may be mapped.

Embodiments according to the invention are related to a conversion from production side object metadata, especially object position data, in case on production side a Cartesian coordinate system is used, but in the transport format the object position metadata is described in the spherical coordinates.

It has been recognized that it is a problem that, in the Cartesian coordinates, the loudspeakers are not always located at the mathematically "correct" positions compared to the spherical coordinate system. Therefore, conversion is desired that ensures that the cuboid area from the Cartesian space is projected correctly into the sphere, or semi-sphere.

For example, loudspeaker positions are equally rendered using an audio object renderer based on a spherical coordinate system (for example, a renderer as described in the MPEG-H 3D audio standard) or using a Cartesian based renderer with the corresponding conversion algorithm.

It has been found that the cuboid surfaces should be mapped or projected (or sometimes have to be mapped or projected) onto the surface of the sphere on which the loudspeakers are located. Furthermore, it is desired (or sometimes useful), that the conversion algorithm has a small computational complexity. This is especially true for the conversion step from spherical to Cartesian coordinates.

An example application for the invention is: use state-of-the art audio object authoring tools that often use a Cartesian parameter space (x, y, z) for the audio object coordinates, but use a transport format that describes the audio object positions in spherical coordinates (azimuth, elevation, radius), like e.g., MPEG-H 3D Audio. However, the transport format may be agnostic to the renderer (spherical or Cartesian), that is applied afterwards.

It should be noted that, in the following, the invention is described, as an example, for a 5.1+4H loudspeaker set-up, but can easily be transferred for all kinds of loudspeaker set-ups (e.g., 7.1+4, 22.2, etc.) or varying Cartesian parameter spaces (different orientation of the axes, or different scaling of the axes, . . . ).

General Comparison of Coordinate Systems

In the following, a general comparison of coordinate systems will be provided.

Figure 3:
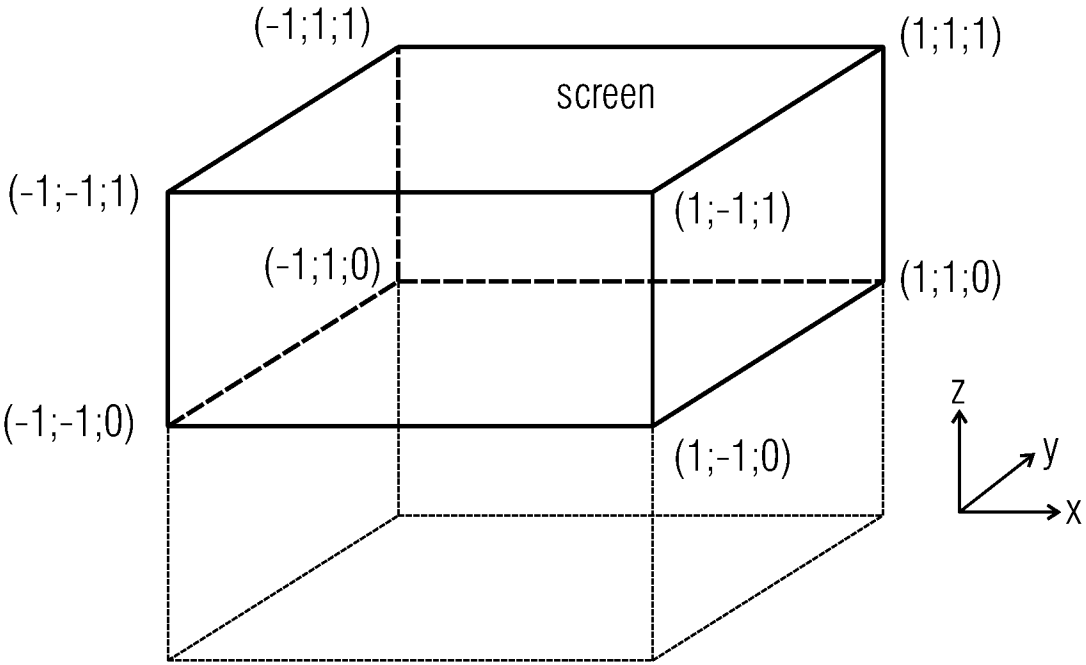
FIG. 3 shows a schematic representation of an example of a Cartesian parameter room with corresponding loudspeaker positions for a 5.1+4H setup.

For this purpose, FIG. 3 shows a schematic representation of an example of a Cartesian parameter room with corresponding loudspeaker positions for a 5.1+4 H set-up. As can be seen, a normalized object position may, for example, lie within cuboids having corners at coordinates (−1; −1; 0), (1; −1; 0), (1; 1; 0), (−1; 1; 0), (−1; −1; 1), (1; −1; 1), (1; 1; 1) and (−1; 1; 1).

Figure 4:
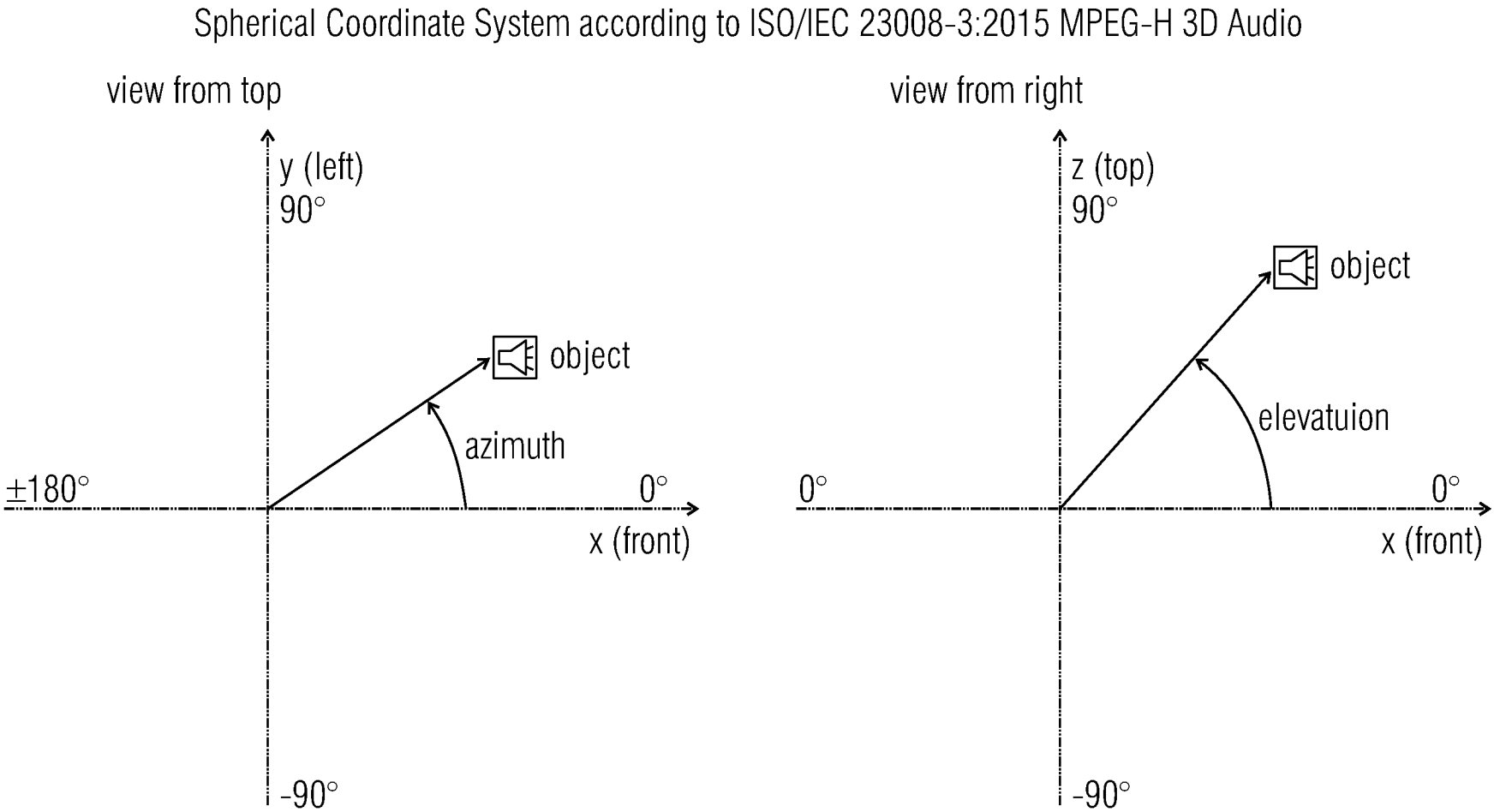
FIG. 4 shows a schematic representation of a spherical coordinate system according to ISO/IEC 23008-3:2015 MPEG-H 3D Audio.
Figure 5:
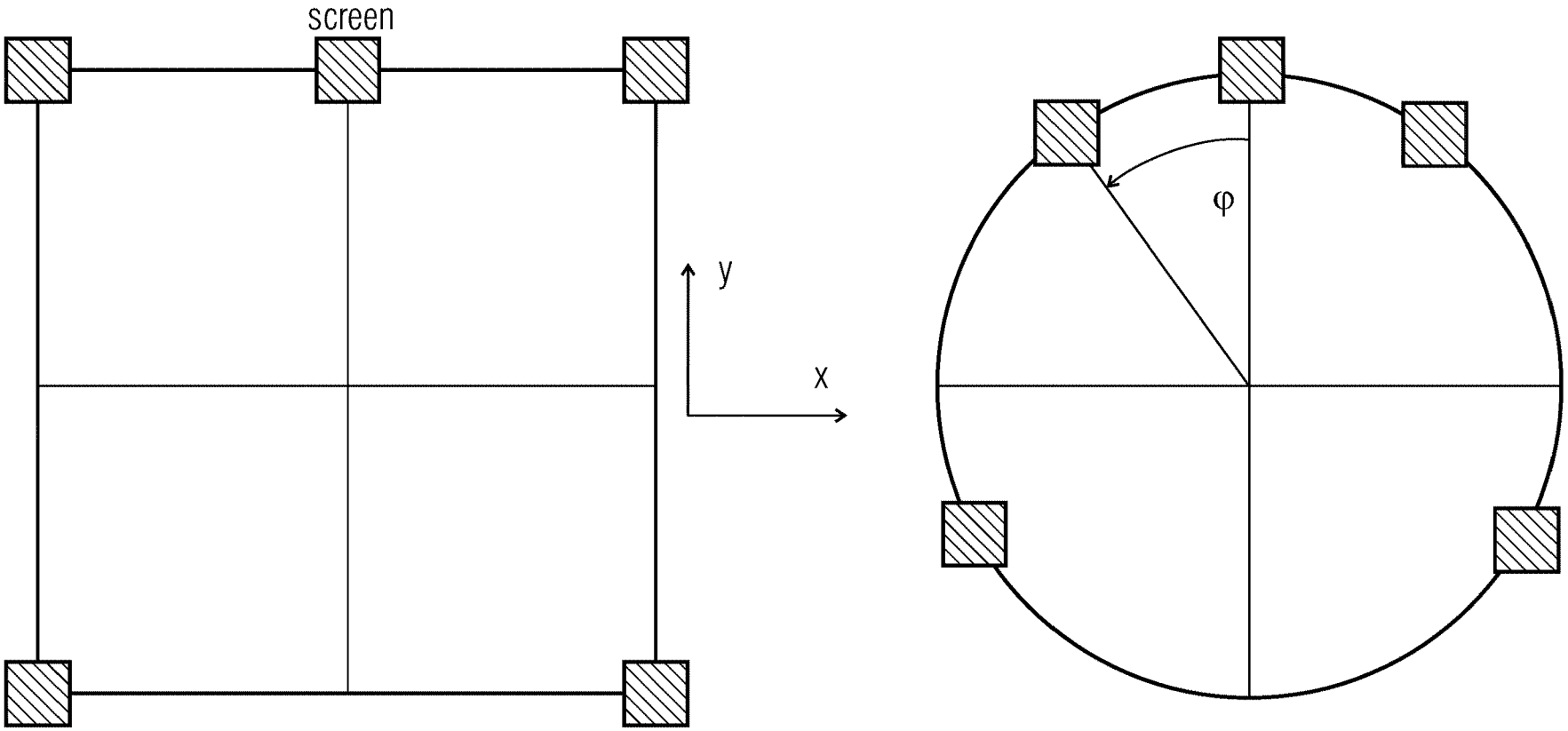
FIG. 5 shows a schematic representation of speaker positions in a Cartesian coordinate system and in a spherical coordinate system.

As a comparison, FIG. 4 shows a schematic representation of a spherical coordinate system according to ISO/IEC 23008-3:2015 MEG-H 3D audio. As can be seen, a position of an object is described by an azimuth angle, by an elevation angle and by a (spherical domain) radius.

However, it should be noted that the coordinates X and Y in the ISO coordinate system are defined differently compared to the Cartesian coordinate system described above.

However, it should be noted that the coordinate systems shown here should be considered as examples only.

3.1 Production Side Conversion (Cartesian 2 Spherical or Cartesian-to-Spherical)

In the following, a conversion from a Cartesian representation (for example, of an object position) to a spherical representation (for example, of the object position) will be described, which may advantageously be performed by the apparatus 100.

It should be noted that the features, functionalities and details described here can optionally be taken over into the apparatus 100, both individually and taken in combination.

However, the "projection side conversion" (which is a conversion from a Cartesian representation to a spherical representation) described here may be considered as an embodiment according to the invention, which can be used as-is (or in combination with one or more of the features and functionalities of the apparatus 100, or in combination with one or more of the features and functionalities as defined by the claims).

It is assumed here, for example, that the loudspeaker positions are given in spherical coordinates as described, for example, by the ITU recommendation ITU-R BS.2159-7 and described in the MPEG-H specification.

The conversion is applied in a separated approach. First the x and y coordinates are mapped to the azimuth angle φ and the radius $r_{xy}$ in the azimuth/xy-plane (for example, a base plane). This may, for example, be performed by blocks 120, 130, 140 of the apparatus 100. Afterwards, the elevation angle and the radius in the 3D space (often designated as spherical domain radius value) are calculated using the z-coordinate. This can be performed, for example, by blocks 146 (optional), 150, 160, 170 (optional) and 180 (optional). The mapping is described, as an example (or exemplarily), for the 5.1+4H loudspeaker setup.

Special Case x=y=0;

It should be noted that, optionally, the following assumption may be made for the special case x=y=0.

For z>0:

φ=undefined(=0°), θ=90° and r=z.

For z=0:

φ=undefined(=0°), θ=0° and r=0.

1) Conversion in Xy-Plane

The conversion which takes place in the xy-plane may, for example, comprise three steps which will be described in the following.

Step 1: (Optional; May be a Preparatory Step)

In the first step, triangles in the Cartesian coordinate system are mapped to corresponding triangles in the spherical coordinate system.

For example, FIG. 6 shows a graphic representation basis area triangles and associated spherical domain triangles. For example, a graphic representation 610 shows four triangles. For example, there is a x-coordinate direction 620 and a y-coordinate direction 622. An origin is, for example, at position 624. For example, four triangles are inscribed into a square which may, for example, comprise normalized coordinates (−1; −1), (1; −1), (1; 1) and (−1; 1). A first triangle (shown in green or using a first hatching) is designated with 630 and comprises corners at (1; 1), (−1; 1) and (0; 0). A second triangle, shown in purple or using a second hatching, is designated with 632 and has corners at coordinates (−1; 1), (−1; −1) and (0; 0). A third triangle 634 is shown in red or using third hatching and has corners at coordinates (−1; −1), (1; −1) and (0; 0). A fourth triangle 636 is shown in white or using a fourth hatching and has corners at coordinates (1; −1), (1; 1) and (0; 0).

Accordingly, the whole inner area of a (normalized) unit square is filled up by the four triangles, wherein the fourth triangles all have one of their corners at the origin of the coordinate system. It may be set that the first triangle 630 is "in front" of the origin (for example, in front of a listener assumed to be at the origin), the second triangle 632 is at the left side of the origin, the third triangle is "behind" the origin and the fourth triangle 636 is on the right side of the origin. Worded differently, the first triangle 630 covers a first angle range when seen from origin, the second triangle 632 covers a second angle range when seen from the origin, the third triangle covers a third angle range when seen from the origin and the fourth triangle covers a fourth angle range when seen from the origin. It should be noted that four possible speaker positions coincide with the corners of the unit square, and that a fifth speaker position (center speaker) may be assumed to be at coordinate (0; 1).

A graphic representation 650 shows associated triangles which are inscribed into a unit circle in a spherical coordinate system.

As can be seen in the graphic representation 650, four triangles are inscribed into the unit circle, which is, for example, lying in a base area of a spherical coordinate system (for example, an elevation angle of zero). A first spherical domain triangle 660 is shown in green color or in a first hatching, and is associated with the first base area triangle 630. The second spherical domain triangle 662 is shown in a purple color or in a second hatching and is associated with as second base area triangle 632. A third spherical domain triangle 664 is shown in a red color or a third hatching and is associated with the third base area triangle 634. A fourth spherical domain triangle 666 is shown in a white color or in a fourth hatching and is associated with a fourth base area triangle 636. Adjacent spherical domain triangles share a common triangle edge. Also, the four spherical domain triangles cover a full range of 360° when seen from the origin. For example, the first spherical domain triangle 660 covers a first angle range when seen from the origin, the second spherical domain triangle 662 covers a second angle range when seen from the origin, the third spherical domain triangle 664 covers a third angle range when seen from the origin and the fourth spherical domain triangle 666 covers a fourth angle range when seen from the origin. For example, the first spherical domain triangle 660 may cover an angle range in front of the origin, the second spherical domain triangle 662 may cover an angle range on a left side or origin, the third spherical domain triangle may cover an angle range behind the origin and the fourth spherical domain triangle 666 may cover an angle range on a right side of the origin. Moreover, four speaker positions may be arranged at positions on the circle which are common corners of adjacent spherical domain triangles. Another speaker position (for example, of a center speaker) may be arranged outside of the spherical domain triangles (for example, on the circle "in front" of the first spherical domain triangle).

Generally speaking, it should also be noted that the angle ranges covered by the spherical domain triangles may be different from the angle ranges covered by the associated base area triangles. For example, while each of the base area triangles may, for example, cover an angle range of 90° when seen from the origin of the Cartesian coordinate system, the first, second and fourth spherical domain triangles may cover angle ranges which are smaller than 90° and the third spherical domain triangle may cover an angle range which is larger than 90° (when seen from the origin of the spherical coordinate system). Alternatively, more triangles may be used, as shown in the below example with 5 segments.

Moreover, while the base area triangles 630, 632, 634, 636 may be equal, the spherical domain triangles may have different shapes, wherein the shape of the second spherical domain triangle 666 and the shape of the fourth spherical domain triangle 666 may be equal (but mirrored with respect to each other).

Moreover, it should be noted that a higher number of triangles could be used both in the Cartesian representation and in the spherical representation.

In the following, a mapping of triangles in the Cartesian coordinate system to corresponding triangles in the spherical coordinate system will be shown, as an example, for one triangle.

Figure 7:
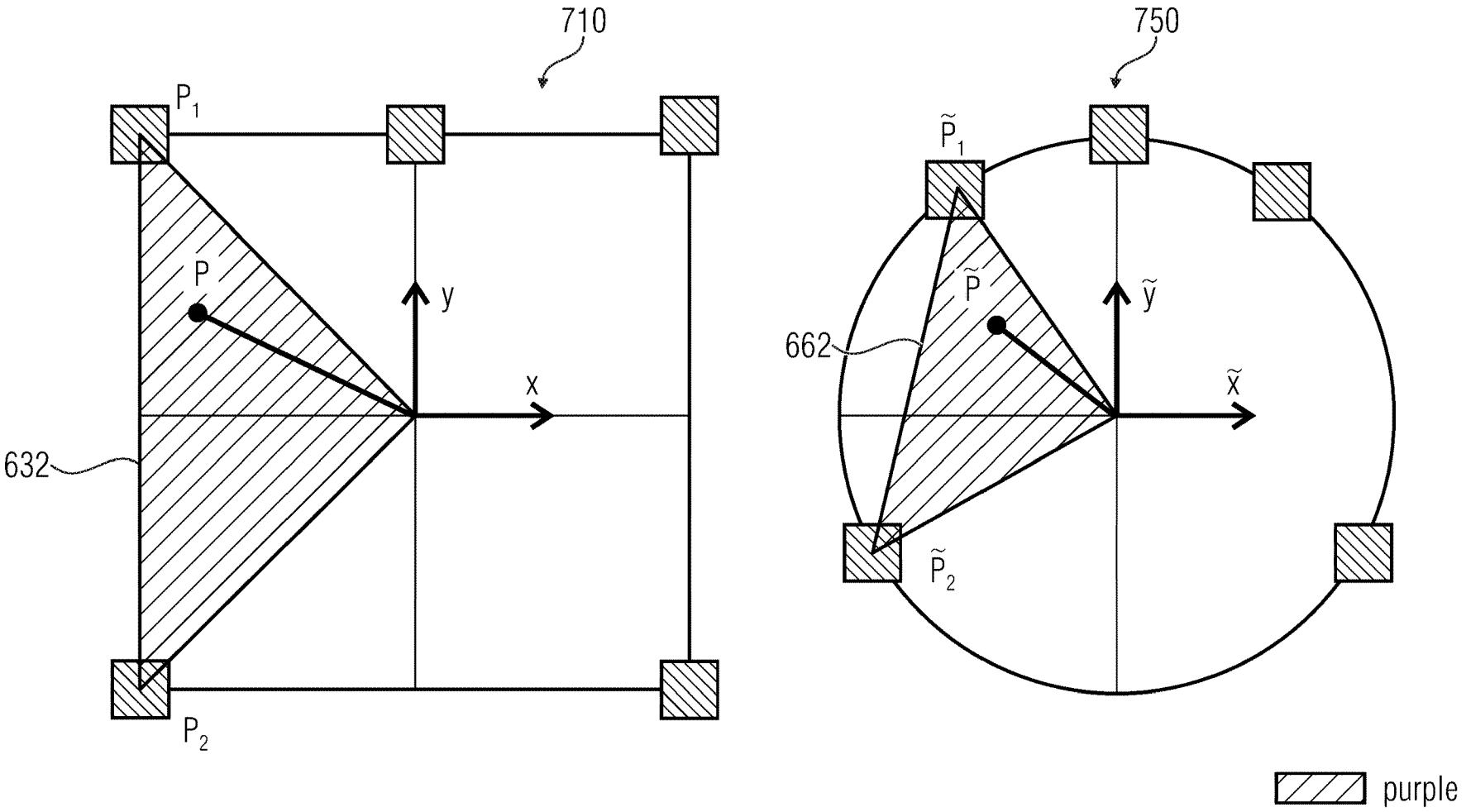
FIG. 7 shows a schematic representation of a mapping of a point within a triangle in the Cartesian coordinate system onto a point within a corresponding triangle in the spherical coordinate system.

As an example, FIG. 7 shows a graphic representation of a base area triangle and an associated spherical domain triangle. As can be seen in a graphic representation 710, the base area triangle, which may be the "second base area triangle" comprises corners at coordinates $P_1$, $P_2$ and at the origin of the Cartesian coordinate system. The associated spherical domain triangle (for example the "second spherical domain triangle") may comprise corners at coordinates $\tilde{P}_1$, $\tilde{P}_2$ and at the origin of the Cartesian coordinate system, as can be seen in a graphic representation 750. For example, a point P within the first base area triangle 632 is mapped onto a corresponding point $\tilde{P}$ in the associated spherical domain triangle 662.

The triangles, or positions therein, like, for example, the point P can be projected (or mapped) onto each other using a linear transform:

$$\tilde{P} = \begin{pmatrix} \tilde{x} \\ \tilde{y} \end{pmatrix} = \underline{T}P$$

The transform matrix can be calculated (or pre-calculated), for example, using the known positions of the corners of the (associated) triangles $P_1$, $P_2$, $\tilde{P}_1$ and $\tilde{P}_2$. These points depend on the loudspeaker set-up and the corresponding positions of the loudspeakers and the triangle in which the position P is located.

$$\underline{T} = \begin{bmatrix} t_{11} & t_{12} \\ t_{21} & t_{22} \end{bmatrix} = \frac{1}{P_{1,x}P_{2,y} - P_{2,x}P_{1,y}} \begin{bmatrix} \tilde{P}_{1,x}P_{2,y} - \tilde{P}_{2,x}P_{1,,y} & P_{1,x}\tilde{P}_{2,x} - \tilde{P}_{1,x}P_{2,x} \\ \tilde{P}_{1,y}P_{2,y} - \tilde{P}_{2,y}P_{1,y} & P_{1,x}\tilde{P}_{2,y} - \tilde{P}_{1,y}P_{2,x} \end{bmatrix}$$

However, it should be noted that the transform matrix T may, for example, be pre-computed.

For example, if the concept is implemented using the apparatus 100, the triangle determinator 120 may determine in which triangle a position P to be converted from a Cartesian representation to a spherical representation is located (or, more precisely, may determine in which of the base area triangles a (two-dimensional) projection P of the (original, three-dimensional) position into the base plane is arranged, where it is assumed that the position may be a three-dimensional position described by an x-coordinate, a y-coordinate and a z-coordinate). According to the determination in which of the triangles the projection P of the position lies, an appropriate transform matrix T may be selected and may be applied (for example, to the projection P) by the mapped position determinator 130.

Thus, the mapped position $\tilde{P}$ is obtained.

In the following, an example regarding the base area triangles and the spherical domain triangles will be described.

For example, the 5.1+4H loudspeaker setup contains in the middle layer a standard 5.1 loudspeaker set up, which is the basis for the projection in the xy-plane. In table 1, the corresponding points $P_1$, $P_2$, $\tilde{P}_1$ and $\tilde{P}_2$ are given for the four triangles that have to be projected. However, it should be noted that the points as shown in table 1 should be considered as an example only, and that the concept can also be applied in combination with other loudspeaker arrangements, wherein the triangles may naturally be chosen in a different manner.

Step 2

In a second step, a radius $\tilde{r}_{xy}$ (which may also be designated as an intermediate radius or intermediate radius value) and the azimuth angle φ are calculated based on the mapped coordinates $\tilde{x}$ and $\tilde{y}$. For example, this calculation is performed by the azimuth angle deviator and by the intermediate radius value determinator, which is shown as block 140 in the apparatus 100. For example, the following computation or mapping may be performed:

$$\tilde{r}_{xy} = \sqrt{\tilde{x}^2 + \tilde{y}^2}$$

$$\varphi = \begin{cases} \tan^{-1}\frac{-\tilde{x}}{\tilde{y}} \text{ for } \tilde{y} > 0 \\ -90° \text{ for } \tilde{y} = 0 \wedge \tilde{x} > 0 \\ 0° \text{ for } \tilde{y} = 0 \wedge \tilde{x} = 0 \\ 90° \text{ for } \tilde{y} = 0 \wedge \tilde{x} < 0 \\ -90° + \tan^{-1}\frac{\tilde{y}}{\tilde{x}} \text{ for } \tilde{y} < 0 \wedge \tilde{x} > 0 \\ -180° \text{ for } \tilde{y} < 0 \wedge \tilde{x} = 0 \\ 90° + \tan^{-1}\frac{\tilde{y}}{\tilde{x}} \text{ for } \tilde{y} < 0 \wedge \tilde{x} < 0 \end{cases}$$

Step 3 (Optional)

The radius (for example, the intermediate radius value $\tilde{r}_{xy}$) may be adjusted, because the loudspeakers are, for example, placed on a square in the Cartesian coordinate system in contrast to the spherical coordinate system. In the spherical coordinate system, the loudspeakers are positioned, for example, on a circle.

To adjust the radius, the boundary of the Cartesian loudspeaker square is projected on the circle of the spherical coordinate system. This means that the chord is projected onto the corresponding segment of the circle.

It should be noted that this functionality, may, for example, be performed by the radius adjuster 146 of the apparatus 100.

Figure 8:
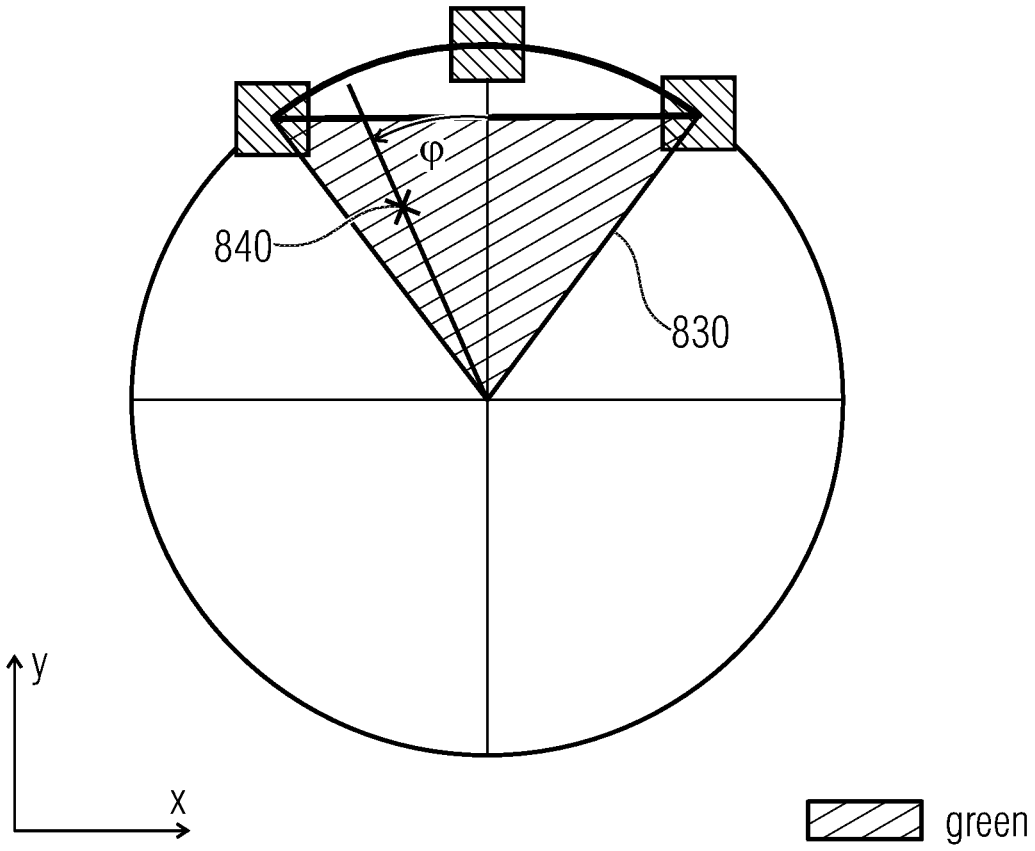
FIG. 8 shows a schematic representation of a radius adjustment which is used in embodiments according to the present invention.

FIG. 8 illustrates the scaling, considering, for example, the first spherical domain triangle. A point 840 within the first spherical domain triangle 830 is described, for example, by an intermediate radius value $\tilde{r}_{xy}$ and by an azimuth angle φ. Points on the chord may, for example, typically comprise (intermediate) radius values which are smaller than the radius of the circle (wherein the radius of the circle may be 1 if it is assumed that the radius is normalized). However, the "radius" (or radius coordinate, or distance from the origin) of the points on the chord may be dependent on the azimuth angle, wherein end points of the chord may have a radius value which is identical to the radius of the circle. However, for the points within the first spherical domain triangle, the radius values may be scaled by the ratio between the radius of the circle (for example, 1) and the radius value (for example, the distance from the origin) of a respective point on the chord. Accordingly, the radius values of points on the chord may be scaled such that they become equal to the radius of the circle. Other points (like, for example, point 840) which have the same azimuth angle, are scaled in a proportional manner.

An example for such adjustment of the radius (more precisely, of the intermediate radius value) will be provided in the following:

For $|\varphi| \leq 30°$:

$$r_{xy} = \tilde{r}_{xy}\frac{\cos\varphi}{\cos 30°}$$

For $30° < |\varphi| \leq 110°$:

$$r_{xy} = \tilde{r}_{xy}\frac{\cos(70° - |\varphi|)}{\cos 80°}$$

For $110° < |\varphi| \leq 180°$:

$$r_{xy} = \tilde{r}_{xy}\frac{\cos(180° - |\varphi|)}{\cos 140°}$$

2) Conversion of z Component

For example, the elevation of a top layer is assumed to be a 30° elevation angle in a spherical coordinate system.

Worded differently, it is assumed, as an example, that elevated speakers (which may be considered to constitute a "top layer") are arranged at an elevation angle of 30°.

Figure 9:
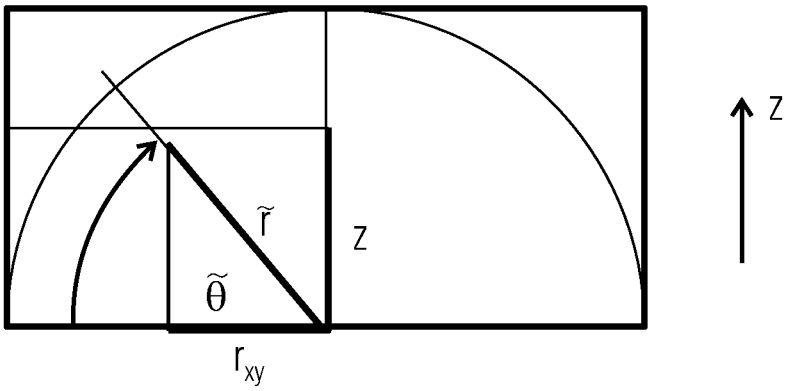
FIG. 9 shows a schematic representation of a derivation of an elevation angle and of a spherical domain radius, which is used in embodiments according to the present invention.

FIG. 9 shows, as an example, a definition of quantities in a spherical coordinate system. As can be seen in FIG. 9, definitions are shown in a two-dimensional projection view. In particular, FIG. 9 shows the (adjusted) intermediate radius value $r_{xy}$, the z-coordinate of the Cartesian representation, a spherical domain radius value $\tilde{r}$ and an elevation angle $\tilde{\theta}$.

In the following, different steps to determine $\tilde{r}$ and $\tilde{\theta}$, or corrected or adjusted versions r, θ thereof, will be described.

Step 1:

In an example, it is possible to calculate the elevation angle $\tilde{\theta}$ based on the radius $r_{xy}$ (which may be the adjusted intermediate radius value) and the z component (which may be the z value of the Cartesian representation). This computation may, for example, be performed by the elevation angle calculator 150. Furthermore, the method also comprises calculating the 3D radius $\tilde{r}$ (also designated as spherical domain radius value) based on the angle $\tilde{\theta}$ (also designated as elevation angle) and $r_{xy}$. For example, a computation $\tilde{r}=r_{xy}/\cos(\tilde{\theta})$ may be used.

Alternatively, however, the 3D radius $\tilde{r}$ may be computed based on the radius $r_{xy}$ and the z component. This computation may, for example, be performed by the spherical domain radius value calculator 160.

For example, $\tilde{\theta}$ and $\tilde{r}$ may be computed according to:

$$\tilde{\theta} = \tan^{-1}\frac{z}{r_{xy}}$$

$$\tilde{r} = \sqrt{r_{xy}^2 + z^2}$$

Step 2: (Optional)

Optionally, a correction of the radius $\tilde{r}$ due to the projection of the rectangular boundaries of the Cartesian system onto the unit circle of the spherical coordinate may be performed.

Figure 10:
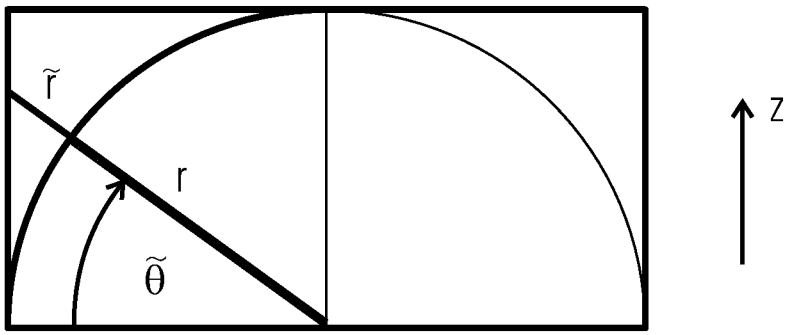
FIG. 10 shows a schematic representation of a correction of a radius, which is used in embodiments according to the present invention.

FIG. 10 shows a schematic representation of this transform.

As can be seen from FIG. 10, the spherical domain radius value $\tilde{r}$ can take values which are larger than the radius of the unit circle in the spherical coordinate system. Taking reference to the above equation mentioned in the previous steps, $\tilde{r}$ can take values up to $\sqrt{2}$ under the assumption that $r_{xy}$ can take values between 0 and 1 and under the assumption that z can take values between 0 and 1, or between −1 and 1 (for example, for points within a unit cube within the spherical coordinate system).

Accordingly, the spherical domain radius value is corrected or adjusted, to thereby obtain a corrected (or adjusted) spherical domain radius value r. For example, the correction or adjustment can be done using the following equations or mapping rules:

For $0 \le \tilde{\theta} \le 45°$:

$$r = \tilde{r}\cos\tilde{\theta}$$

For $45° \le \tilde{\theta} \le 90°$:

$$r = \tilde{r}\sin\tilde{\theta}$$

Moreover, it should be noted that the above-mentioned adjustment or correction of the spherical domain radius value may be performed by the spherical domain radius value corrector 180.

Step 3: (Optional)

Optionally, a correction of the elevation angle $\tilde{\theta}$ may be performed due to the different placement of the loudspeakers in the Cartesian ($\tilde{\theta}$=45°) and spherical (θ=30°) coordinate system.

In other words, since the height loudspeakers or elevated loudspeakers are, for example, arranged at different elevations in a Cartesian coordinate system and in a spherical coordinate system, a mapping of $\tilde{\theta}$ to θ may optionally be performed. Such a mapping may be helpful to improve a hearing impression which can be achieved at the side of an audio decoder. For example, the mapping of $\tilde{\theta}$ to θ will be performed according to the following equation or mapping rule:

$$\theta = \begin{cases} \tilde{\theta}\dfrac{30°}{45°} & \text{for } \tilde{\theta} \le 45° \\ (\tilde{\theta} - 45°)\dfrac{(90° - 30°)}{45°} + 30° & \text{for } 45° < \tilde{\theta} < 90° \end{cases}$$

However, more general formulas could be used, as will be described below.

For example, the mapping of $\tilde{\theta}$ to θ can be performed by the elevation angle corrector 170.

To conclude, details regarding the functionality which may be used when transforming a Cartesian representation into a spherical representation, have been described. The details described here can optionally be introduced into the apparatus 100, both individually and in combination.

3.2 Decoder Side Conversion (Spherical to Cartesian or "Sph 2 Cart") (Embodiment)

On the decoder side, an inverse conversion (which may be inverse to the procedure performed at the production side) may be executed. This means that the conversion steps may, for example, be reversed in opposite order.

In the following, some details will be described.

1) Conversion of Elevation and Projection of Radius on xy-Plane (Calculation of z Component)

Special case θ=90°: (optional)

Optionally, a special handling may be performed in the case of θ=90°. For example, the following settings may be used in this case:

$$x=0, y=0 \text{ and } z=r$$

Step 1: (Optional)

Optionally, a mapping of θ to $\tilde{\theta}$ may be performed which may, for example, reverse the (optional) mapping of $\tilde{\theta}$ to θ mentioned above. For example, the mapping of θ to $\tilde{\theta}$ may be made using the following mapping rule:

$$\tilde{\theta} = \begin{cases} \theta\dfrac{45°}{30°} & \text{for } \theta \le 30° \\ (\theta - 30°)\dfrac{45°}{(90° - 30°)} + 45° & \text{for } 30° < \theta < 90° \end{cases}$$

It should be noted that the mapping of θ to $\tilde{\theta}$ may, for example, be performed by the elevation angle mapper 220, which can be considered as being optional.

Step 2: (Optional)

Optionally, an inversion of a radius correction may be performed. For example, the above-mentioned correction of the radius $\tilde{r}$ due to the projection of the rectangular boundaries of the Cartesian system on to the unit circle of the spherical coordinate system may be reversed by such an operation.

For example, the inversion of the radius correction may be performed using the following mapping rule:

$$\tilde{r} = \begin{cases} \dfrac{r}{\cos\tilde{\theta}} & \text{for } \tilde{\theta} \le 45° \\ \dfrac{r}{\sin\tilde{\theta}} & \text{for } 45° < \tilde{\theta} < 90° \end{cases}$$

For example, the inversion of the radius correction may be performed by the spherical domain radius value mapper 230.

Step 3:

Moreover, a z-coordinate z and a radius value or "intermediate radius value "$r_{xy}$" may be calculated on the basis of the mapped spherical domain radius value $\tilde{r}$ and on the basis of the mapped elevation angle $\tilde{\theta}$ (or, alternatively, on the basis of a spherical domain radius value r and an elevation angle θ, if the above-mentioned optional mapping of $\tilde{\theta}$ to θ and the above-mentioned optional inversion of the radius correction are omitted).

For example, the calculation of z and $r_{xy}$ may be performed according to the following mapping rules:

$$z=\tilde{r}\sin\tilde{\theta}$$

$$r_{xy}=\tilde{r}\cos\tilde{\theta}$$

For example, the calculation of the z coordinate may be performed by the z-coordinate calculator 240. The calculation of $r_{xy}$ may, for example, be performed by the intermediate radius calculator 250.

2) Calculation of x and y Component

In the following, the computation of an x component and a y component will be described. For example, the x component and the y component are determined on the basis of the intermediate radius $r_{xy}$ and on the basis of the azimuth angle φ.

Step 1: (Optional)

Optionally, an inversion of the radius correction may be performed. For example, the optional radius adjustment, which is made because the loudspeakers are placed on a square in the Cartesian coordinate system in contrast to the spherical coordinate system, may be reversed.

The optional inversion of the radius correction may, for example, be performed according to the following mapping rule:

$$\tilde{r}_{xy}=\begin{cases} r_{xy}\dfrac{\cos 30^\circ}{\cos\varphi} & \text{for } |\varphi|\le 30^\circ \\ r_{xy}\dfrac{\cos 80^\circ}{\cos(70^\circ-|\varphi|)} & \text{for } 30^\circ<|\varphi|\le 110^\circ \\ r_{xy}\dfrac{\cos 140^\circ}{\cos(180^\circ-|\varphi|)} & \text{for } 110^\circ<|\varphi|\le 180^\circ \end{cases}$$

For example, the optional inversion of the radius correction may be performed by the radius corrector 260.

Step 2:

Furthermore, a calculation of coordinates $\tilde{x}$ and $\tilde{y}$ may be performed. For example, $\tilde{x}$ and $\tilde{y}$ may be determined on the basis of the corrected radius value $\tilde{r}_{xy}$ and on the basis of the azimuth angle. For example, the following mapping rule may be used for the calculation of $\tilde{x}$ and $\tilde{y}$:

$$\tilde{x}=\begin{cases} -\tilde{r}_{xy}\sin\varphi & \text{for } |\varphi|\le 90^\circ \\ -\tilde{r}_{xy}\sin(180^\circ-\varphi) & \text{for } 90^\circ<|\varphi|\le 180^\circ \end{cases}$$

$$\tilde{y}=\begin{cases} \tilde{r}_{xy}\cos\varphi & \text{for } |\varphi|\le 90^\circ \\ -\tilde{r}_{xy}\cos(180^\circ-|\varphi|) & \text{for } 90^\circ<|\varphi|\le 180^\circ \end{cases}$$

The calculation of $\tilde{x}$ and $\tilde{y}$ may, for example, be performed by the position determinator 270.

Step 3:

Furthermore, a calculation of coordinates x and y, which are coordinates in the Cartesian representation, may be performed.

In particular, a linear transform $T^{-1}$ may be used. Transform matrix $T^{-1}$ may be an inverse of the transform matrix T mentioned above. The transform matrix $T^{-1}$ may, for example, be selected in dependence on the question in which of the spherical domain triangle the coordinates $\tilde{x}$ and $\tilde{y}$ are arranged. For this purpose, a triangle identification 280 may optionally be performed. Then, an appropriate transform matrix $T^{-1}$ may be selected, which is defined as mentioned above.

For example, the calculation of coordinates x and y may be performed according to the following mapping rule:

$$P=\begin{pmatrix} x \\ y \end{pmatrix}=T^{-1}\,\tilde{P}$$

For example, the calculation of x and y will be performed by the mapper 290, wherein the appropriate mapping matrix $T^{-1}$ is selected in dependence on coordinates $\tilde{x}$ and $\tilde{y}$ and, in particular, in dependence on the question in which of the spherical domain triangles a point having coordinates $\tilde{x}$ and $\tilde{y}$ is arranged.

To conclude, a derivation of Cartesian coordinates x, y, z on the basis of spherical coordinates r, φ and θ was described.

However, it should be mentioned that the above calculation could be adapted, for example, by choosing different basis area triangles, spherical domain triangles or mapping rule constants. Also, a number of triangles could be varied, for example, by splitting up one of the base area triangles into two base area triangles and/or by defining more spherical domain triangles.

It should also be noted that any of the details described herein can optionally be introduced into the apparatus 200, both individually, and taken in combination.

3. Audio Stream Provider According to FIG. 11

Figure 11:
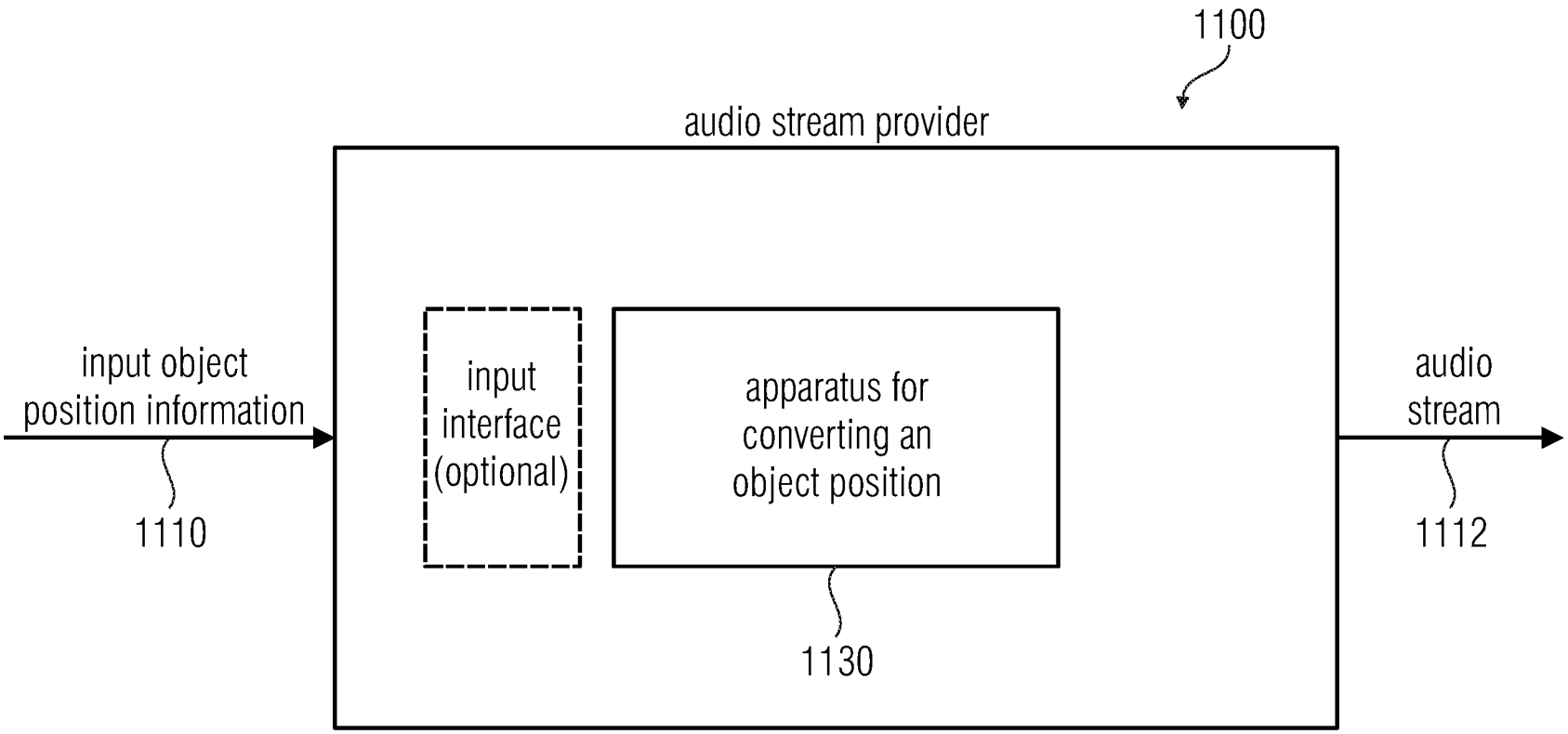
FIG. 11 shows a block schematic diagram of an audio stream provider, according to an embodiment of the present invention.

FIG. 11 shows a block schematic diagram of an audio stream provider, according to an embodiment of the present invention.

The audio stream provider according to FIG. 11 is designated in its entirety with 1100. The audio stream provider 1100 is configured to receive an input object position information describing a position of an audio object in a Cartesian representation. Moreover, the audio stream provider is configured to provide an audio stream 1112 comprising output object position information describing the position of the audio object in a spherical representation. The audio stream provider 1100 comprises an apparatus 1130 for converting object position of an audio object from a Cartesian representation to a spherical representation.

The apparatus 1130 is used to convert the Cartesian representation, which is included in the input object position information, into the spherical representation, which is included into the audio stream 1112. Accordingly, the audio stream provider 1100 is capable to provide an audio stream describing an object position in a spherical representation, even though the input object position information merely describes the position of the audio object in a Cartesian representation. Thus, the audio stream 1112 is usable by audio decoders which may use a spherical representation of an object position to properly render an audio content. Thus, the audio stream provider 1100 is well-suited for usage in a production environment in which object position information is available in a Cartesian representation. It should be noted that many audio production environments are adapted to conveniently specify a position of an audio object in a Cartesian representation (for example, using x, y, z coordinates). Thus, the audio stream provider 1100 can receive object position information from such audio production equipment and provide an audio stream 1112 which is usable by an audio decoder relying on a spherical representation of the object position information.

Moreover, it should be noted that the audio stream provider 1100 can optionally comprise additional functionalities. For example, the audio stream provider 1100 can comprise an audio encoder which receives an input audio information and provides, on the basis thereof, an encoded audio representation. For example, the audio stream provider can receive a one-channel input signal or can receive a multi-channel input signal and provide, on the basis thereof, an encoded representation of the one-channel input audio signal or of the multi-channel input audio signal, which is also included into the audio stream 1112. For example, the one or more input channels may represent an audio signal from an "audio object" (for example, from a specific audio source, like a specific music instrument, or a specific other sound source). This audio signal may be encoded by an audio encoder included in the audio stream provider and the encoded representation may be included into the audio stream. The encoding may, for example, use a frequency domain encoder (like an AAC encoder, or an improved version thereof) or a linear-prediction-domain audio encoder (like an LPC-based audio encoder). However, a position of the audio object may, for example, be described by the input object position information 1110, and may be converted into a spherical representation by the apparatus 1130, wherein the spherical representation of the input object position information may be included into the audio stream. Accordingly, the audio content of an audio object may be encoded separately from the object position information, which typically significantly improves an encoding efficiency.

However, it should be noted that the audio stream provider may optionally comprise additional functionalities, like a downmix functionality (for example, to downmix signals from a plurality of audio objects into one or two or more downmix signals), and may be configured to provide an encoded representation of the one or two or more downmix signals into the audio stream 1112.

Moreover, the audio stream provider may optionally also comprise a functionality to obtain some side information which describes a relationship between two or more object signals from two or more audio objects (like, for example, an inter-object correlation, an inter-object time difference, an inter-object phase difference and/or an inter-object level difference). This side information may be included into the audio stream 1112 by the audio stream provider, for example, in an encoded version.

In this way, the information may be included into the audio stream 1112 by the audio stream provider, for example, in an encoded version.

Thus, the audio stream provider 1100 may, for example, be configured to include an encoded downmix signal, encoded object-relationship metadata (side information) and encoded object position information into the audio stream, wherein the encoded object position information may be in a spherical representation.

However, the audio stream provider 1100 may optionally be supplemented by any of the features and functionalities known to the man skilled in the art with respect to audio stream providers and audio encoders.

Also, it should be noted that the apparatus 1130 may, for example, correspond to the apparatus 100 described above, and may optionally comprise additional features and functionalities and details as described herein.

4. Audio Content Production System According to FIG. 12

Figure 12:
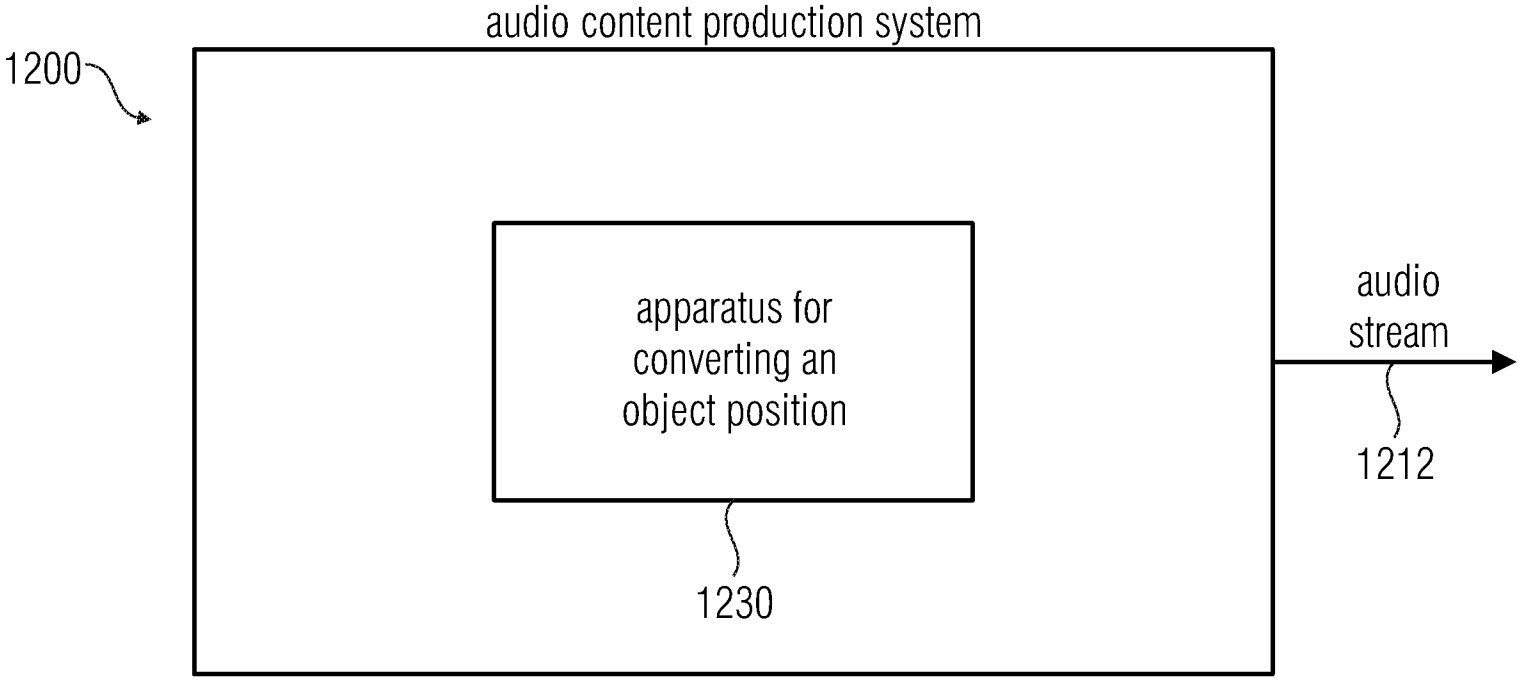
FIG. 12 shows a block schematic diagram of an audio content production system, according to an embodiment of the present invention.

FIG. 12 shows a block-schematic diagram of an audio content production system 1200, according to an embodiment of the present invention.

The audio content production system 1200 may be configured to determine an object position information describing a position of an audio object in a Cartesian representation. For example, the audio content production system may comprise a user interface, where a user can input the object position information in a Cartesian representation. However, optionally, the audio content production system may also derive the object position information in the Cartesian representation from other input information, for example, from a measurement of the object position or from a simulation of a movement of an object, or from any other appropriate functionality.

Moreover, the audio content production system comprises an apparatus for converting an object position of an audio object from a Cartesian representation to a spherical representation, as described herein. The apparatus for converting the object position is designated with 1230 and may correspond to the apparatus 100 as described above. Moreover, the apparatus 1230 is used to convert the determined Cartesian representation into the spherical representation.

Moreover, the audio content production system is configured to include the spherical representation provided by the apparatus 1230 into an audio stream 1212.

Thus, the audio content production system may provide an audio stream comprising an object position information in a spherical representation even though the object position information may originally be determined in a Cartesian representation (for example, from a user interface or using any other object position determination concept).

Naturally, the audio content production system may also include other audio content information, for example, an encoded representation of an audio signal, and possibly additional meta information into the audio stream 1212. For example, the audio content production system may include the additional information described with respect to the audio stream provider 1110 into the audio stream 1212.

Thus, the audio content production system 1200 may optionally comprise an audio encoder which provides an encoded representation of one or more audio signals. The audio content production system 1200 may also optionally comprise a downmixer, which downmixes audio signals from a plurality of audio objects into one or two or more downmix signals. Moreover, the audio content production system may optionally be configured to derive object-relationship information (like, for example, object level difference information or inter-object correlation values, or inter-object time difference values, or the like) and may include an encoded representation thereof into the audio stream 1212.

To summarize, the audio content production system 1200 can provide an audio stream 1212 in which the object position information is included in a spherical representation, even though the object position is originally provided in a Cartesian representation.

Naturally, the apparatus 1230 for converting the object position from the Cartesian representation to the spherical representation can be supplemented by any of the features and functionalities and details described herein.

5. Audio Playback Apparatus According to FIG. 13

Figure 13:
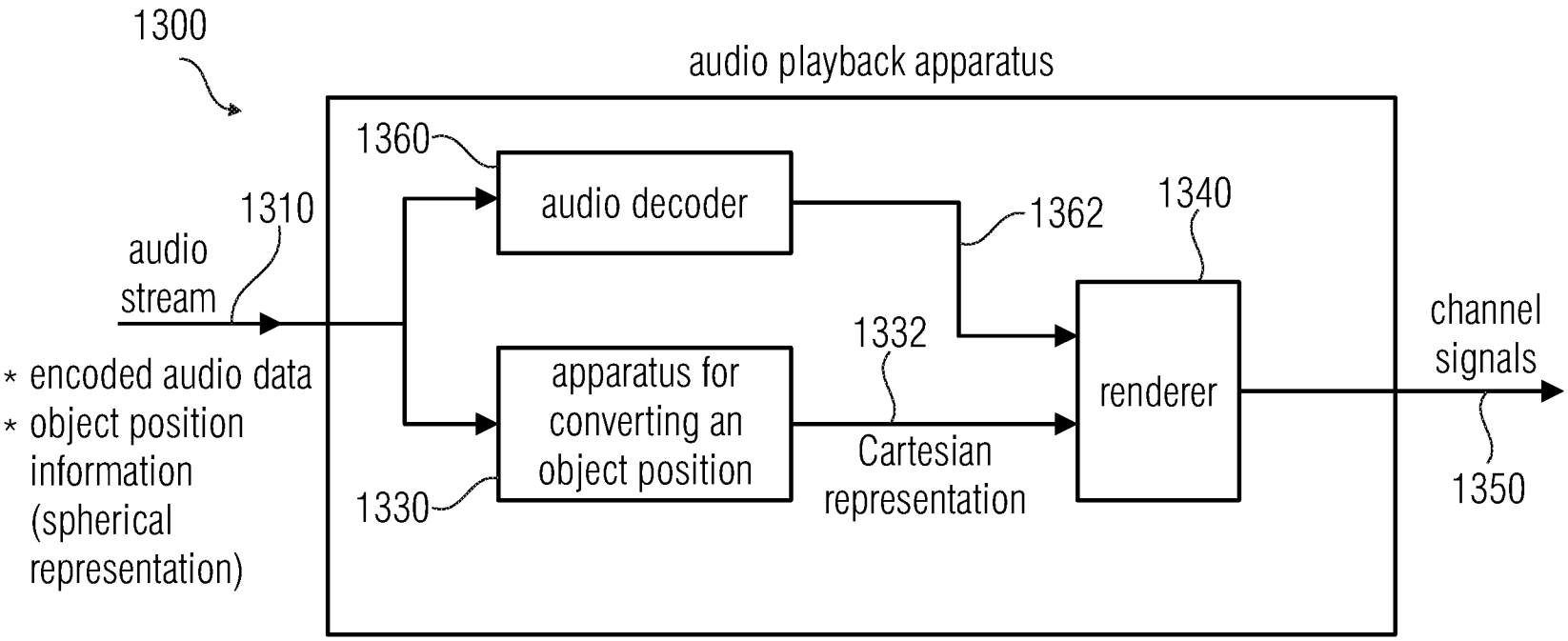
FIG. 13 shows a block schematic diagram of an audio playback apparatus, according to an embodiment of the present invention.

FIG. 13 shows a block-schematic diagram of an audio playback apparatus 1300, according to an embodiment of the present invention.

The audio playback apparatus 1300 is configured to receive an audio stream 1310 comprising a spherical representation of an object position information. Moreover, the audio stream 1310 typically also comprises encoded audio data.

The audio playback apparatus comprises an apparatus 1330 for converting an object position from a spherical representation into a Cartesian representation, as described herein. The apparatus 1330 for converting the object position may, for example, correspond to the apparatus 200 described herein. Thus, the apparatus 1330 for converting an object position may receive the object position information in the spherical representation and provide the object position information in a Cartesian representation, as shown at reference numeral 1332.

Moreover, the audio playback apparatus 1300 also comprises a renderer 1340 which is configured to render an audio object to a plurality of channel signals 1350 associated with sound transducers in dependence on the Cartesian representation 1332 of the object position information.

Optionally, the audio playback apparatus also comprises an audio decoding (or an audio decoder) 1360 which may, for example, receive encoded audio data, which is included in the audio stream 1310, and provide, on the basis thereof, decoded audio information 1362. For example, the audio decoding may provide, as the decoded audio information 1362, one or more channel signals or one or more object signals to the renderer 1340.

Moreover, it should be noted that the renderer 1340 may render a signal of an audio object at a position (within a hearing environment) determined by the Cartesian representation 1332 of the object position. Thus, the renderer 1340 may use the Cartesian representation 1332 of the object position to determine how a signal associated to an audio object should be distributed to the channel signals 1350. In other words, the renderer 1340 decides, on the basis of the Cartesian representation of the object position information, by which sound transducers or speakers a signal from an audio object is rendered (and in which intensity the signal is rendered in the different channel signals).

This provides for an efficient concept for an audio playback. Also, it should be noted that several types of renderers could be used which receive an object position information in a Cartesian representation, because many renderers typically have difficulties to handle an object position representation in a spherical representation (or cannot deal with object position information in a spherical representation at all).

Thus, by using the apparatus 1330 for converting an object position information in a spherical representation into a Cartesian representation, the audio playback apparatus can use rendering apparatuses which are best suited for object position information provided in a Cartesian representation. Also, it should be noted that the apparatus 1330 can be implemented with comparatively small computational effort, as discussed above.

Moreover, it should be noted that the apparatus 1330 can be supplemented by any of the features and functionalities and details described with respect to the apparatus 200.

6. Method According to FIG. 14

Figure 14:
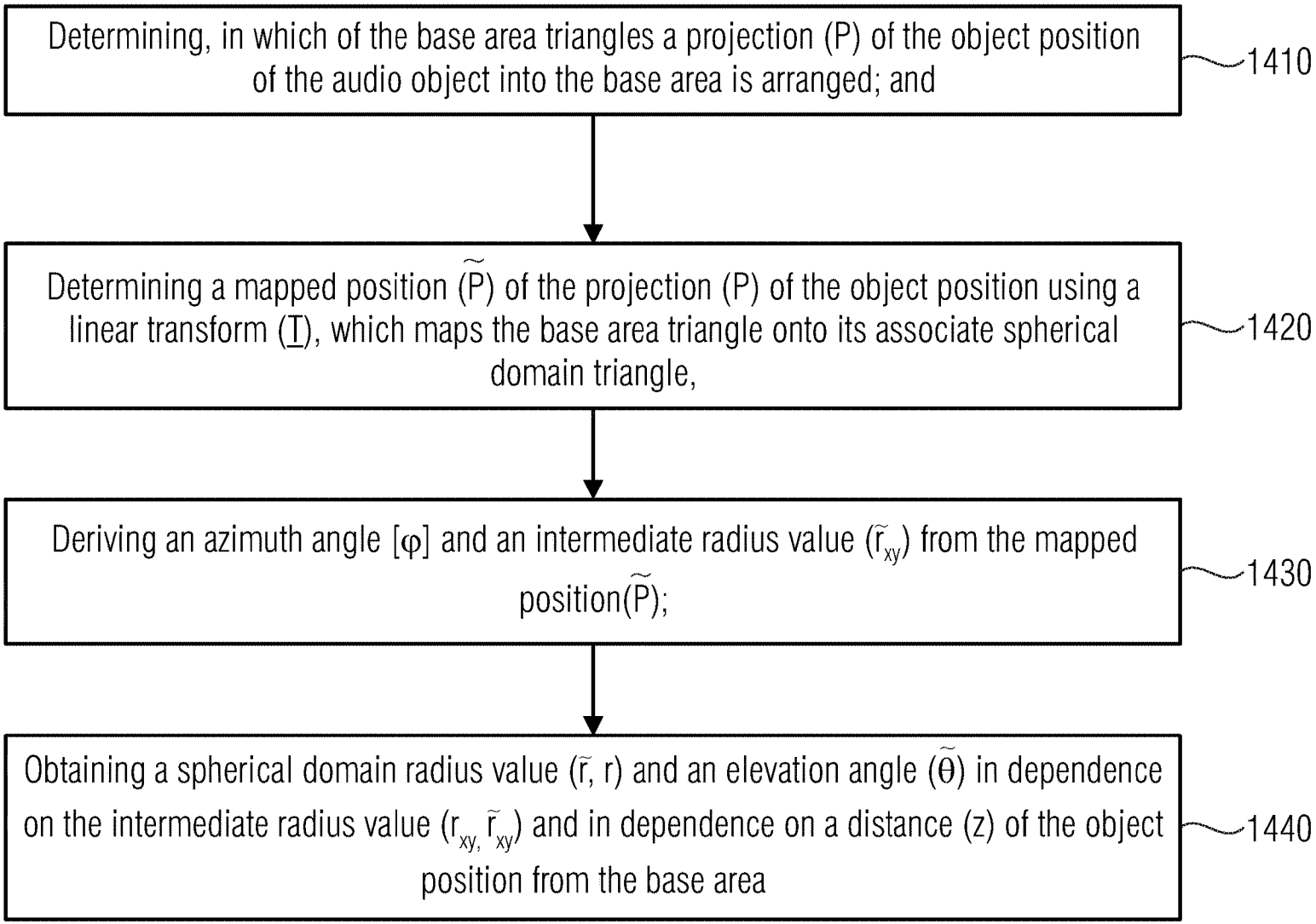
FIG. 14 shows a flowchart of a method, according to an embodiment of the present invention.

FIG. 14 shows a flowchart of a method for converting an object position of an audio object from a Cartesian representation to a spherical representation.

The method 1400 according to claim 14 comprises determining 1410 in which of the number of base area triangles a projection of the object position of the audio object into the base area is arranged. The method also comprises determining 1420 a mapped position of the projection of the object position using a linear transform, which maps the base area triangle onto its associate spherical domain triangle.

The method also comprises deriving 1430 an azimuth angle and an intermediate radius value from the mapped position. The method also comprises obtaining 1440 a spherical domain radius value and an elevation angle in dependence on the intermediate radius value and in dependence on a distance of the object position from the base area.

This method is based on the same considerations as the above-mentioned apparatus for converting an object position from a Cartesian representation to a spherical representation. Accordingly, the method 1400 can be supplemented by any of the features, functionalities and details described herein, for example, with respect to the apparatus 100.

7. Method According to FIG. 15

Figure 15:
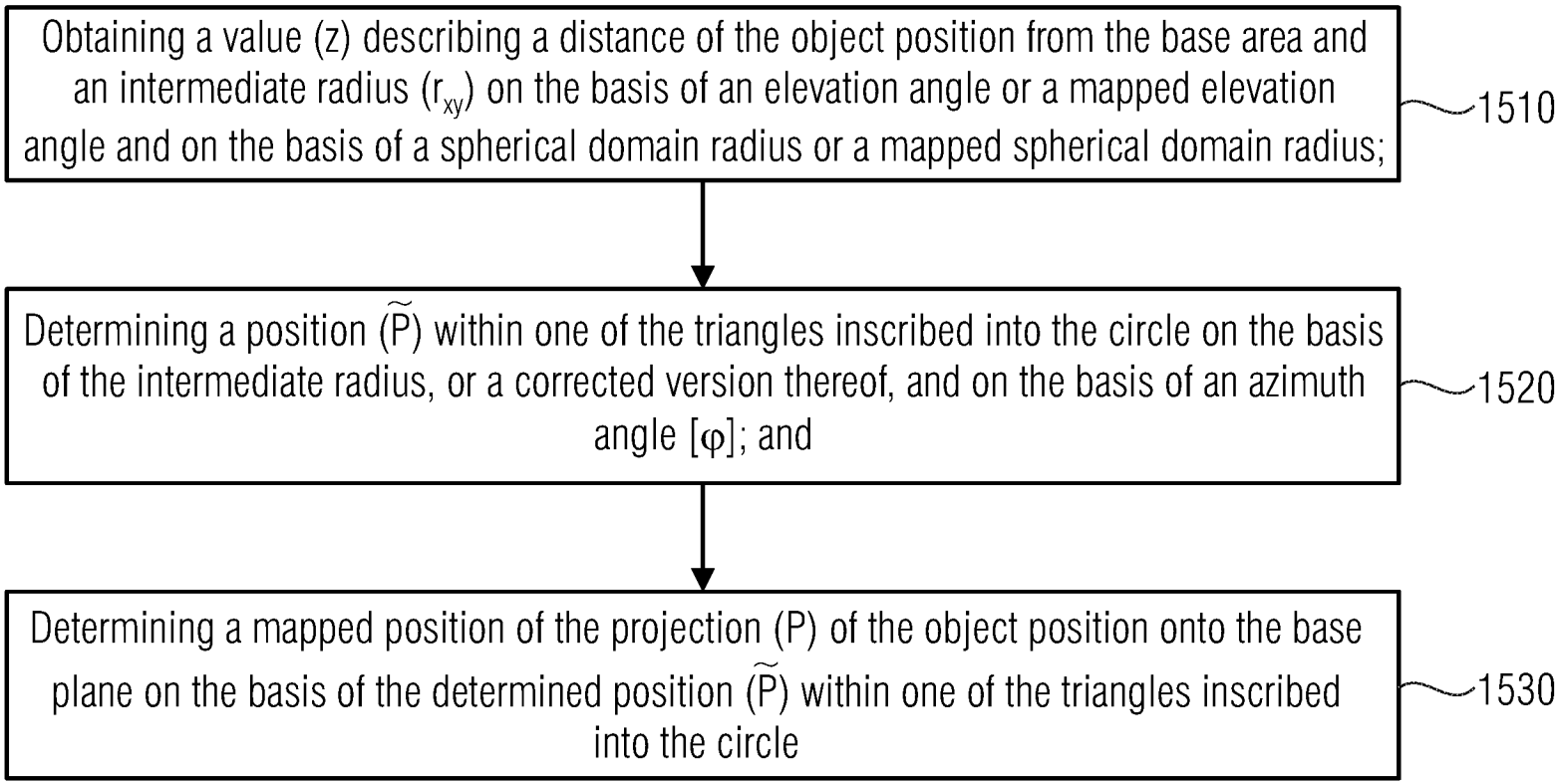
FIG. 15 shows a flowchart of a method, according to an embodiment of the present invention.

FIG. 15 shows a flowchart of a method for converting an object position of an audio object from a spherical representation to a Cartesian representation.

The method comprises obtaining 1510 a value describing a distance of the object position from the base area and an intermediate radius on the basis of an elevation angle or a mapped elevation angle and on the basis of a spherical domain radius or a mapped spherical domain radius.

The method also comprises determining 1520 a position within one of a plurality of triangles inscribed into a circle on the basis of the intermediate radius, or a corrected version thereof, and on the basis of an azimuth angle.

The method also comprises determining a 1530 mapped position of the projection of the object position onto a base plane of a Cartesian representation on the basis of the determined position within one of the triangles inscribed into the circle.

This method is based on the same considerations as the above-described apparatuses. Also, the method 1500 can be supplemented by any of the features, functionalities and details described herein.

In particular, the method 1500 can be supplemented by any of the features, functionalities and details described with respect to the apparatus 200.

8. Method According to FIG. 16

Figure 16:
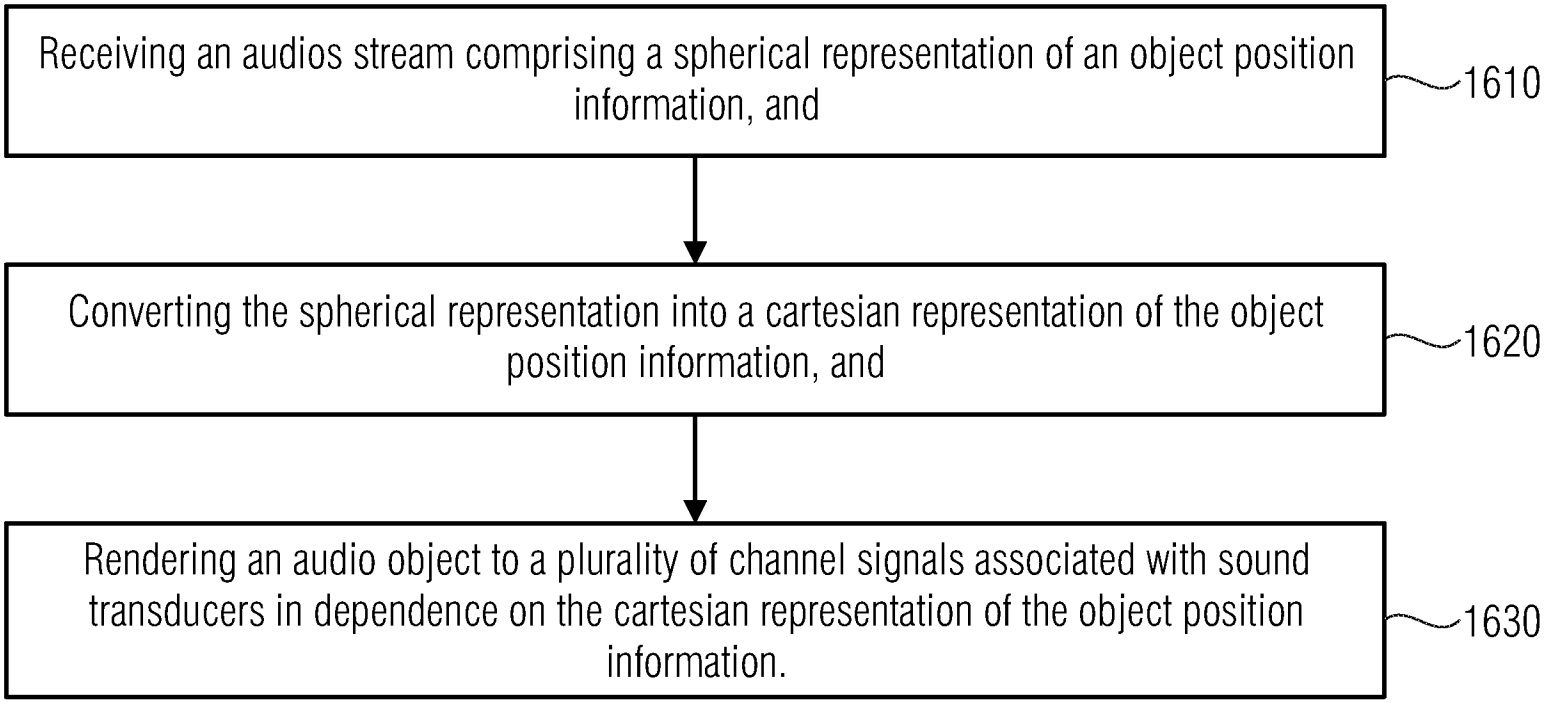
FIG. 16 shows a flowchart of a method, according to an embodiment of the present invention.

FIG. 16 shows a flowchart of a method 1600 for audio playback.

The method comprises receiving 1610 an audios stream comprising a spherical representation of an object position information.

The method also comprises converting 1620 the spherical representation into a Cartesian representation of the object position information.

The method also comprises rendering 1630 an audio object to a plurality of channel signals associated with sound transducers in dependence on the Cartesian representation of the object position information.

In particular, the method 1600 can be supplemented by any of the features, functionalities and details described herein.

9. Conclusions and Further Embodiments

In the following, additional embodiments will be described which can be used individually or in combination with the features, functionalities and details described herein.

Also, the features and functionalities and details described in the following can optionally be used in combination with any of the other embodiments described herein.

A first aspect creates a method to convert audio related object metadata between different coordinate spaces A second aspect creates a method to convert audio related object metadata from room related coordinates to listener related coordinates and vice versa.

A third aspect creates a method to convert loudspeaker positions between different coordinate spaces.

A fourth aspect creates a method to convert loudspeaker positions metadata from room related coordinates to listener related coordinates and vice versa.

A fifth aspect creates a method to convert audio object position metadata from a Cartesian parameter space to a spherical coordinate system, that separates the conversion from the xy plane to the azimuth angle j and the conversion from the z component to the elevation angle q.

A sixth aspect creates a method according to the fifth aspect that correctly maps the loudspeaker positions from the Cartesian space to the spherical coordinate system.

A seventh aspect creates a method according to the fifth aspect that projects the surfaces of the cuboid space in the Cartesian coordinate system, on which the loudspeakers are located, on to the surface of the sphere that contains the corresponding loudspeakers in the spherical coordinate system.

An eight aspect creates a method according to one of the first aspect to fifth aspect that comprises following processing steps:

- Projecting triangles formed by 2 neighboring loudspeaker positions in the xy-plane and the center of the cuboid onto the corresponding triangle in the spherical space
- Correcting the radius to map the outer edge of the loudspeaker rectangle from the xy-plane on the corresponding circle containing the loudspeakers in the horizontal plane of the spherical coordinate system
- Applying the elevation on the radius based on the z component, to determine a spherical (3D) radius
- Correcting the radius based on the elevation angle to map also the height speakers onto the sphere
- Correcting the elevation angle to reflect the different elevations of the height speakers in Cartesian and spherical coordinate systems A ninth aspect creates a method that performs the inverse operations according to the fifth aspect.

A tenth aspect creates a method that performs the inverse operations according to the sixth aspect.

An eleventh aspect creates a method that performs the inverse operations according to the seventh aspect.

A twelfth aspect creates a method that performs the inverse operations according to the eight aspect.

10. Further Embodiments

In the following, further embodiments according to the invention will be described, which can be used individually or in combination with any of the features, functionalities and details described herein (also in the claims). Further, any of the other embodiments described herein (also in the claims) can optionally be supplemented by any of the features, functionalities and details described in this section, both individually and taken in combination.

Mapping Rule for Dynamic Object Position Metadata:

This section describes a conversion from production side object metadata, especially object position data, in case on production side a Cartesian coordinate system is used, but in the transport format the object position metadata is described in spherical coordinates.

The problem is that in the Cartesian coordinates the loudspeakers are not always located at the mathematically correct positions compared to the spherical coordinate system. Therefore, a conversion is needed, that ensures that the cuboid area from the Cartesian space is projected correctly into the sphere (or semi-sphere). E.g. loudspeaker positions are equally rendered using an audio object renderer based on a spherical coordinate system (e.g. a renderer as described in the MPEG-H 3D Audio standard) or using a Cartesian based renderer with the corresponding conversion algorithm. The cuboid surfaces should be or have to be mapped/projected onto the surface of the sphere on which the loudspeakers are located.

Furthermore, it is desired or useful that the conversion algorithm has a small computational complexity especially the conversion step from spherical to Cartesian coordinates.

An example application for the embodiments according to the invention is: use state-of-the-art audio object authoring tools that often use a Cartesian parameter space (x,y,z) for the audio object coordinates, but use a transport format that describes the audio object positions in spherical coordinates (azimuth, elevation, radius), like e.g. MPEG-H 3D Audio. However, the transport format may be (or has to) be agnostic to the renderer (spherical or Cartesian), that is applied afterwards.

The conversion is exemplarily described for a 5.1+4H loudspeaker set-up, but can easily transferred for all kind of loudspeaker set-ups (e.g. 7.1+4, 22.2, etc.) or varying Cartesian parameter spaces (different orientation of the axes, or different scaling of the axes, . . . )

General Comparison of Coordinate Systems

Figure 17:
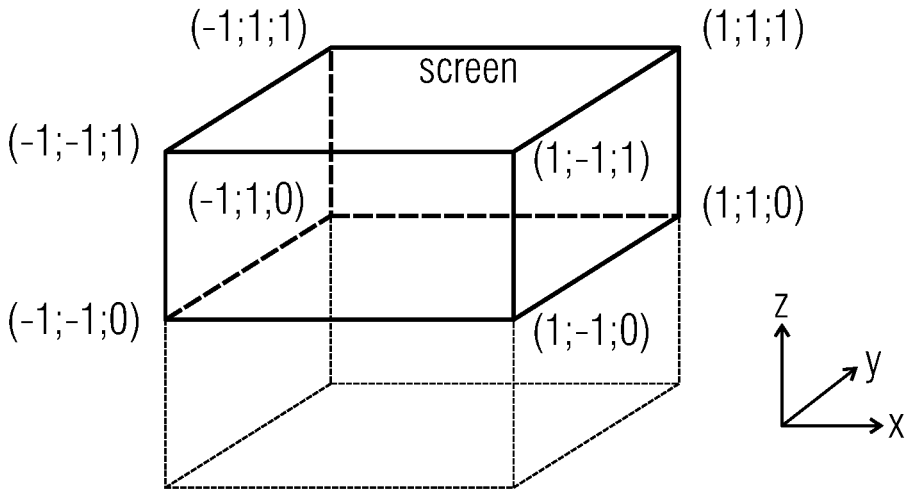
FIG. 17 shows a schematic representation of an example of a Cartesian parameter room with corresponding loudspeaker positions for a 5.1+4H setup.

An example of a Cartesian parameter room with corresponding loudspeaker positions for a 5.1+4H set-up is shown in FIG. 17.

Figure 18:
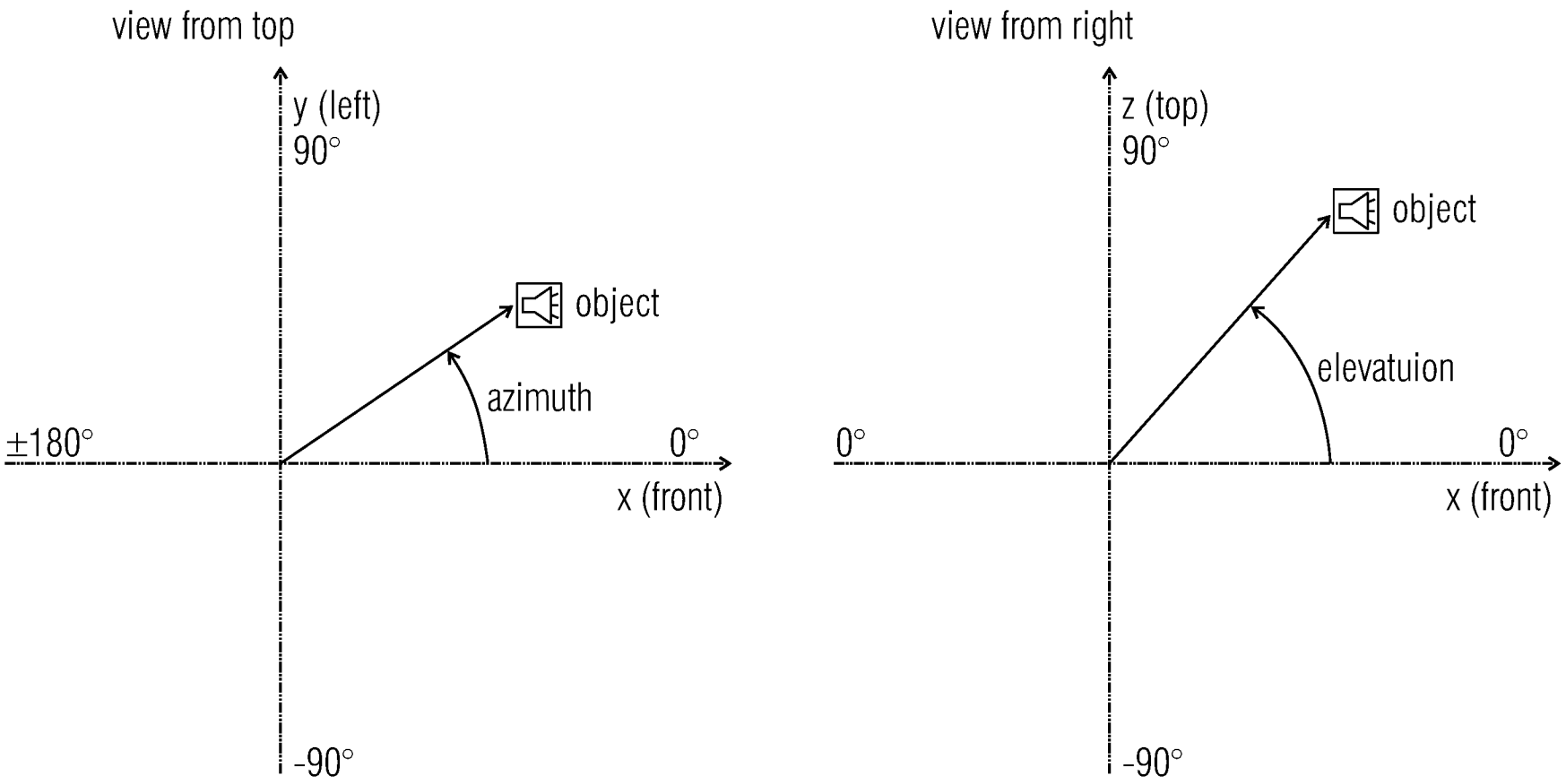
FIG. 18 shows a schematic representation of a spherical coordinate system according to ISO/IEC 23008-3:2015 MPEG-H 3D Audio.

An example of a Spherical Coordinate System according to ISO/IEC 23008-3:2015 MPEG-H 3D Audio is shown in FIG. 18.

Note that the coordinates X and Y in the ISO coordinate system are defined differently compared to the Cartesian coordinate system described above.

Production Side Conversion (Cartesian 2 Spherical)

The loudspeaker positions are given in spherical coordinates as e.g. described by the ITU-R recommendation ITU-R BS.2051-1 (advanced sound system for programme production) and described in the MPEG-H specification. The conversion is applied in a separated approach. First the x and y coordinates are mapped to the azimuth angle φ and the radius $r_{xy}$ in the azimuth/xy plane. Afterwards the elevation angle and the radius in the 3D space are calculated using the z coordinate. The mapping is exemplarily described for the 5.1+4H loudspeaker set-up.

Special Case x=y=0:

For z>0:

φ=undefined(=0°), θ=90° and r=z.

For z=0:

φ=undefined(=0°), θ=0° and r=0.

1) Conversion in Xy-Plane

Figure 19:
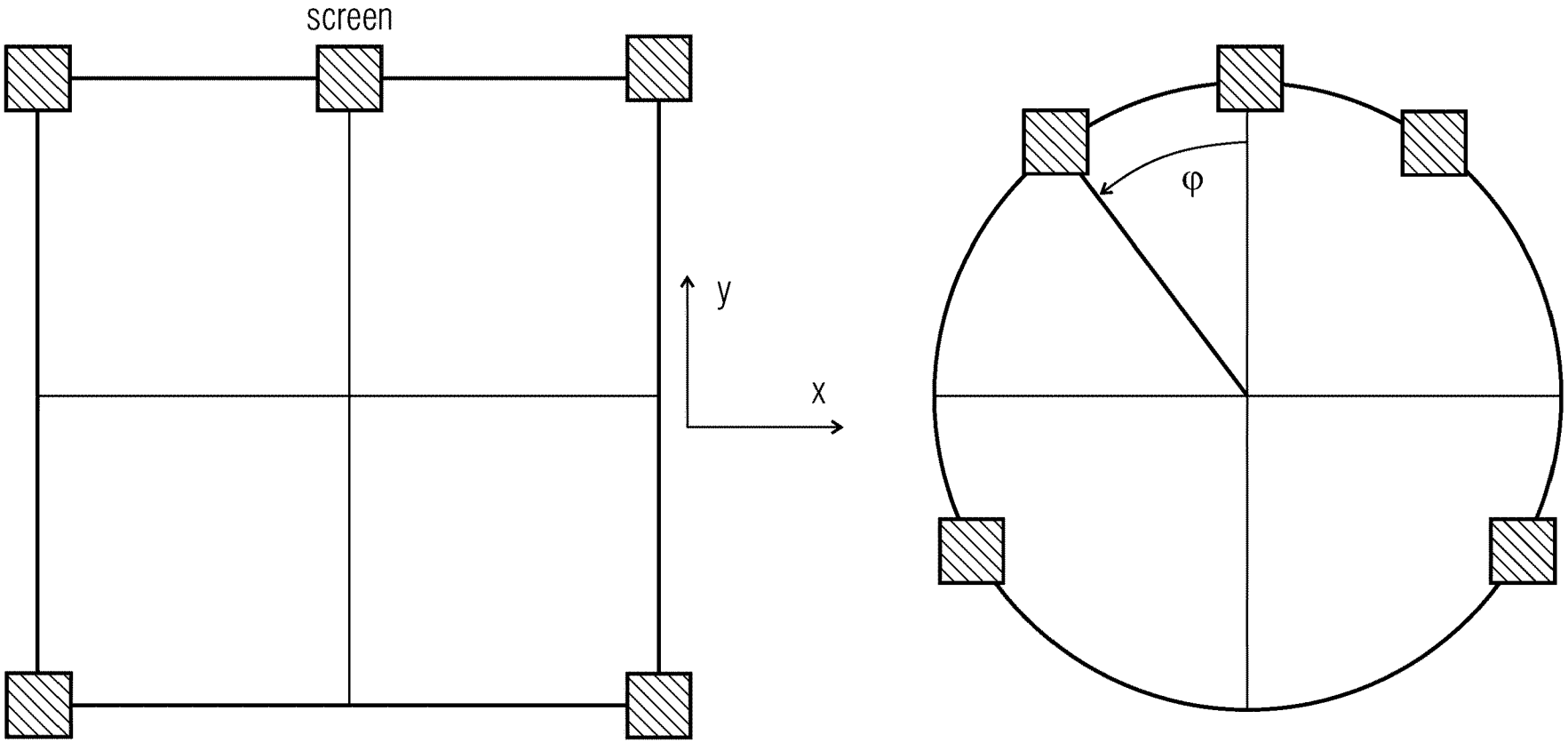
FIG. 19 shows a schematic representation of speaker positions in a Cartesian coordinate system and in a spherical coordinate system.

Reference is made to FIG. 19, which shows a schematic representation of a Cartesian coordinate system and of a spherical coordinate system, and of speakers (filled squares).

Step 1:

In the first step triangles in the Cartesian coordinate system are mapped to corresponding triangles in the spherical coordinate system.

Figure 20:
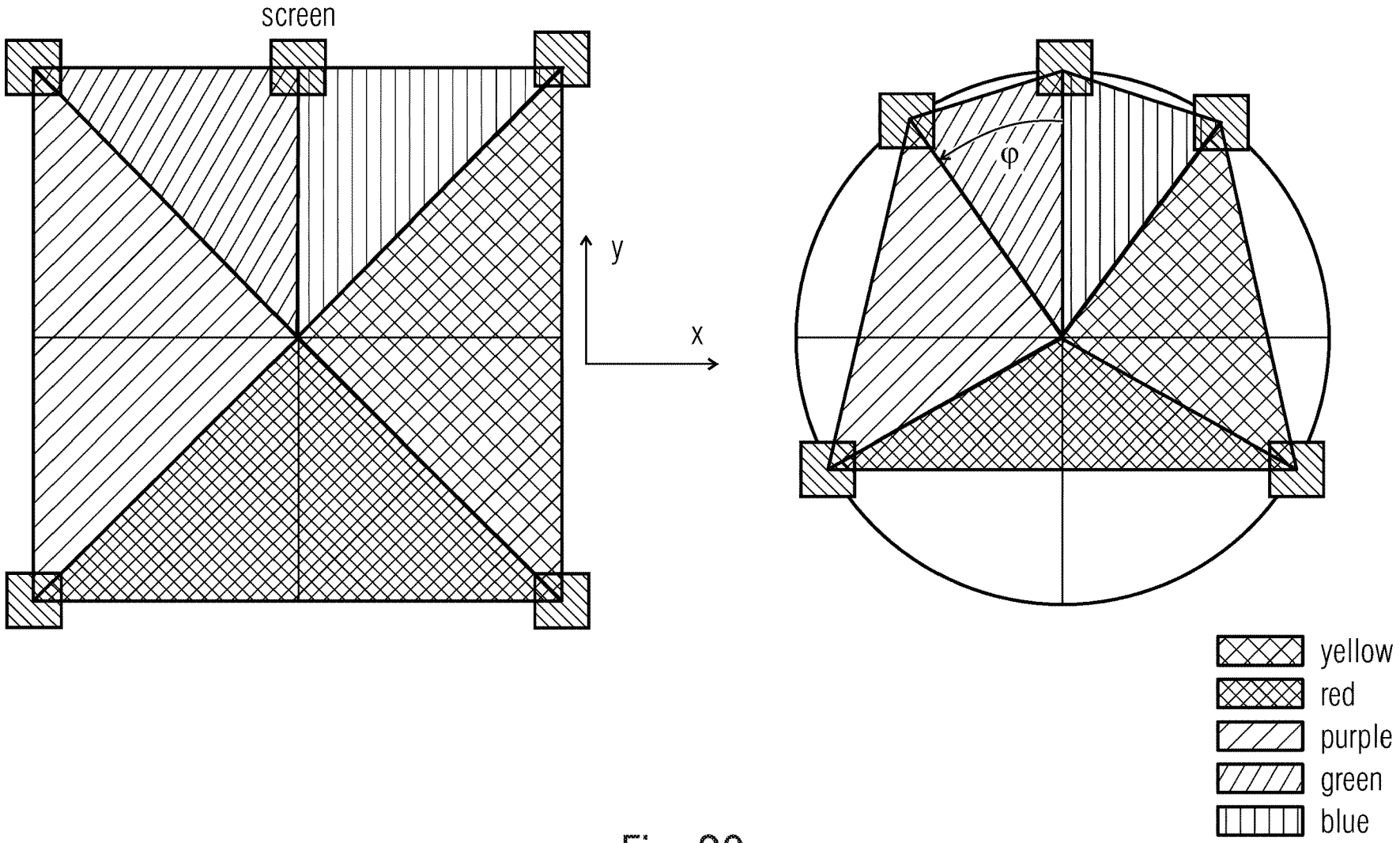
FIG. 20 shows a graphic representation of a mapping of triangles in a Cartesian coordinate system onto corresponding triangles in a spherical coordinate system.

Reference is made to FIG. 20, which shows a graphic representation of triangles inscribed into a square in the Cartesian coordinate system and into a circle in the spherical coordinate system.

Figure 21:
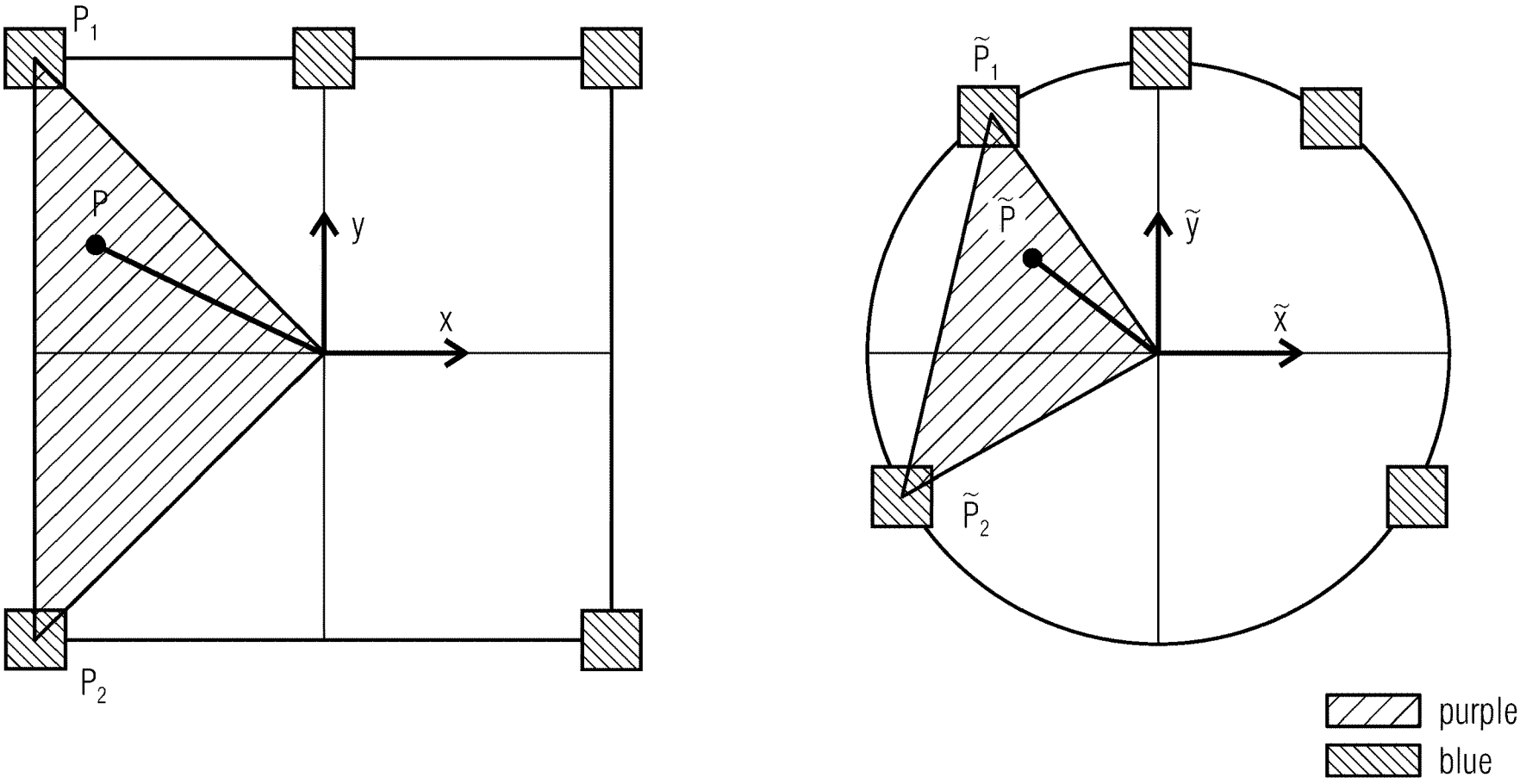
FIG. 21 shows a schematic representation of a mapping of a point within a triangle in the Cartesian coordinate system onto a point within a corresponding triangle in the spherical coordinate system.
Figure 22A:
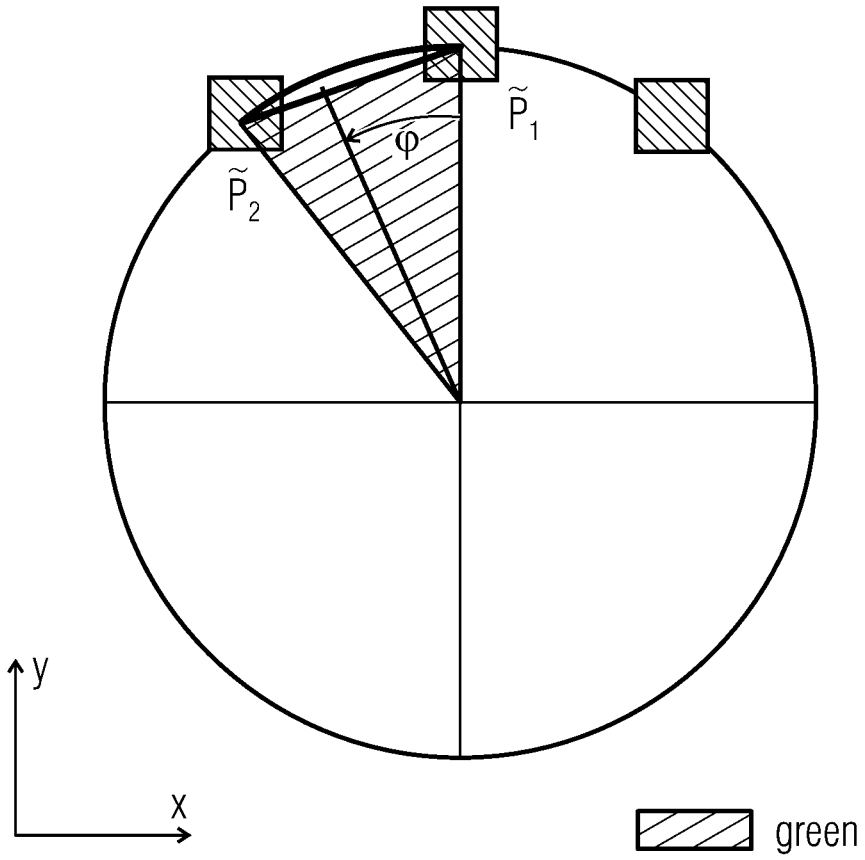
FIG. 22*a-b* shows a schematic representation of a radius adjustment which is used in embodiments according to the present invention.
Figure 22B:
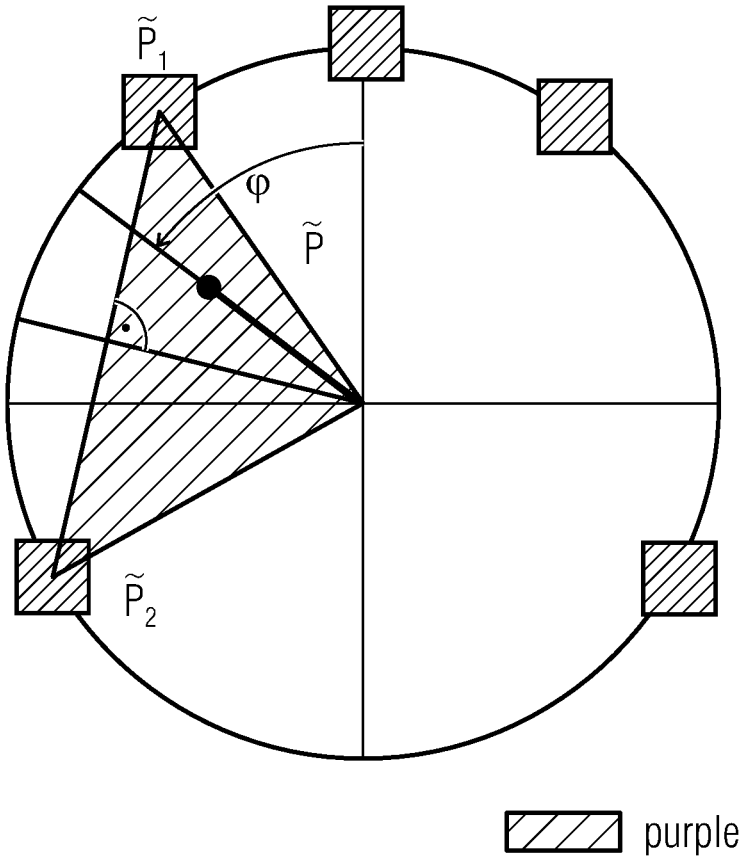

In the following this is shown exemplarily for one triangle. Reference is also made to FIG. 21.

The triangles can be projected onto each other using a linear transform:

$$\tilde{P} = \begin{pmatrix} \tilde{x} \\ \tilde{y} \end{pmatrix} = \underline{T}\ P$$

The transform matrix can be calculated using the known positions of the corners of the triangle $P_1$, $P_2$, $\tilde{P}_1$ and $\tilde{P}_2$. These points depend on the loudspeaker set-up and the corresponding positions of the loudspeakers and the triangle in which the position P is located.

$$\underline{T} = \begin{bmatrix} t_{11} & t_{12} \\ t_{21} & t_{22} \end{bmatrix} = \frac{1}{P_{1,x}P_{2,y} - P_{2,x}P_{1,y}} \begin{bmatrix} \tilde{P}_{1,x}P_{2,y} - \tilde{P}_{2,x}P_{1,y} & P_{1,x}\tilde{P}_{2,x} - \tilde{P}_{1,x}P_{2,x} \\ \tilde{P}_{1,y}P_{2,y} - \tilde{P}_{2,y}P_{1,y} & P_{1,x}\tilde{P}_{2,y} - \tilde{P}_{1,y}P_{2,x} \end{bmatrix}$$

The 5.1+4H loudspeaker setup contains in the middle layer a standard 5.1 loudspeaker setup, which is the basis for the projection in the xy-plane. In the Table 2 the corresponding points $P_1$, $P_2$, $\tilde{P}_1$ and $\tilde{P}_2$ are given for the 5 triangles that have to be projected.

Step 2:

Calculate the radius $\tilde{r}_{xy}$ and the azimuth angle φ based on the mapped coordinates $\tilde{x}$ and $\tilde{y}$.

$$\tilde{r}_{xy} = \sqrt{\tilde{x}^2 + \tilde{y}^2}$$

$$\varphi = \begin{cases} \tan^{-1}\frac{-\tilde{x}}{\tilde{y}} \text{ for } \tilde{y} > 0 \\ -90° \text{ for } \tilde{y} = 0 \wedge \tilde{x} > 0 \\ 0° \text{ for } \tilde{y} = 0 \wedge \tilde{x} = 0 \\ 90° \text{ for } \tilde{y} = 0 \wedge \tilde{x} < 0 \\ -90° + \tan^{-1}\frac{\tilde{y}}{\tilde{x}} \text{ for } \tilde{y} < 0 \wedge \tilde{x} > 0 \\ -180° \text{ for } \tilde{y} < 0 \wedge \tilde{x} = 0 \\ 90° + \tan^{-1}\frac{\tilde{y}}{\tilde{x}} \text{ for } \tilde{y} < 0 \wedge \tilde{x} < 0 \end{cases}$$

Step 3:

The radius has to be adjusted, because the loudspeakers are placed on a square in the Cartesian coordinate system in contrast to the spherical coordinate system. In the spherical coordinate system the loudspeakers are positioned on a circle.

To adjust the radius the boundary of the Cartesian loudspeaker square is projected on the circle of the spherical coordinate system. This means the chord is projected onto the corresponding segment of the circle.

For $\varphi(\tilde{P}_1) < \varphi \leq \varphi(\tilde{P}_2)$:

$$r_{xy} = \tilde{r}_{xy} \frac{\cos\left(\frac{\varphi(\tilde{P}_2) + \varphi(\tilde{P}_1)}{2} - \varphi\right)}{\cos\left(\frac{\varphi(\tilde{P}_2) - \varphi(\tilde{P}_1)}{2}\right)}$$

2) Conversion of z Component

The elevation of the top layer is assumed to be at $\theta_{Top}$=30° (or 35°) elevation angle in the spherical coordinate system (typical elevation recommended by ITU-R BS.2051).

Figure 23:
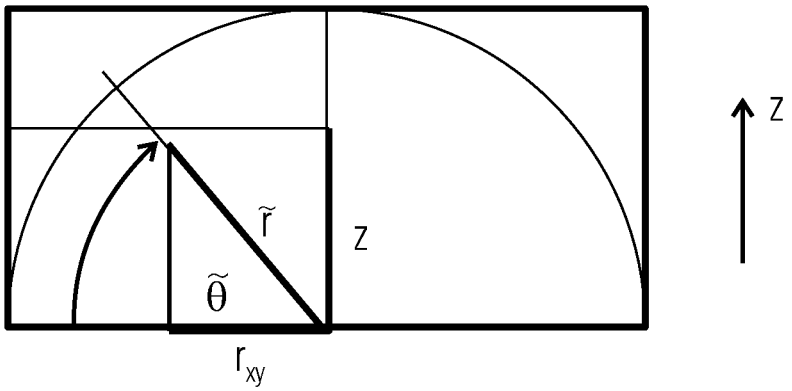
FIG. 23 shows a schematic representation of a derivation of an elevation angle and of a spherical domain radius, which is used in embodiments according to the present invention.

Reference is also made to FIG. 23.

Step 1:

Calculate the elevation angle $\tilde{\theta}$ based on the radius $r_{xy}$ and the z component. Furthermore, calculate the 3D radius $\tilde{r}$ based on angle $\tilde{\theta}$ and $r_{xy}$.

$$\tilde{\theta} = \tan^{-1}\frac{z}{r_{xy}}$$

$$\tilde{r} = \sqrt{r_{xy}^2 + z^2}$$

Step 2:

Correction of the radius $\tilde{r}$ due to the projection of the rectangular boundaries of the Cartesian system onto the unit circle of the spherical coordinate system.

Figure 24:
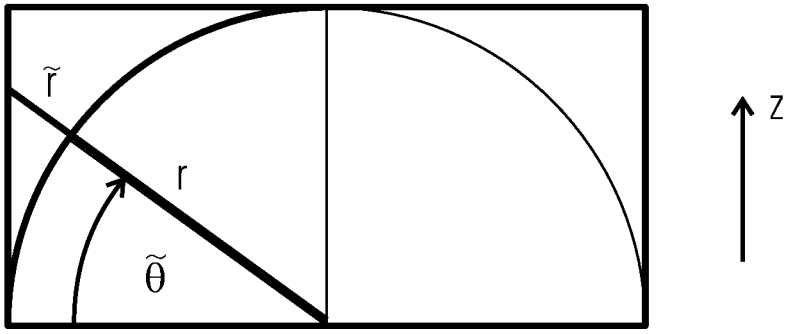
FIG. 24 shows a schematic representation of a correction of a radius, which is used in embodiments according to the present invention.

Reference is also made to FIG. 24.

For $0 \leq \tilde{\theta} \leq 45°$:

$$r = \tilde{r} \cos \tilde{\theta}$$

For $45° < \tilde{\theta} \leq 90°$:

$$r = \tilde{r} \sin \tilde{\theta}$$

Step 3:

Correction of the elevation angle $\tilde{\theta}_{Top}$, due to the different placement of the loudspeakers in the Cartesian ($\tilde{\theta}_{Top}$=45°) and spherical ($\theta_{Top}$=30° (or 35°)) coordinate system.

Mapping of $\tilde{\theta}$ to θ:

$$\theta = \begin{cases} \tilde{\theta}\frac{\theta_{Top}}{\tilde{\theta}_{Top}} & \text{for } \tilde{\theta} \leq \tilde{\theta}_{Top} \\ (\tilde{\theta} - \tilde{\theta}_{Top})\frac{(90° - \theta_{Top})}{\tilde{\theta}_{Top}} + \theta_{Top} & \text{for } \tilde{\theta}_{Top} < \tilde{\theta} < 90° \end{cases}$$

Decoder Side Conversion (Sph 2 Cart)

On the decoder side the inverse conversion to the production side has to be executed. This mean the conversion steps are reversed in opposite order.

Conversion of Elevation and Projection of Radius on Xy-Plane (Calculation of z Component)

Special Case θ=90°:

$$x=0, y=0 \text{ and } z=r$$

Step 1:

Mapping of θ to $\tilde{\theta}$: with $\theta_{Top}$=30° (or 35°)

$$\tilde{\theta} = \begin{cases} \theta\frac{\tilde{\theta}_{Top}}{\theta_{Top}} & \text{for } \theta \leq \theta_{Top} \\ (\theta - \theta_{Top})\frac{\tilde{\theta}_{Top}}{(90° - \theta_{Top})} + \tilde{\theta}_{Top} & \text{for } \theta_{Top} < \theta < 90° \end{cases}$$

Step 2:

Inversion of radius correction: with $\tilde{\theta}_{Top}=45°$ $$\tilde{r}=\begin{cases}\dfrac{r}{\cos\tilde{\theta}} & \text{for } \tilde{\theta}\le\tilde{\theta}_{Top}\\ \dfrac{r}{\sin\tilde{\theta}} & \text{for } \tilde{\theta}_{Top}<\tilde{\theta}<90°\end{cases}$$

Step 3:

Calculate z and $r_{xy}$ $$z=\tilde{r}\sin\tilde{\theta}$$

$$r_{xy}=\tilde{r}\cos\tilde{\theta}$$

Calculation of x and y Component

Step 1:

Inversion of the radius correction.

$$\tilde{r}_{xy}=r_{xy}\frac{\cos\left(\dfrac{\varphi(\tilde{P}_2)-\varphi(\tilde{P}_1)}{2}\right)}{\cos\left(\dfrac{\varphi(\tilde{P}_2)+\varphi(\tilde{P}_1)}{2}-\varphi\right)}$$

Step 2:

Calculation of $\tilde{x}$ and $\tilde{y}$.

$$\tilde{x}=\begin{cases}-\tilde{r}_{xy}\sin\varphi & \text{for } |\varphi|\le 90°\\ -\tilde{r}_{xy}\sin(180°-\varphi) & \text{for } 90°<|\varphi|\le 180°\end{cases}$$

$$\tilde{y}=\begin{cases}\tilde{r}_{xy}\cos\varphi & \text{for } |\varphi|\le 90°\\ -\tilde{r}_{xy}\cos(180°-|\varphi|) & \text{for } 90°<|\varphi|\le 180°\end{cases}$$

Step 3:

Calculation of x and y.

$$P=\begin{pmatrix}x\\ y\end{pmatrix}=\underline{T}^{-1}\,\tilde{P}$$

Mapping Rule for Spread Metadata:

Encoder (Cart→Sph): (Note: shall not use uniform spread signaling)

$$s_\varphi=\frac{180°}{4}\,(s_x+s_y)^2$$

$$s_d=D\cdot\begin{cases}s_y & \text{for } |\varphi|\le 45°\\ s_x & \text{for } 45<|\varphi|<135°\\ s_y & \text{for } 135\le|\varphi|\le 180°\end{cases}\quad\text{with } D=$$

-continued 15.5 is the maximum distance value $$s_\theta=90°\cdot s_z$$

width spread: $s_\varphi$, height spread: $s_\theta$ and distance spread: $s_d$

Decoder (Sph→Cart)

$$s_x=\begin{cases}\sqrt{\dfrac{4\,s_\varphi}{180°}}-\dfrac{s_d}{D} & \text{for } |\varphi|\le 45°\\ \dfrac{s_d}{D} & \text{for } 45<|\varphi|<135°\\ \sqrt{\dfrac{4\,s_\varphi}{180°}}-\dfrac{s_d}{D} & \text{for } 135\le|\varphi|\le 180°\end{cases}$$

$$s_y=\begin{cases}\dfrac{s_d}{D} & \text{for } |\varphi|\le 45°\\ \sqrt{\dfrac{4\,s_\varphi}{180°}}-\dfrac{s_d}{D} & \text{for } 45<|\varphi|<135°\\ \dfrac{s_d}{D} & \text{for } 135\le|\varphi|\le 180°\end{cases}$$

$$s_z=\frac{1}{90°}\cdot s_\theta$$

In case of uniform spread in the bitstream the conversion is:

$$s_x=s_y=s_z=\frac{1}{180°}\cdot s_{\varphi\,uniform}$$

Limit $s_x$, $s_y$, and $s_z$ to ranges between [0, 1].

11. Further Remarks

As a general remark, it should be noted that it is not necessary to use exactly 4 segments or triangles. For example, the segments (or triangles, like Cartesian domain triangles and spherical domain triangles) can be defined by the loudspeaker positions of the horizontal plane of the loudspeaker setup. For example, in a 5.1+4 height speakers (elevated speakers) setup, the segments or triangles may be defined by the 5.1 base setup. Accordingly, 5 segments may be defined in this example (see, for example, the description in section 10). In a 7.1+4 height speakers (elevated speakers) setup, 7 segments or triangles may be defined. This may, for example, be represented by the more generic equations shown in section 10 (which do not comprise fixed angles). Also, the angles of the height speakers (elevated speakers) may, for example, differ from setup to setup (for example, 30 degree or 35 degree).

Thus, the number of triangles and the angle ranges may, for example, vary from embodiment to embodiment.

12. Implementation Alternatives

Any of the features and functionalities described herein can be implemented in hardware or in software, or using a combination of hardware and software, as will be described in this section.

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus. Some or all of the method steps may be executed by (or using) a hardware apparatus, like for example, a microprocessor, a programmable computer or an electronic circuit. In some embodiments, one or more of the most important method steps may be executed by such an apparatus.

Depending on certain implementation requirements, embodiments of the invention can be implemented in hardware or in software. The implementation can be performed using a digital storage medium, for example a floppy disk, a DVD, a Blu-Ray, a CD, a ROM, a PROM, an EPROM, an EEPROM or a FLASH memory, having electronically readable control signals stored thereon, which cooperate (or are capable of cooperating) with a programmable computer system such that the respective method is performed. Therefore, the digital storage medium may be computer readable.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein. The data carrier, the digital storage medium or the recorded medium are typically tangible and/or non-transitionary.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

A further embodiment according to the invention comprises an apparatus or a system configured to transfer (for example, electronically or optically) a computer program for performing one of the methods described herein to a receiver. The receiver may, for example, be a computer, a mobile device, a memory device or the like. The apparatus or system may, for example, comprise a file server for transferring the computer program to the receiver.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods are advantageously performed by any hardware apparatus.

The apparatus described herein may be implemented using a hardware apparatus, or using a computer, or using a combination of a hardware apparatus and a computer.

The apparatus described herein, or any components of the apparatus described herein, may be implemented at least partially in hardware and/or in software.

The methods described herein may be performed using a hardware apparatus, or using a computer, or using a combination of a hardware apparatus and a computer.

The methods described herein, or any components of the apparatus described herein, may be performed at least partially by hardware and/or by software.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

The invention claimed is:

1. An apparatus for converting an object position of an audio object from a Cartesian representation to a spherical representation, wherein a base area of the Cartesian representation is subdivided into a plurality of base area triangles, and wherein a plurality of associated spherical-domain triangles are inscribed into a circle of the spherical representation, wherein the apparatus comprises a triangle determinator configured to determine, in which of the base area triangles a projection of the object position of the audio object into the base area is arranged; and wherein the apparatus comprises a mapped position determinator configured to determine a mapped position of the projection of the object position using a linear transform, which maps the base area triangle onto its associated spherical domain triangle, wherein the apparatus comprises an azimuth angle derivator configured to derive an azimuth angle and an intermediate radius value from the mapped position;

wherein the apparatus is configured to acquire a spherical domain radius value and an elevation angle in dependence on the intermediate radius value and in dependence on a distance of the object position from the base area.

2. The apparatus according to claim 1, wherein the apparatus is configured to determine the mapped position $\tilde{P}$ of the projection P of the object position using a linear transform described by a transform matrix T according to $$\tilde{P} = \begin{pmatrix} \tilde{x} \\ \tilde{y} \end{pmatrix} = \underline{T}\, P,$$

wherein the apparatus is configured to acquire the transform matrix in dependence the determined base area triangle, and wherein $\tilde{x}$ represents a first coordinate of the mapped position $\tilde{P}$ and $\tilde{y}$ represents a second coordinate of the mapped position $\tilde{P}$.

3. The apparatus according to claim 2, wherein the transform matrix is defined according to $$T = \begin{bmatrix} t_{11} & t_{12} \\ t_{21} & t_{22} \end{bmatrix} = \frac{1}{P_{1,x}P_{2,y} - P_{2,x}P_{1,y}} \begin{bmatrix} \tilde{P}_{1,x}P_{2,y} - \tilde{P}_{2,x}P_{1,y} & P_{1,x}\tilde{P}_{2,x} - \tilde{P}_{1,x}P_{2,x} \\ \tilde{P}_{1,y}P_{2,y} - \tilde{P}_{2,y}P_{1,y} & P_{1,x}\tilde{P}_{2,y} - \tilde{P}_{1,y}P_{2,x} \end{bmatrix}$$

wherein $P_{1,x}$, $P_{1,y}$, $P_{2,x}$, $P_{2,y}$ are x- and y-coordinates of two corners of the determined base area triangle; and wherein $\tilde{P}_{1,x}$, $\tilde{P}_{1,y}$, $\tilde{P}_{2,x}$, $\tilde{P}_{2,y}$ are x- and y-coordinates of two corners of the associated spherical domain triangle.

4. The apparatus according to claim 1, wherein the base area triangles comprise a first base area triangle which covers an area in front of an origin of the Cartesian representation, a second base area triangle which covers an area on a left side of the origin of the Cartesian representation, a third base area triangle which covers an area on a right side of the origin of the Cartesian representation, and a fourth base area triangle which covers an area behind the origin of the Cartesian representation.

5. The apparatus according to claim 1, wherein the spherical domain triangles comprise a first spherical domain triangle which covers an area in front of an origin of the spherical representation, a second spherical domain triangle which covers an area on a left side of the origin of the spherical representation, a third spherical domain triangle which covers an area on a right side of the origin of the spherical representation, and a fourth spherical domain triangle which covers an area behind the origin of the spherical representation.

6. The apparatus according to claim 1, wherein the base area triangles comprise a first base area triangle which covers an area in a right front region of an origin of the Cartesian representation, a second base area triangle which covers an area in a left front region of the origin of the Cartesian representation a third base area triangle which covers an area on a left side of the origin of the Cartesian representation, a fourth base area triangle which covers an area on a right side of the origin of the Cartesian representation, and a fifth base area triangle which covers an area behind the origin of the Cartesian representation.

7. The apparatus according to claim 1, wherein the spherical domain triangles comprise a first spherical domain triangle which covers an area in a right front area of an origin of the spherical representation, a second spherical domain triangle which covers an area in a left front area of the origin of the spherical representation, a third spherical domain triangle which covers an area on a left side of the origin of the spherical representation, a fourth spherical domain triangle which covers an area on a right side of the origin of the spherical representation, and a fifth spherical domain triangle which covers an area behind the origin of the spherical representation.

8. The apparatus according to claim 1, wherein coordinates P1, P2 of corners of the base area triangles and coordinates $\tilde{P}_1$ and $\tilde{P}_2$ of corners of the associated spherical domain triangles are defined as follows:

| | $P_1$ | $P_2$ | $\tilde{P}_1$ | $\tilde{P}_2$ |
|---|---|---|---|---|
| Triangle pair 1 | (1, 1) | (−1, 1) | $\left(\sin 30° = \frac{\sqrt{3}}{2}, \cos 30° = \frac{1}{2}\right)$ | $\left(-\frac{\sqrt{3}}{2}, \frac{1}{2}\right)$ |
| Triangle pair 2 | (−1, 1) | (−1, −1) | $\left(-\frac{\sqrt{3}}{2}, \frac{1}{2}\right)$ | (−0.93969, −0.34202) |
| Triangle pair 3 | (−1, −1) | (1, −1) | (−cos(110° − 90°) = −0.93969, −sin(20°) = −0.34202) | (0.93969, −0.34202) |
| Triangle pair 4 | (1, −1) | (1, 1) | (0.93969, −0.34202) | $\left(\frac{\sqrt{3}}{2}, \frac{1}{2}\right)$ |

wherein a third corner of the respective triangles is in an origin of the respective coordinate system.

9. The apparatus according to claim 1, wherein coordinates P1, P2 of corners of the base area triangles and coordinates $\tilde{P}_1$ and $\tilde{P}_2$ of corners of the associated spherical domain triangles are defined as follows:

| | $P_1$ | $P_2$ | $\tilde{P}_1$ | $\tilde{P}_2$ |
|---|---|---|---|---|
| Triangle pair 1 | (0, 1) | (−1, 1) | $\varphi_{Sp} = 0°$, $r_{Sp} = 1$ (0, 1) | $\varphi_{Sp} = 30°$, $r_{Sp} = 1$ $\left(-\frac{1}{2}, \frac{\sqrt{3}}{2}\right)$ |
| Triangle pair 2 | (−1, 1) | (−1, −1) | $\varphi_{Sp} = 30°$, $r_{Sp} = 1$ $\left(-\frac{1}{2}, \frac{\sqrt{3}}{2}\right)$ | $\varphi_{Sp} = 110°$, $r_{Sp} = 1$ (−0.93969, −0.34202) |
| Triangle pair 3 | (−1, −1) | (1, −1) | $\varphi_{Sp} = 110°$, $r_{Sp} = 1$ (−0.93969, −0.34202) | $\varphi_{Sp} = -110°$, $r_{Sp} = 1$ (0.93969, −0.34202) |
| Triangle pair 4 | (1, −1) | (1, 1) | $\varphi_{Sp} = -110°$, $r_{Sp} = 1$ (0.93969, −0.34202 | $\varphi_{Sp} = -30°$, $r_{Sp} = 1$ $\left(\frac{1}{2}, \frac{\sqrt{3}}{2}\right)$ |
| Triangle pair 5 | (1, 1) | (0, 1) | $\varphi_{Sp} = -30°$, $r_{Sp} = 1$ $\left(\frac{1}{2}, \frac{\sqrt{3}}{2}\right)$ | $\varphi_{Sp} = 0°$, $r_{Sp} = 1$ (0, 1) |

wherein a third corner of the respective triangles is in an origin of the respective coordinate system.

10. The apparatus according to claim 1, wherein the apparatus is configured to derive the azimuth angle $\varphi$ from mapped coordinates $\tilde{X}$ and $\tilde{y}$ of the mapped position according to $$\varphi = \begin{cases} \tan^{-1}\frac{-\tilde{x}}{\tilde{y}} \text{ for } \tilde{y} > 0 \\ -90^\circ \text{ for } \tilde{y} = 0 \wedge \tilde{x} > 0 \\ 0^\circ \text{ for } \tilde{y} = 0 \wedge \tilde{x} = 0 \\ 90^\circ \text{ for } \tilde{y} = 0 \wedge \tilde{x} < 0 \\ -90^\circ + \tan^{-1}\frac{\tilde{y}}{\tilde{x}} \text{ for } \tilde{y} < 0 \wedge \tilde{x} > 0 \\ -180^\circ \text{ for } \tilde{y} < 0 \wedge \tilde{x} = 0 \\ 90^\circ + \tan^{-1}\frac{\tilde{y}}{\tilde{x}} \text{ for } \tilde{y} < 0 \wedge \tilde{x} < 0 \end{cases}.$$

11. The apparatus according to claim 1, wherein the apparatus is configured to derive the intermediate radius value $\tilde{r}_{xy}$ from mapped coordinates $\tilde{x}$ and $\tilde{y}$ of the mapped position according to $$\tilde{r}_{xy} = \sqrt{\tilde{x}^2 + \tilde{y}^2}$$

12. The apparatus according to claim 1, wherein the apparatus is configured to acquire the spherical domain radius value in dependence on the intermediate radius value using a radius adjustment which maps a spherical domain triangle inscribed into the circle onto a circle segment.

13. The apparatus according to claim 1, wherein the apparatus is configured to acquire the spherical domain radius value in dependence on the intermediate radius value using a radius adjustment, wherein the radius adjustment is adapted to scale the intermediate radius value acquired before in dependence on the azimuth angle $\varphi$.

14. The apparatus according to claim 1, wherein the apparatus is configured to acquire the spherical domain radius value in dependence on the intermediate radius value using a mapping of the form for $|\varphi| \leq 30^\circ$:

$$r_{xy} = \tilde{r}_{xy}\frac{\cos\varphi}{\cos 30^\circ}$$

for $30^\circ < |\varphi| \leq 100^\circ$:

$$r_{xy} = \tilde{r}_{xy}\frac{\cos(70^\circ - |\varphi|)}{\cos 80^\circ}$$

for $110^\circ < |\varphi| \leq 180^\circ$:

$$r_{xy} = \tilde{r}_{xy}\frac{\cos(180^\circ - |\varphi|)}{\cos 140^\circ}$$

wherein $r_{xy}$ is a radius-adjusted version of the intermediate radius value $\tilde{r}_{xy}$; and wherein $\varphi$ is an azimuth angle.

15. The apparatus according to claim 1, wherein the apparatus is configured to acquire the spherical domain radius value $r_{xy}$ in dependence on the intermediate radius value $\tilde{r}_{xy}$ using a mapping of the form for $\varphi(\tilde{P}_1) < \varphi \leq \varphi(\acute{P}_2)$:

$$r_{xy} = \tilde{r}_{xy}\frac{\cos\left(\frac{\varphi(\tilde{P}_2) + \varphi(\tilde{P}_1)}{2} - \varphi\right)}{\cos\left(\frac{\varphi(\tilde{P}_2) - \varphi(\tilde{P}_1)}{2}\right)}$$

wherein $\varphi(\tilde{P}_1)$ and $\varphi(\tilde{P}_2)$ are position angles of two corners of a respective spherical domain triangle.

16. The apparatus according to claim 1, wherein the apparatus is configured to acquire the elevation angle as an angle of a right triangle comprising legs of the intermediate radius value and of the distance of the object position from the base area.

17. The apparatus according to claim 1, wherein the apparatus is configured to acquire the spherical domain radius as a hypotenuse length $\tilde{r}$ of a right triangle comprising legs of the intermediate radius value and of the distance of the object position from the base area, or as an adjusted version thereof.

18. The apparatus according to claim 1, wherein the apparatus is configured to acquire the elevation angle $\theta$ according to $$\tilde{\theta} = \tan^{-1}\frac{z}{r_{xy}}$$

and/or to acquire the spherical domain radius f according to $$\tilde{r} = \sqrt{r_{xy}^2 + z^2},$$

wherein z is the distance of the object position from the base area, and wherein $r_{xy}$ is the intermediate radius value, or an adjusted version thereof.

19. The apparatus according to claim 1, wherein the apparatus is configured to acquire an adjusted elevation angle.

20. The apparatus according to claim 19, wherein the apparatus is configured to acquire the adjusted elevation angle using a non-linear mapping which linearly maps angles in a first angle region onto a first mapped angle region and which linearly maps angles within a second angle region onto a second mapped angle region, wherein the first angle region comprises a different width when compared to the first mapped angle region.

21. The apparatus according to claim 20, wherein an angle range covered together by first angle region and the second angle region is identical to an angle range covered together by the first mapped angle region and the second mapped angle region.

22. The apparatus according to claim 19, wherein the apparatus is configured to mapping the elevation angle $\tilde{\theta}$ onto the adjusted elevation angle $\theta$ according to $$\theta = \begin{cases} \tilde{\theta}\frac{30^\circ}{45^\circ} & \text{for } \tilde{\theta} \leq 45^\circ \\ (\tilde{\theta} - 45^\circ)\frac{(90^\circ - 30^\circ)}{45^\circ} + 30^\circ & \text{for } 45^\circ < \tilde{\theta} < 90^\circ \end{cases}.$$

23. The apparatus according to claim 19, wherein the apparatus is configured to mapping the elevation angle θ onto the adjusted elevation angle θ according to $$\theta = \begin{cases} \tilde{\theta}\dfrac{\theta_{Top}}{\tilde{\theta}_{Top}} & \text{for } \tilde{\theta} \le \tilde{\theta}_{Top} \\ (\tilde{\theta} - \tilde{\theta}_{Top})\dfrac{(90^\circ - \theta_{Top})}{\tilde{\theta}_{Top}} + \theta_{Top} & \text{for } \tilde{\theta}_{Top} < \tilde{\theta} < 90^\circ \end{cases}$$

wherein $\theta_{Top}$ is an elevation angle of elevated loudspeakers in the Cartesian coordinate system; and wherein $\theta_{Top}$ is an elevation angle of elevated loudspeakers in the spherical coordinate system.

24. The apparatus according to claim 1, wherein the apparatus is configured to acquire an adjusted spherical domain radius on the basis of a spherical domain radius.

25. The apparatus according to claim 24, wherein the apparatus is configured to perform a mapping, which maps boundaries of a square in a Cartesian system onto a circle in a spherical coordinate system, in order to acquire an adjusted spherical domain radius.

26. The apparatus according to claim 24, wherein the apparatus is configured to map the spherical domain radius $\tilde{r}$ onto the adjusted spherical domain radius r according to:

for $0 \le \tilde{\theta} \le 45^\circ$:

$$r = \tilde{r} \cos \tilde{\theta}$$

for $45^\circ \le \tilde{\theta} \le 90^\circ$:

$$r = \tilde{r} \sin \tilde{\theta}$$

wherein $\tilde{\theta}$ is the elevation angle.

27. An audio stream provider for providing an audio stream, wherein the audio stream provider is configured to receive input object position information describing a position of an audio object in a Cartesian representation and to provide an audio stream comprising output object position information describing the position of the object in a spherical representation, wherein the audio stream provider comprises an apparatus according to claim 1 in order to convert the Cartesian representation into the spherical representation.

28. An audio content production system, wherein the audio content production system is configured to determine an object position information describing a position of an audio object in a Cartesian representation, and wherein the audio content production system comprises an apparatus according to claim 1 in order to convert the Cartesian representation into the spherical representation, and wherein the audio content production system is configured to incorporate the spherical representation into an audio stream.

29. An audio playback apparatus, wherein the audio playback apparatus is configured to receive an audio stream comprising a Cartesian representation of an object position information, and wherein the audio playback apparatus comprises an apparatus according to claim 1, which is configured to convert the Cartesian representation into a spherical representation of the object position information, and wherein the audio playback apparatus comprises a renderer configured to render an audio object to a plurality of channel signals associated with sound transducers in dependence on the spherical representation of the object position information.

30. An audio playback apparatus, wherein the audio playback apparatus is configured to receive an audio stream comprising a Cartesian representation of an object position information, and wherein the audio playback apparatus comprises an apparatus according to claim 1, which is configured to convert the Cartesian representation into a spherical representation of the object position information, and wherein the audio playback apparatus comprises a renderer configured to render an audio object to a plurality of channel signals associated with sound transducers in dependence on the spherical representation of the object position information.

31. An apparatus for converting an object position of an audio object from a spherical representation to a Cartesian representation, wherein a base area of the Cartesian representation is subdivided into a plurality of base area triangles, and wherein a plurality of spherical-domain triangles are inscribed into a circle of the spherical representation, wherein the apparatus is configured to acquire a value describing a distance of the object position from the base area and an intermediate radius on the basis of an elevation angle or a mapped elevation angle and on the basis of a spherical domain radius or a mapped spherical domain radius;

wherein the apparatus comprises a position determinator configured to determine a position within one of the triangles inscribed into the circle on the basis of the intermediate radius, or a corrected version thereof, and on the basis of an azimuth angle; and wherein the apparatus comprises a mapper configured to determine a mapped position of the projection of the object position onto the base area on the basis of the determined position within one of the triangles inscribed into the circle.

32. The apparatus according to claim 31, wherein the apparatus is configured to acquire a mapped elevation angle on the basis of an elevation angle.

33. The apparatus according to claim 32, wherein the apparatus is configured to acquire the mapped elevation angle using a non-linear mapping which linearly maps angles in a first angle region onto a first mapped angle region and which linearly maps angles within a second angle region onto a second mapped angle region, wherein the first angle region comprises a different width when compared to the first mapped angle region.

34. The apparatus according to claim 33, wherein an angle range covered together by the first angle region and the second angle region is identical to an angle range covered together by the first mapped angle region and the second mapped angle region.

35. The apparatus according to claim 32, wherein the apparatus is configured to map the elevation angle θ onto the mapped elevation angle $\tilde{\theta}$ according to $$\tilde{\theta} = \begin{cases} \theta\dfrac{45^\circ}{30^\circ} & \text{for } \theta \le 30^\circ \\ (\theta - 30^\circ)\dfrac{45^\circ}{(90^\circ - 30^\circ)} + 45^\circ & \text{for } 30^\circ < \theta < 90^\circ \end{cases}.$$

36. The apparatus according to claim 32, wherein the apparatus is configured to map the elevation angle θ onto the mapped elevation angle $\tilde{\theta}$ according to $$\tilde{\theta} = \begin{cases} \theta \dfrac{\tilde{\theta}_{Top}}{\theta_{Top}} & \text{for } \theta \le \theta_{Top} \\ (\theta - \theta_{Top}) \dfrac{\tilde{\theta}_{Top}}{(90^\circ - \theta_{Top})} + \tilde{\theta}_{Top} & \text{for } \theta_{Top} < \theta < 90^\circ \end{cases}$$

wherein $\theta_{Top}$ is an elevation angle of elevated loudspeakers in the Cartesian coordinate system; and wherein $\tilde{\theta}_{Top}$ is an elevation angle of elevated loudspeakers in the spherical coordinate system.

37. The apparatus according to claim 31, wherein the apparatus is configured to acquire a mapped spherical domain radius $\tilde{r}$ on the basis of a spherical domain radius.

38. The apparatus according to claim 37, wherein the apparatus is configured to scale the spherical domain radius in dependence on the elevation angle or in dependence on the mapped elevation angle, wherein the apparatus is configured to perform a mapping, which maps a circle in a spherical coordinate system onto boundaries of a square in a Cartesian system.

39. The apparatus according to claim 37, wherein the apparatus is configured to acquire the mapped spherical domain radius $\tilde{r}$ on the basis of a spherical domain radius r according to $$\tilde{r} = \begin{cases} \dfrac{r}{\cos \tilde{\theta}} & \text{for } \tilde{\theta} \le 45^\circ \\ \dfrac{r}{\sin \tilde{\theta}} & \text{for } 45^\circ < \tilde{\theta} < 90^\circ \end{cases}$$

wherein $\tilde{\theta}$ is the elevation angle or the mapped elevation angle.

40. The apparatus according to claim 37, wherein the apparatus is configured to acquire the mapped spherical domain radius $\tilde{r}$ on the basis of a spherical domain radius r according to $$\tilde{r} = \begin{cases} \dfrac{r}{\cos \tilde{\theta}} & \text{for } \tilde{\theta} \le \tilde{\theta}_{Top} \\ \dfrac{r}{\sin \tilde{\theta}} & \text{for } \tilde{\theta}_{Top} < \tilde{\theta} < 90^\circ \end{cases}$$

wherein $\tilde{\theta}$ is the elevation angle or the mapped elevation angle, and wherein $\tilde{\theta}_{Top}$ is an elevation angle of elevated loudspeakers in the spherical coordinate system.

41. The apparatus according to claim 31, wherein the apparatus is configured to acquire the value z describing a distance of the object position from the base area according to $$z = \tilde{r} \sin \tilde{\theta}$$

and/or wherein the apparatus is configured to acquire the intermediate radius $r_{xy}$ according to $$r_{xy} = \tilde{r} \cos \tilde{\theta},$$

wherein $\tilde{r}$ is the spherical domain radius or the mapped spherical domain radius; and wherein $\tilde{\theta}$ is the elevation angle or the mapped elevation angle.

42. The apparatus according to claim 31, wherein the apparatus is configured to perform a radius correction using a mapping which maps circle segments onto triangles inscribed in a circle.

43. The apparatus according to claim 31, wherein the apparatus is configured to scale the intermediate radius in dependence on the azimuth angle, to acquire a corrected radius.

44. The apparatus according to claim 31, wherein the apparatus is configured to acquire the corrected radius $\tilde{r}_{xy}$ on the basis of the intermediate radius $r_{xy}$ according to $$\tilde{r}_{xy} = \begin{cases} r_{xy} \dfrac{\cos 30^\circ}{\cos \varphi} & \text{for } |\varphi| \le 30^\circ \\ r_{xy} \dfrac{\cos 80^\circ}{\cos(70^\circ - |\varphi|)} & \text{for } 30^\circ < |\varphi| \le 110^\circ \\ r_{xy} \dfrac{\cos 140^\circ}{\cos(180^\circ - |\varphi|)} & \text{for } 110^\circ < |\varphi| \le 180^\circ \end{cases}$$

wherein φ is the azimuth angle.

45. The apparatus according to claim 31, wherein the apparatus is configured to acquire the corrected radius $\tilde{r}_{xy}$ on the basis of the intermediate radius $r_{xy}$ according to $$\tilde{r}_{xy} = r_{xy} \frac{\cos\left(\dfrac{\varphi(\tilde{P}_2) + \varphi(\tilde{P}_1)}{2}\right)}{\cos\left(\dfrac{\varphi(\tilde{P}_2) - \varphi(\tilde{P}_1)}{2} - \varphi\right)}$$

wherein φ is the azimuth angle, and wherein $\varphi(\tilde{P}_1)$ and $\varphi(\tilde{P}_2)$ are position angles of two corners of a respective spherical domain triangle.

46. The apparatus according to claim 31, wherein the apparatus is configured to determine a position within one of the triangles inscribed into the circle according to $$\tilde{x} = \begin{cases} -\tilde{r}_{xy} \sin \varphi & \text{for } |\varphi| \le 90^\circ \\ -\tilde{r}_{xy} \sin(180^\circ - \varphi) & \text{for } 90^\circ < |\varphi| \le 180^\circ \end{cases}$$

$$\tilde{y} = \begin{cases} -\tilde{r}_{xy} \cos \varphi & \text{for } |\varphi| \le 90^\circ \\ -\tilde{r}_{xy} \cos(180^\circ - |\varphi|) & \text{for } 90^\circ < |\varphi| \le 180^\circ \end{cases}$$

wherein $\tilde{x}$ and $\tilde{y}$ are coordinate values;

wherein $\tilde{r}_{xy}$ is the intermediate radius or the corrected radius; and wherein φ is the azimuth angle.

47. The apparatus according to claim 31, wherein the apparatus is configured to determine the mapped position of the projection of the object position onto the base area on the basis of the determined position within one of the triangles inscribed into the circle using a linear transform mapping the triangle in which the determined position lies, onto an associated triangle in the base area.

48. The apparatus according to claim 31, wherein the apparatus is configured to determine the mapped position of the projection P of the object position onto the base area according to $$P = \begin{pmatrix} x \\ y \end{pmatrix} = \underline{T}^{-1}\ \tilde{P}$$

wherein T is a transform matrix, and wherein $\tilde{P}$ is a vector representing the projection of the object position onto the base area, and wherein x represents a first coordinate of the mapped position of the projection P within the base area and y represents a second coordinate of the mapped position of the projection P within the base area.

49. The apparatus according to claim 48, wherein the transform matrix is defined according to $$\underline{T} = \begin{bmatrix} t_{11} & t_{12} \\ t_{21} & t_{22} \end{bmatrix} = \frac{1}{P_{1,x}P_{2,y} - P_{2,x}P_{1,y}} \begin{bmatrix} \tilde{P}_{1,x}P_{2,y} - \tilde{P}_{2,x}P_{1,y} & P_{1,x}\tilde{P}_{2,x} - \tilde{P}_{1,x}P_{2,x} \\ \tilde{P}_{1,y}P_{2,y} - \tilde{P}_{2,y}P_{1,y} & P_{1,x}\tilde{P}_{2,y} - \tilde{P}_{1,y}P_{2,x} \end{bmatrix}$$

wherein $P_{1,x}$, $P_{1,y}$, $P_{2,x}$, $P_{2,y}$ are x- and y-coordinates of two corners of the determined base area triangle; and wherein $\tilde{P}_{1,x}$, $\tilde{P}_{1,y}$, $\tilde{P}_{2,x}$, $\tilde{P}_{2,y}$ are x- and y-coordinates of two corners of the associated spherical domain triangle.

50. The apparatus according to claim 31, wherein the base area triangles comprise a first base area triangle which covers an area in front of an origin of the Cartesian representation, a second base area triangle which covers an area on a left side of the origin of the Cartesian representation, a third base area triangle which covers an area on a right side of the origin of the Cartesian representation, and a fourth base area triangle which covers an area behind the origin of the Cartesian representation.

51. The apparatus according to claim 31, wherein the spherical domain triangles comprise a first spherical domain triangle which covers an area in front of an origin of the spherical representation, a second spherical domain triangle which covers an area on a left side of the origin of the spherical representation, a third spherical domain triangle which covers an area on a right side of the origin of the spherical representation, and a fourth spherical domain triangle which covers an area behind the origin of the spherical representation.

52. The apparatus according to claim 31, wherein the base area triangles comprise a first base area triangle which covers an area in a right front region of an origin of the Cartesian representation, a second base area triangle which covers an area in a left front region of the origin of the Cartesian representation a third base area triangle which covers an area on a left side of the origin of the Cartesian representation, a fourth base area triangle which covers an area on a right side of the origin of the Cartesian representation, and a fifth base area triangle which covers an area behind the origin of the Cartesian representation.

53. The apparatus according to claim 31, wherein the spherical domain triangles comprise a first spherical domain triangle which covers an area in a right front area of an origin of the spherical representation, a second spherical domain triangle which covers an area in a left front area of the origin of the spherical representation, a third spherical domain triangle which covers an area on a left side of the origin of the spherical representation, a fourth spherical domain triangle which covers an area on a right side of the origin of the spherical representation, and a fifth spherical domain triangle which covers an area behind the origin of the spherical representation.

54. The apparatus according to claim 31, wherein coordinates P1, P2 of corners of the base area triangles and coordinates of corners of the associated spherical domain triangles $\tilde{P}_1$ and $\tilde{P}_2$ are defined as follows:

| | $P_1$ | $P_2$ | $\tilde{P}_1$ | $\tilde{P}_2$ |
|---|---|---|---|---|
| Triangle pair 1 | (1, 1) | (−1, 1) | $\left(\sin 30° = \frac{\sqrt{3}}{2}, \cos 30° = \frac{1}{2}\right)$ | $\left(-\frac{\sqrt{3}}{2}, \frac{1}{2}\right)$ |
| Triangle pair 2 | (−1, 1) | (−1, −1) | $\left(-\frac{\sqrt{3}}{2}, \frac{1}{2}\right)$ | (−0.93969, −0.34202) |
| Triangle pair 3 | (−1, −1) | (1, −1) | (−cos(110° − 90°) = −0.93969, −sin(20°) = −0.34202) | (0.93969, −0.34202) |
| Triangle pair 4 | (1, −1) | (1 ,1) | (0.93969, −0.34202) | $\left(\frac{\sqrt{3}}{2}, \frac{1}{2}\right)$ |

wherein a third corner of the respective triangles is in an origin of the respective coordinate system.

55. An audio playback apparatus, wherein the audio playback apparatus is configured to receive an audios stream comprising a spherical representation of an object position information, and wherein the audio playback apparatus comprises an apparatus according to claim 31, which is configured to convert the spherical representation into a Cartesian representation of the object position information, and wherein the audio playback apparatus comprises a renderer configured to render an audio object to a plurality of channel signals associated with sound transducers in dependence on the Cartesian representation of the object position information.

56. An audio stream provider for providing an audio stream, wherein the audio stream provider is configured to receive input object position information describing a position of an audio object in a spherical representation and to provide an audio stream comprising output object position information describing the position of the object in a Cartesian representation, wherein the audio stream provider comprises an apparatus according to claim 31 in order to convert the spherical representation into the Cartesian representation.

57. An audio content production system, wherein the audio content production system is configured to determine an object position information describing a position of an audio object in a spherical representation, and wherein the audio content production system comprises an apparatus according to claim 31 in order to convert the spherical representation into a Cartesian representation, and wherein the audio content production system is configured to incorporate the Cartesian representation into an audio stream.

58. A method for converting an object position of an audio object from a Cartesian representation to a spherical representation, wherein a base area of the Cartesian representation is subdivided into a plurality of base area triangles, and wherein a plurality of associated spherical-domain triangles are inscribed into a circle of the spherical representation, wherein the method comprises determining, in which of the base area triangles a projection of the object position of the audio object into the base area is arranged; and wherein the method comprises determining a mapped position of the projection of the object position using a linear transform, which maps the base area triangle onto its associated spherical domain triangle, wherein the method comprises deriving an azimuth angle [φ] and an intermediate radius value from the mapped position;

wherein the method comprises acquiring a spherical domain radius value and an elevation angle in dependence on the intermediate radius value and in dependence on a distance of the object position from the base area.

59. A non-transitory digital storage medium having a computer program stored thereon to perform the method according to claim 58 when said computer program is run by a computer.

60. A method for providing an audio stream, wherein the method comprises receiving input object position information describing a position of an audio object in a Cartesian representation and providing an audio stream comprising output object position information describing the position of the object in a spherical representation, wherein the method comprises converting the Cartesian representation into the spherical representation using the method according to claim 58.

61. A non-transitory digital storage medium having a computer program stored thereon to perform the method according to claim 60 when said computer program is run by a computer.

62. A method for producing an audio content, wherein the method comprises determining an object position information describing a position of an audio object in a Cartesian representation, and wherein the method comprises converting the Cartesian representation into the spherical representation using the method according to claim 58, and wherein the method comprises incorporating the spherical representation into an audio stream.

63. A non-transitory digital storage medium having a computer program stored thereon to perform the method according to claim 62 when said computer program is run by a computer.

64. A method for audio playback, wherein the method comprises receiving an audios stream comprising a spherical representation of an object position information, and wherein the method comprises converting the spherical representation into a Cartesian representation of the object position information according to claim 58, and wherein the method comprises rendering an audio object to a plurality of channel signals associated with sound transducers in dependence on the Cartesian representation of the object position information.

65. A non-transitory digital storage medium having a computer program stored thereon to perform the method according to claim 64 when said computer program is run by a computer.

66. A method for providing an audio stream, wherein the method comprises receiving input object position information describing a position of an audio object in a spherical representation and providing an audio stream comprising output object position information describing the position of the object in a Cartesian representation, wherein the method comprises converting the spherical representation into the Cartesian representation using the method according to claim 58.

67. A non-transitory digital storage medium having a computer program stored thereon to perform the method according to claim 66 when said computer program is run by a computer.

68. A method for producing an audio content, wherein the method comprises determining an object position information describing a position of an audio object in a spherical representation, and wherein the method comprises converting the spherical representation into the Cartesian representation using the method according to claim 58, and wherein the method comprises incorporating the Cartesian representation into an audio stream.

69. A non-transitory digital storage medium having a computer program stored thereon to perform the method according to claim 68 when said computer program is run by a computer.

70. A method for audio playback, wherein the method comprises receiving an audios stream comprising a Cartesian representation of an object position information, and wherein the method comprises converting the Cartesian representation into a spherical representation of the object position information according to claim 58, and wherein the method comprises rendering an audio object to a plurality of channel signals associated with sound transducers in dependence on the spherical representation of the object position information.

71. A non-transitory digital storage medium having a computer program stored thereon to perform the method according to claim 70 when said computer program is run by a computer.

72. A method for converting an object position of an audio object from a spherical representation to a Cartesian representation, wherein a base area of the Cartesian representation is subdivided into a plurality of base area triangles, and wherein a plurality of spherical-domain triangles are inscribed into a circle of the spherical representation, wherein the method comprises acquiring a value describing a distance of the object position from the base area and an intermediate radius on the basis of an elevation angle or a mapped elevation angle and on the basis of a spherical domain radius or a mapped spherical domain radius;

wherein the method comprises determining a position within one of the triangles inscribed into the circle on the basis of the intermediate radius, or a corrected version thereof, and on the basis of an azimuth angle [φ]; and wherein the method comprises determining a mapped position of the projection of the object position onto the base area on the basis of the determined position within one of the triangles inscribed into the circle.

73. A non-transitory digital storage medium having a computer program stored thereon to perform the method according to claim 72 when said computer program is run by a computer.

74. An apparatus for converting an object position of an audio object from a Cartesian representation to a spherical representation, in which the object position is described using an azimuth angle, an elevation angle and a spherical domain radius, wherein loudspeakers are placed on a square in a Cartesian coordinate system associated with the Cartesian representation and loudspeakers are placed on a circle in a spherical coordinate system associated with the spherical representation;

wherein a base area of the Cartesian representation is subdivided into a plurality of base area triangles, and wherein a plurality of spherical-domain triangles are inscribed into a circle of the spherical representation, wherein each of the spherical-domain triangles is associated to a base area triangle of the plurality of base area triangles;

wherein positions of corners of at least some of the base area triangles correspond to positions of loudspeakers in the Cartesian coordinate system, and wherein positions of corners of at least some of the spherical-domain triangles correspond to positions of loudspeakers in the spherical coordinate system;

wherein the apparatus comprises a triangle determinator configured to determine, in which of the base area triangles a projection of the object position of the audio object into the base area is arranged; and wherein the apparatus comprises a mapped position determinator configured to determine a mapped position of the projection of the object position using a linear transform, which maps the base area triangle onto an associated spherical domain triangle, wherein the apparatus comprises an azimuth angle derivator configured to derive an azimuth angle and an intermediate radius value from the mapped position;

wherein the apparatus is configured to acquire a spherical domain radius value and an elevation angle in dependence on the intermediate radius value and in dependence on a distance of the object position from the base area.

75. A method for converting an object position of an audio object from a Cartesian representation to a spherical representation, in which the object position is described using an azimuth angle, an elevation angle and a spherical domain radius, wherein loudspeakers are placed on a square in a Cartesian coordinate system associated with the Cartesian representation and loudspeakers are placed on a circle in a spherical coordinate system associated with the spherical representation;

wherein a base area of the Cartesian representation is subdivided into a plurality of base area triangles, and wherein a plurality of spherical-domain triangles are inscribed into a circle of the spherical representation, wherein each of the spherical-domain triangles is associated to a base area triangle of the plurality of base area triangles;

wherein positions of corners of at least some of the base area triangles correspond to positions of loudspeakers in the Cartesian coordinate system, and wherein positions of corners of at least some of the spherical-domain triangles correspond to positions of loudspeakers in the spherical coordinate system;

wherein the method comprises determining, in which of the base area triangles a projection of the object position of the audio object into the base area is arranged; and wherein the method comprises determining a mapped position of the projection of the object position using a linear transform, which maps the base area triangle onto its associated spherical domain triangle, wherein the method comprises deriving an azimuth angle [φ] and an intermediate radius value from the mapped position;

wherein the method comprises acquiring a spherical domain radius value and an elevation angle in dependence on the intermediate radius value and in dependence on a distance of the object position from the base area.

76. An apparatus for converting an object position of an audio object from a spherical representation, in which the object position is described using an azimuth angle, an elevation angle and a spherical domain radius, to a Cartesian representation, wherein loudspeakers are placed on a square in a Cartesian coordinate system associated with the Cartesian representation and loudspeakers are placed on a circle in a spherical coordinate system associated with the spherical representation;

wherein a base area of the Cartesian representation is subdivided into a plurality of base area triangles, and wherein a plurality of spherical-domain triangles are inscribed into a circle of the spherical representation, wherein positions of corners of at least some of the base area triangles correspond to positions of loudspeakers in the Cartesian coordinate system, and wherein positions of corners of at least some of the spherical-domain triangles correspond to positions of loudspeakers in the spherical coordinate system;

wherein the apparatus is configured to acquire a value describing a distance of the object position from the base area and an intermediate radius on the basis of the elevation angle or a mapped elevation angle and on the basis of the spherical domain radius or a mapped spherical domain radius;

wherein the apparatus comprises a position determinator configured to determine a position within one of the triangles inscribed into the circle on the basis of the intermediate radius, or a corrected version thereof in which a radius adjustment, which is made because the loudspeakers are placed on a square in the Cartesian coordinate system in contrast to the spherical coordinate system, is reversed, and on the basis of the azimuth angle; and wherein the apparatus comprises a mapper configured to determine a mapped position of the projection of the object position onto the base area on the basis of the determined position within one of the triangles inscribed into the circle, using a linear transform mapping the triangle in which the determined position lies, onto an associated triangle in the base area, wherein the value describing the distance of the object position from the base area and the mapped position describe the object position in the Cartesian representation.

77. A method for converting an object position of an audio object from a spherical representation, in which the object position is described using an azimuth angle, an elevation angle and a spherical domain radius, to a Cartesian representation, wherein loudspeakers are placed on a square in a Cartesian coordinate system associated with the Cartesian representation and loudspeakers are placed on a circle in a spherical coordinate system associated with the spherical representation;

wherein a base area of the Cartesian representation is subdivided into a plurality of base area triangles, and wherein a plurality of spherical-domain triangles are inscribed into a circle of a spherical representation, wherein positions of corners of at least some of the base area triangles correspond to positions of loudspeakers in the Cartesian coordinate system, and wherein positions of corners of at least some of the spherical-domain triangles correspond to positions of loudspeakers in the spherical coordinate system;

wherein the method comprises acquiring a value describing a distance of the object position from the base area and an intermediate radius on the basis of an elevation angle or a mapped elevation angle and on the basis of a spherical domain radius or a mapped spherical domain radius;

wherein the method comprises determining a position within one of the triangles inscribed into the circle on the basis of the intermediate radius, or a corrected version thereof in which a radius adjustment, which is made because the loudspeakers are placed on a square in the Cartesian coordinate system in contrast to the spherical coordinate system, is reversed, and on the basis of an azimuth angle [φ]; and wherein the method comprises determining a mapped position of the projection of the object position onto the base area on the basis of the determined position within one of the triangles inscribed into the circle, using a linear transform mapping the triangle in which the determined position lies, onto an associated triangle in the base area;

wherein the value describing the distance of the object position from the base area and the mapped position describe the object position in the Cartesian representation.

* * * * *